US006945066B2

(12) United States Patent
Hiwata et al.

(10) Patent No.: US 6,945,066 B2
(45) Date of Patent: Sep. 20, 2005

(54) REFRIGERATION CYCLE APPARATUS

(75) Inventors: Akira Hiwata, Kyoto (JP); Yuji Inoue, Shiga (JP); Yoshikazu Kawabe, Shiga (JP); Noriho Okaza, Shiga (JP); Kazuo Nakatani, Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 4 days.

(21) Appl. No.: 10/655,020

(22) Filed: Sep. 5, 2003

(65) Prior Publication Data

US 2004/0074254 A1 Apr. 22, 2004

(30) Foreign Application Priority Data

Oct. 18, 2002 (JP) ..... 2002-303980

(51) Int. Cl.[7] ..... F25B 13/00; F25B 1/10; F25B 43/00; F25B 9/00

(52) U.S. Cl. ..... 62/324.6; 62/324.1; 62/172; 62/467; 62/510; 62/512

(58) Field of Search ..... 62/324.1–325, 62/172, 467, 510, 512

(56) References Cited

U.S. PATENT DOCUMENTS

| | | | | |
|---|---|---|---|---|
| 4,739,628 | A * | 4/1988 | Shoemaker | 62/324.6 |
| 4,835,979 | A | 6/1989 | Murry et al. | 62/172 |
| 5,711,163 | A * | 1/1998 | Uchikawa et al. | 62/324.6 |
| 6,321,564 | B1 | 11/2001 | Yamanaka et al. | 62/510 |
| 6,606,860 | B2 * | 8/2003 | McFarland | 60/648 |
| 2001/0025509 | A1 | 10/2001 | Fujii et al. | 62/467 |
| 2004/0123621 | A1 * | 7/2004 | Okaza et al. | |

FOREIGN PATENT DOCUMENTS

| | | |
|---|---|---|
| EP | 0 672 877 | 9/1995 |
| EP | 0 837 291 | 4/1998 |
| EP | 1 022 521 | 7/2000 |
| EP | 1 046 869 A1 | 10/2000 |
| EP | 1 046 869 | 10/2000 |
| JP | 59-69661 | 4/1984 |
| JP | 61-96370 | 5/1986 |
| JP | 08-136073 | 5/1996 |
| JP | 09-250830 | 9/1997 |
| JP | 2000-161805 | 6/2000 |
| JP | 2000-234814 | 8/2000 |

(Continued)

OTHER PUBLICATIONS

"Transcritical CO2 Cycle Technology" 2002 SAE Automotive Alternate Refrigerant Systems Symposium, Jul. 2002, pp. 1–17 by Joo Seok Baek, et al.*

Copy of European Patent Office Communication including European Search Report for corresponding European Patent Application No. 03019272 dated May 14, 2004.

Patent Abstracts of Japan 09250830, Sep. 22, 1997.

Patent Abstracts of Japan 2000161805, Jun. 16, 2000.

Patent Abstracts of Japan 2000234814, Aug. 29, 2000.

Patent Abstracts of Japan 2001235246, Aug. 31, 2001.

Patent Abstracts of Japan 2002022298, Jan. 23, 2002.

European Search Report dated Feb. 6, 2004.

*Primary Examiner*—Cheryl Tyler
*Assistant Examiner*—Filip Zec
(74) *Attorney, Agent, or Firm*—Armstrong, Kratz, Quintos, Hanson & Brooks, LLP

(57) ABSTRACT

A refrigeration cycle apparatus using carbon dioxide as a refrigerant has a compressor, an outdoor heat exchanger, an expander, an indoor heat exchanger and an auxiliary compressor. The auxiliary compressor is driven by power recover by the expander. When refrigerant flows using the indoor heat exchanger as an evaporator, a discharge side of the auxiliary compressor becomes a suction side of the compressor, and when refrigerant flows using the indoor heat exchanger as a gas cooler, a discharge side of the compressor becomes a suction side of the auxiliary compressor.

20 Claims, 25 Drawing Sheets

FOREIGN PATENT DOCUMENTS

| | | |
|---|---|---|
| JP | 2001-116371 | 1/2001 |
| JP | 2001-041598 | 2/2001 |
| JP | 2001-235246 | 8/2001 |
| JP | 2002-022298 | 1/2002 |
| JP | 2003-07499 | 3/2003 |
| JP | 2003-121015 | 4/2003 |
| JP | 2003-139429 | 5/2003 |
| JP | 2003-172244 | 6/2003 |
| WO | 02/18848 A1 | 3/2002 |
| WO | 02/18848 | 3/2002 |

* cited by examiner

Fig. 3

Fixed density ratio

| | At the time of cooling operation | | At the time of heating operation | |
|---|---|---|---|---|
| | Rated operation | 1/2 rated operation | Rated operation | 1/2 rated operation |
| Supercharger mode | 4.09 | 3.36 | 8.50 | 8.02 |
| Super-pressurizing mode | 3 00 | 2.65 | 5.99 | 5.29 |

| | Rated operation | 1/2 rated operation | Rated operation | 1/2 rated operation |
|---|---|---|---|---|
| Switching system between supercharger mode and super-pressurizing mode | 4.09 | 3.36 | 5.99 | 5.29 |

Fig. 4

COP value

| | | Present invention | Comparative example | |
|---|---|---|---|---|
| | | Switching system between supercharger mode and super-pressurizing mode | Bypass valve and pre-expansion valve system | Electric generator system |
| At the time of heating operation | Rated operation | 5.456 | 5.302 | 5.547 |
| | 1/2 rated operation | 5.672 | 5.490 | 5.781 |
| At the time of cooling operation | Rated operation | 4.862 | 4.862 | 4.504 |
| | 1/2 rated operation | 5.089 | 5.089 | 4.943 |
| Average COP value (rated) | | 5.159 | 5.082 | 5.026 |

Fig. 5

| Frequency range (estimation) | | Main compressor frequency | Frequency ratio | Auxiliary compressor frequency |
|---|---|---|---|---|
| At the time of heating operation | Rated operation | 60 | 0.6545 | 39.3 |
| | 1/2 rated operation | 30 | 0.6131 | 18.4 |
| At the time of cooling operation | Rated operation | 40 | 1.000 | 40 |
| | 1/2 rated operation | 20 | 0.9824 | 19.6 |

REFRIGERATION CYCLE APPARATUS

BACKGROUND OF THE INVENTION

1. Field of the Invention

The present invention relates to a refrigeration cycle apparatus using carbon dioxide as refrigerant and having a compressor, an outdoor heat exchanger, an expander and an indoor heat exchanger.

2. Description of the Related Art

A flow rate of a mass of refrigerant which circulates through a refrigeration cycle apparatus is the same in all points in a refrigeration cycle. If a suction density of refrigerant passing through a compressor is defined as DC and a suction density of refrigerant passing through an expander is defined as DE, the DE/DC (density ratio) is always constant.

In recent years, attention is focused on a refrigeration cycle apparatus using, as a refrigerant, carbon dioxide (CO2, hereinafter) in which the ozone destruction coefficient is zero and global warming coefficient is extremely less than that for Freon. The $CO_2$ refrigerant has a low critical temperature as low as 31.06° C. When a temperature higher than this temperature is utilized, a high pressure side (outlet of the compressor—gas cooler—inlet of pressure reducing device) of the refrigeration cycle apparatus is brought into a supercritical state in which CO2 refrigerant is not condensed, and there is a feature that operation efficiency of the refrigeration cycle apparatus is deteriorated as compared with a conventional refrigerant. Therefore, it is important for the refrigeration cycle apparatus using $CO_2$ refrigerant to maintain optimal COP, and if a temperature of the refrigerant is changed, it is necessary that a pressure is adjusted to a refrigerant pressure which is optimal to the refrigerant temperature.

However, when the refrigeration cycle apparatus is provided with the expander and power recovered by the expander is used as a portion of a driving force of the compressor, the number of rotations of the expander and the number of rotations of the compressor must be the same, and it is difficult to maintain the optimal COP when the operation condition is changed under constraint that the density ratio is constant.

Hence, there is proposed a structure in which a bypass pipe which bypasses the expander is provided, the refrigerant amount flowing into the expander is controlled, and the optimal COP is maintained (see patent documents 1 and 2 for example).

[Patent Document 1]

Japanese Patent Application Laid-open No.2000-234814 (paragraphs (0024) and (0025) and FIG. 1)

[Patent Document 2]

Japanese Patent Application Laid-open No.2001-116371 (paragraph (0023) and FIG. 1)

However, there is a problem that as a difference between a volume flow rate of fluid which flows into the expander and an optimal flow rate in terms of design is increased, an amount of refrigerant flowing through the bypass pipe is increased and as a result, power which could have been recovered cannot be sufficiently recovered.

If the power recovered by the expander is used as a driving force for an auxiliary compressor which is different from the compressor, it is possible to eliminate the constraint that the number of rotations of the expander and the number of rotations of the compressor must be the same. However, even if the auxiliary compressor is driven by the expander, the constraint that the density ratio is constant still remains, and it is still necessary to control the amount of refrigerant which flows into the expander.

Thereupon, it is an object of the present invention to reduce the constraint that the density ratio is constant as small as possible, and to obtain high power recovery effect in a wide operation range.

SUMMARY OF THE INVENTION

A first aspect of the present invention provides a refrigeration cycle apparatus using carbon dioxide as a refrigerant and having a compressor, an outdoor heat exchanger, an expander, an indoor heat exchanger and an auxiliary compressor, in which the auxiliary compressor is driven by power recovered by the expander, when refrigerant flows using the indoor heat exchanger as an evaporator, a discharge side of the auxiliary compressor becomes a suction side of the compressor, and when refrigerant flows using the indoor heat exchanger as a gas cooler, a discharge side of the compressor becomes a suction side of the auxiliary compressor.

According to the first aspect of the present invention, a refrigeration cycle apparatus is structured such that when refrigerant flows while using an indoor heat exchanger as an evaporator, a discharge side of an auxiliary compressor is a suction side of a compressor, and the refrigerant which is sucked into the compressor by the auxiliary compressor is supercharged, and when the refrigerant flows while using the indoor heat exchanger as a gas cooler, the discharge side of the compressor is a suction side of the auxiliary compressor, and the refrigerant which is discharged from the compressor is further super-pressurized, thereby reducing the difference in the density ratio by the refrigerant flow (operation aspect) to achieve high efficiency.

The density ratio of the aspect will be explained using FIG. 3. Here, the refrigerant flow in which the indoor heat exchanger is used as the evaporator is called a cooling operation aspect, the refrigerant flow in which the indoor heat exchanger is used as the gas cooler is called a heating operation aspect, and a case in which the discharge side of the auxiliary compressor is the suction side of the compressor is called a supercharger aspect, and a case in which the discharge side of the compressor is the suction side of the auxiliary compressor is called a super-pressurizing aspect.

For example, an expander of the supercharger aspect which is optimal for the cooling operation aspect is designed such that a fixed density ratio is 4.09. If this expander is used, a fixed density ratio is 3.36 at the time of ½ rated operation. When this expander is used in the supercharger aspect, a fixed density ratio in the heating operation aspect at the time of rated operation is 8.50, and the fixed density ratio at the time of ½ rated operation is 8.02.

In the cooling operation aspect when the expander is used in the super-pressurizing aspect, a fixed density ratio at the time of the rated operation is 3.00, and a fixed density ratio at the time of the ½ rated operation is 2.65, a fixed density ratio at the time of the rated operation in the heating operation aspect is 5.99, and a fixed density ratio at the time of the ½ rated operation is 5.29.

When the expander is used in the supercharger aspect, a fixed density ratio at the time of the rated operation in the cooling operation aspect is 4.09, and a fixed density ratio at the time of the rated operation in the heating operation aspect is 8.50. Therefore, if it is compared with the case at the time of the rated operation, a difference between the fixed density ratio in the cooling operation aspect and the fixed density ratio in the heating operation aspect is 4.41.

When the expander is used in the super-pressurizing aspect, the fixed density ratio at the time of the rated operation in the cooling operation aspect is 3.00 and the fixed density ratio at the time of the rated operation in the heating operation aspect is 5.99. Therefore, if it is compared with the case at the time of the rated operation, a difference between the fixed density ratio in the cooling operation aspect and the fixed density ratio in the heating operation aspect is 2.99.

On the other hand, if the expander is set in the supercharger aspect at the time of the cooling operation aspect and the expander is set in the super-pressurizing aspect at the time of heating operation aspect as in this aspect, the fixed density ratio at the time of the rated operation in the cooling operation aspect is 4.09 and the fixed density ratio at the time of the rated operation in the heating operation aspect is 5.99. Therefore, if it is compared with the case at the time of the rated operation, a difference between the fixed density ratio in the cooling operation aspect and the fixed density ratio in the heating operation aspect is 1.90, and the difference in the density ration by the refrigerant flow (operation aspect) can be reduced.

The switching aspect between the supercharger and the super-pressurizing of the present aspect is the feature of the present invention, and comparison of the COP is shown in FIG. 4.

As a comparative example, a system in which a bypass valve and a pre-expansion valve are used together, and an electric generator system are used. In the system in which the bypass valve and the pre-expansion valve are used together, a bypass pipe which bypasses the expander is provided with a bypass valve, an amount of refrigerant flowing into the bypass pipe is adjusted by this bypass valve, the expander is provided at its inflow side with the pre-expansion valve, and a flow rate of refrigerant flowing into the expander is adjusted by this pre-expansion valve. In the electric generator system, the present invention and the comparative example are compared in the optimal cycle control state, and the electricity conversion efficiency is taken into consideration.

FIG. 4 shows COP values in a rated cooling operation aspect and a ½ rated cooling operation aspect and in a rated heating operation aspect and a ½ rated heating operation when the expander is operated at the time of rated operation in the cooling operation aspect.

As shown in FIG. 4, according to the present invention, it is possible to obtain a high COP value even as compared with the system in which the bypass valve and the pre-expansion valve are used together.

According to a second aspect of the invention, in the first aspect, the apparatus further comprises a first four-way valve to which a discharge side pipe and a suction side pipe of the compressor are connected, a second four-way valve to which a discharge side pipe and a suction side pipe of the expander are connected, and a third four-way valve to which a discharge side pipe and a suction side pipe of the auxiliary compressor are connected, when refrigerant flows using the indoor heat exchanger as an evaporator, a discharge side of the auxiliary compressor becomes a suction side of the compressor, and when refrigerant flows using the indoor heat exchanger as a gas cooler, a discharge side of the compressor becomes a suction side of the auxiliary compressor by the first four-way valve and the third four-way valve, and a direction of refrigerant flowing through the expander is always set in the same direction by the second four-way valve.

According to a third aspect of the present invention, in the second aspect, at least one of the second four-way valve and the third four-way valve is replaced by a check valve bridge circuit comprising four check valves. By replacing the four-way valve by the check valve bridge circuit, it is possible to switch the refrigerant flow without the necessity of a control mechanism for switching.

According to a fourth aspect of the present invention, in the first aspect, the apparatus further comprises a bypass circuit which reduces an amount of refrigerant flowing into the expander, and a bypass valve which adjusts an amount of refrigerant flowing through the bypass circuit. When a volume flow rate of refrigerant flowing into the expander is greater than a designed flow rate, it is possible to reduce the flow rate of refrigerant flowing into the expander by increasing an opening of the bypass valve.

According to a fifth aspect of the present invention, in the first aspect, the apparatus further comprises a pre-expansion valve which increases the amount of refrigerant flowing into the expander. When the volume flow rate of refrigerant flowing into the expander is smaller than the designed flow rate, it is possible to reduce the density to increase the flow rate of refrigerant flowing into the expander by reducing the opening of the pre-expansion valve.

According to a sixth aspect of the present invention, in the first aspect, a suction capacity of the compressor is 3 to 6 times of a suction capacity of the expander. By setting the suction capacity of the compressor and the suction capacity of the expander in this manner, it is possible to bring the number of rotation of the compressor and the number of rotation of the expander close to each other.

According to a seventh aspect of the present invention, in the first aspect, a suction capacity of the compressor is 4 times of a suction capacity of the expander, and a suction capacity of the auxiliary compressor is 4.3 times of the suction capacity of the expander. If the suction capacity of the auxiliary compressor is changed with respect to the suction capacity of the compressor by a ratio of the suction density of the compressor and the suction density of the auxiliary compressor, it is possible to set the number of rotation of the expander and the number of rotation of the compressor set substantially same.

According to an eighth aspect of the present invention, in the first aspect, a cooling operation rated frequency of the compressor and the cooling operation rated frequency of the auxiliary compressor are set to the same frequency. By setting the cooling operation rated frequency of the auxiliary compressor and the cooling operation rated frequency of the compressor to the same frequency, it is possible to especially make a heating operation rated frequency of the auxiliary compressor lower than a heating operation rated frequency of the compressor.

FIG. 5 shows a relation between frequencies of the compressor and the auxiliary compressor when the cooling operation rated frequency of the auxiliary compressor and the cooling operation rated frequency of the compressor are set to the same frequency of 40 Hz. As shown in FIG. 5, the heating operation rated frequency of the auxiliary compressor becomes 39.3 Hz, which is lower than the heating operation rated frequency of 60 Hz of the compressor, a ½ rated frequency of the auxiliary compressor at the time of heating operation becomes 18.4 Hz which is lower than a ½ rated frequency of 30 Hz of the compressor at the time of heating operation. A ½ rated frequency of the auxiliary compressor at the time of cooling operation becomes 19.6 Hz which is lower than a ½ rated frequency of 20 Hz of the compressor at the time of cooling operation. As shown in FIG. 5, if the rated frequency of the auxiliary compressor is set to a range near 40 Hz, it is possible to obtain the highest efficiency. That is, in the case of a displacement compressor of this kind, as the number of rotation is increased, leakage loss is reduced, but as the number of rotation is increased, mechanical loss is increased. Therefore, the number of rotation of 40 Hz is high efficiency number of rotation.

According to a ninth aspect of the present invention, in the first aspect, an operation frequency of the auxiliary compressor is lower than an operation frequency of the compressor. With this feature, it is possible to rotate the auxiliary compressor at higher efficiency.

According to a tenth aspect of the present invention, the expander and a sub-expander are arranged in parallel, and an electric generator is connected to the sub-expander. An amount of refrigerant flowing through the sub-expander is changed by changing torque of the electric generator of the sub-expander, and it is possible to adjust the amount of refrigerant flowing through the expander such that optimal COP can be obtained. Therefore, it is possible to recover the power efficiently in the expander, and using the refrigerant which bypasses the expander, the expansion power can be converted into electricity and recovered by the electric generator also in the sub-expander.

According to an eleventh aspect of the present invention, the expander is provided at its suction side with a sub-expander, and an electric generator is connected to the sub-expander. By changing torque of the electric generator of the sub-expander, it is possible to change an amount of pre-expanded refrigerant and to adjust the amount of refrigerant flowing through the expander such that the optimal COP is obtained. Therefore, it is possible to effectively recover the power in the expander, and expansion power can be converted into electricity and recovered by the electric generator also in the sub-expander which pre-expands.

According to a twelfth aspect of the present invention, the expander is provided at its discharge side with a sub-expander, and an electric generator is connected to the sub-expander. By changing torque of the electric generator of the sub-expander, an amount of additionally expanded refrigerant is changed, and a low pressure side pressure can be control optimally. Therefore, it is possible to effectively recover the power in the expander, and expansion power can be converted into electricity and recovered by the electric generator also in the sub-expander which additionally expands.

According to a thirteenth aspect of the present invention, the expander is provided at its suction side with a first sub-expander, a second sub-expander is provided in parallel to the expander and the first sub-expander, and electric generators are connected to the first sub-expander and the second sub-expander, respectively. By changing torque of the electric generator of the first sub-expander, an amount of pre-expanded refrigerant can be changed, and the amount of refrigerant flowing through the expander can be adjusted such that the optimal COP can be obtained. Further, by changing torque of the electric generator of the second sub-expander, an amount of refrigerant flowing through the sub-expander can be changed, and the amount of refrigerant flowing through the expander can be adjusted such that the optimal COP can be obtained. Therefore, power can be efficiently recovered in the expander, it is possible to convert the expansion power into electricity and recover the same by the electric generator also in the first sub-expander which pre-expands and the second sub-expander utilizing refrigerant which bypasses the expander, respectively.

According to a fourteenth aspect of the present invention, the expander is provided at its suction side with a sub-expander, a bypass flow path is provided in parallel to the expander and the sub-expander, and the bypass flow path is provided with a bypass valve. By changing torque of the electric generator of the sub-expander, an amount of pre-expanded refrigerant is changed, and it is possible to adjust an amount of refrigerant flowing through the expander such that the optimal COP can be obtained. Further, by changing an opening of the bypass valve provided in the bypass flow path, it is possible to change an amount of refrigerant flowing through the bypass flow path, and to adjust an amount of refrigerant flowing through the expander such that the optimal COP can be obtained. Therefore, it is possible to efficiently recover power in the expander, and to convert the expansion power into electricity and recover the same by the electric generator also in the sub-expander which pre-expands.

According to a fifteenth aspect of the present invention, the expander is provided at its suction side with a pre-expansion valve, a sub-expander is provided in parallel to the expander and the pre-expansion valve, and an electric generator is connected to the sub-expander. By changing an opening of the pre-expansion valve, it is possible to change a high pressure side pressure, and to adjust an amount of refrigerant flowing through the expander such that the optimal COP can be obtained. Further, by changing torque of the electric generator of the sub-expander, it is possible to change an amount of refrigerant flowing through the sub-expander, and to adjust an amount of refrigerant flowing through the expander such that the optimal COP can be obtained. Therefore, it is possible to efficiently recover power in the expander, and to convert the expansion power into electricity and recover the same by the electric generator also in the sub-expander utilizing refrigerant which bypasses the expander.

According to a sixteenth aspect of the present invention, the expander is provided at its suction side with a first sub-expander, a second sub-expander is provided in parallel to the expander and the first sub-expander, an electric generator connected to the first sub-expander is an electric generator connected to a second sub-expander, the electric generator includes a clutch mechanism which is connected to one of the first sub-expander and the second sub-expander. According to this aspect, by changing torque of the electric generator of the first sub-expander, it is possible to change an amount of pre-expanded refrigerant, and to adjust an amount of refrigerant flowing through the expander such that the optimal COP can be obtained. Further, by changing torque of the electric generator of the second sub-expander, it is possible to change an amount of refrigerant flowing through the sub-expander, and to adjust an amount of refrigerant flowing through the expander such that the optimal COP can be obtained. Therefore, it is possible to efficiently recover power in the expander, and it is possible to convert the expansion power into electricity and recover the same by the electric generator also in the first sub-expander which pre-expands and the second sub-expander utilizing refrigerant which bypasses the expander, respectively. Further, it is possible to convert the expansion power of the first sub-expander and the second sub-expander into electricity and recover the same by the one electric generator.

According to a seventeenth aspect of the present invention, the expander is provided at its discharge side with a first sub-expander, a second expander is provided in parallel to the expander and the first sub-expander, an electric generator connected to the first sub-expander is an electric generator connected to the second sub-expander, and the electric generator includes a clutch mechanism which is connected to one of the first sub-expander and the second sub-expander. According to this aspect, by changing torque of the electric generator of the first sub-expander, it is possible to change an amount of additionally expanded refrigerant, and to optimally adjust a low pressure side pressure. Further, by changing torque of the electric generator of the second sub-expander, it is possible to change an amount of refrigerant flowing through the sub-expander, and to adjust an amount of refrigerant flowing through the expander such that the optimal COP can be obtained. Therefore, it is possible to efficiently recover power in the expander, and it is possible to convert the expansion power into electricity and recover the same by the electric generator also in the first sub-expander which pre-expands and the second sub-expander utilizing refrigerant which bypasses the expander, respectively. Further, it is possible to convert the expansion power of the first sub-expander and the second sub-expander into electricity and recover the same by the one electric generator.

According to an eighteenth aspect of the present invention, in the tenth to seventeenth aspects, power recover by the expander can be used as power for driving the auxiliary compressor.

According to a nineteenth aspect of the present invention, in the tenth to seventeenth aspects, there are provided a first four-way valve to which a discharge side pipe and the suction side pipe of the compressor are connected, and a second four-way valve to which the discharge side pipes and the suction side pipes of the expander and the sub-expander are connected. Refrigerant discharged from the compressor is selectively allowed to flow into the indoor heat exchanger or the outdoor heat exchanger by the first four-way valve, a direction of refrigerant flowing through the expander and the sub-expander is always set in the same direction by the second four-way valve. With this structure, it is possible to utilize the tenth to seventeenth aspects as a cooling and heating air conditioner.

According to a twentieth aspect of the present invention, in the eighteenth aspect, there are provided a first four-way valve to which the discharge side pipes and the suction side pipes of the auxiliary compressor and the compressor are connected, and a second four-way valve to which the discharge side pipes and suction side pipes of the expander and the sub-expander are connected. Refrigerant discharged from the compressor and the auxiliary compressor is allowed to flow into the indoor heat exchanger or outdoor heat exchanger by the first four-way valve, a direction of refrigerant flowing through the expander and the sub-expander is always set in the same direction by the second four-way valve. With this structure, it is possible to utilize the eighteenth aspect as a cooling and heating air conditioner.

BRIEF DESCRIPTION OF THE DRAWINGS

FIG. 3 shows one example of a fixed density ratio at the time of cooling operation and heating operation in a charger mode in which a discharge side of an auxiliary compressor becomes a suction side of a compressor and in a super-pressurizing mode in which a discharge side of the compressor becomes a suction side of the auxiliary compressor.

FIG. 4 shows a switching system between supercharging and super-pressurization and a comparison of optimal COP ratios of comparative example.

FIG. 5 shows a relation between frequencies of the compressor and the auxiliary compressor when a cooling operation rated frequency of the auxiliary compressor is set to 37 Hz which is the same as that of the compressor.

PREFERRED EMBODIMENTS

Figure 1:
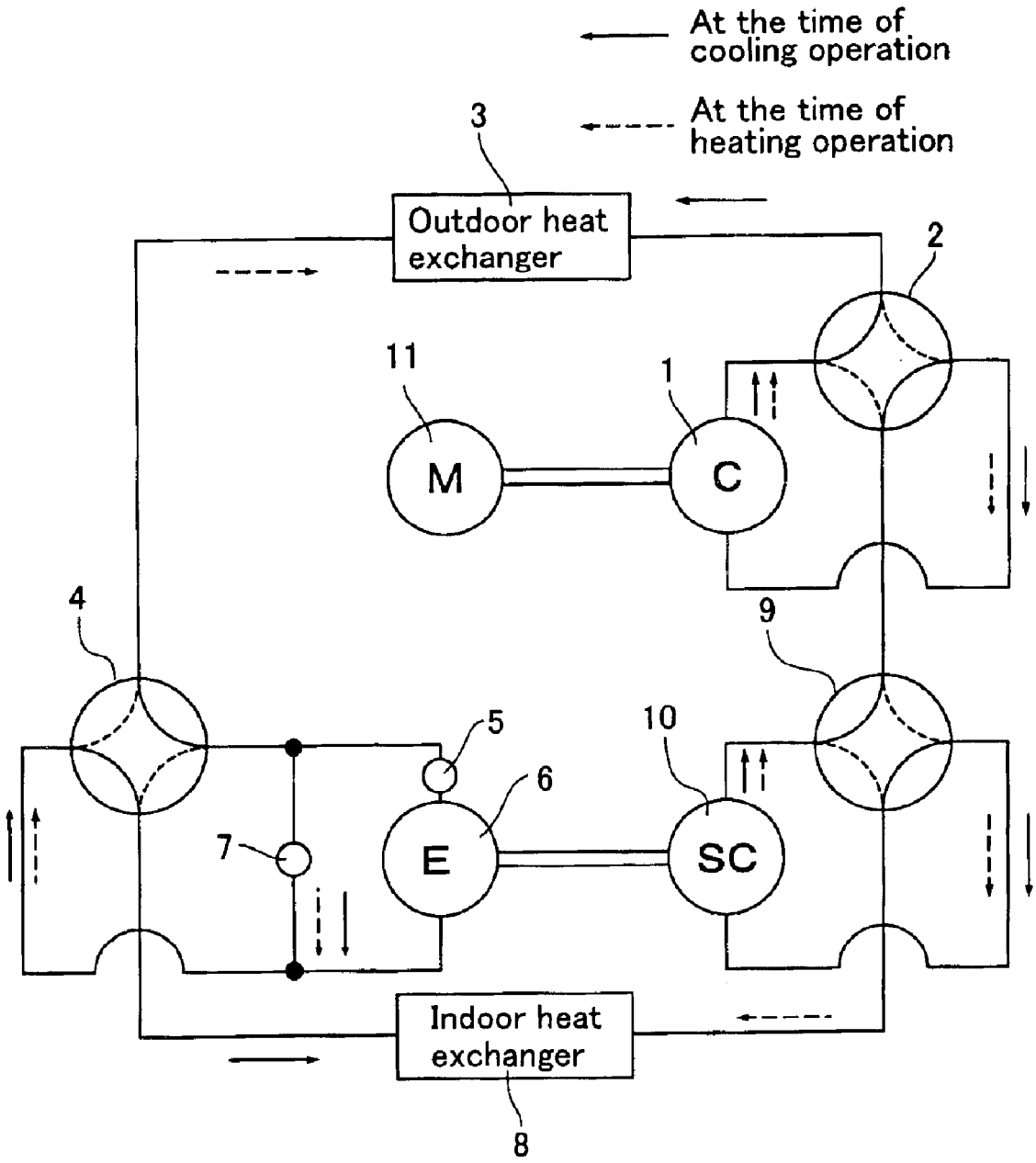
FIG. 1 shows a structure of a heat pump type cooling and heating air conditioner according to an embodiment of the present invention.

A refrigeration cycle apparatus according to an embodiment of the present invention will be explained with reference to the drawing below based on a heat pump type cooling and heating air conditioner.

FIG. 1 shows a structure of the heat pump type cooling and heating air conditioner of the present embodiment.

As shown in FIG. 1, the heat pump type cooling and heating air conditioner of this embodiment uses $CO_2$ refrigerant as refrigerant, and has a refrigerant circuit. The refrigerant circuit comprises a compressor 1 having a motor 11, an outdoor heat exchanger 3, an expander 6, an indoor heat exchanger 8 and an auxiliary compressor 10 which are all connected to one another through pipes.

The refrigerant circuit comprises a first four-way valve 2 to which a discharge side pipe and a suction side pipe of the compressor 1 are connected, a second four-way valve 4 to which a discharge side pipe and a suction side pipe of the expander 6 are connected, and a third four-way valve 9 to which a discharge side pipe and a suction side pipe of the auxiliary compressor 10 are connected. In the case of refrigerant flow in which the outdoor heat exchanger 3 is used as a gas cooler and the indoor heat exchanger 8 is used as an evaporator, the first four-way valve 2 and the third four-way valve 9 are switched over so that the discharge side of the auxiliary compressor 10 becomes the suction side of the compressor 1. In the case of refrigerant flow in which the outdoor heat exchanger 3 is used as the evaporator and the indoor heat exchanger 8 is used as the gas cooler, the first four-way valve 2 and the third four-way valve 9 are switched over so that the discharge side of the compressor 1 becomes the suction side of the auxiliary compressor 10. By switching the second four-way valve 4, a direction of the refrigerant flowing through the expander 6 becomes always the same direction.

The expander 6 is provided at its inflow side with a pre-expansion valve 5 which can change an opening of the valve. A bypass circuit for bypassing the pre-expansion valve 5 and the expander 6 is provided. This bypass circuit is provided with a bypass valve 7 which adjusts a flow rate of refrigerant of the bypass circuit.

A drive shaft of the expander 6 and a drive shaft of the auxiliary compressor 10 are connected to each other, and the auxiliary compressor 10 is driven by power recover by the expander 6.

The operation of the heat pump type cooling and heating air conditioner of this embodiment will be explained below.

First, a cooling operation mode in which the outdoor heat exchanger 3 is used as the gas cooler and the indoor heat exchanger 8 is used as the evaporator will be explained. A flow of refrigerant in this cooling operation mode is shown with solid arrows in the drawings.

Refrigerant at the time of the cooling operation mode is compressed at a high temperature and under a high pressure and is discharged by the compressor 1 which is driven by the motor 11. The refrigerant is introduced into the outdoor heat exchanger 3 through the first four-way valve 2. In the outdoor heat exchanger 3, since $CO_2$ refrigerant is in a supercritical state, the refrigerant is not brought into two-phase state, and dissipates heat to outside fluid such as air and water. Then, the $CO_2$ refrigerant is introduced into the expander 6 through the second four-way valve 4 and the pre-expansion valve 5, and is expanded by the expander 6. At that time, an optimal amount of refrigerant flowing into the expander 6 is calculated from a high pressure refrigerant temperature and a high pressure refrigerant pressure detected on the side of an outlet of the outdoor heat exchanger 3. Openings of the pre-expansion valve 5 and the bypass valve 7 are adjusted such that when a volume flow rate is greater than the calculated optimal refrigerant amount, the opening of the bypass valve 7 is increased to reduce the volume flow rate of refrigerant flowing into the expander 6, and when the volume flow rate is smaller than the calculated optimal refrigerant amount, the opening of the pre-expansion valve 5 is reduced to increase the volume flow rate. The expanded $CO_2$ refrigerant passes through the second four-way valve 4, and is evaporated and suctions heat in the indoor heat exchanger 8. A room is cooled by this endotherm. The refrigerant which has been evaporated is introduced into the auxiliary compressor 10 through the third four-way valve 9, and is supercharged by the auxiliary compressor 10, and is drawn into the compressor 1 through the third four-way valve 9 and the first four-way valve 2. Energy at the time of expansion in the expander 6 is utilized for this charging of the auxiliary compressor 10, and power is recovered.

Next, a heating operation mode in which the outdoor heat exchanger 3 is used as the evaporator and the indoor heat exchanger 8 is used as the gas cooler will be explained. In the drawings, a flow of refrigerant in this heating operation mode is shown with dashed arrows in the drawing.

Refrigerant at the time of the heating operation mode is compressed at a high temperature and under a high pressure and is discharged by the compressor 1 which is driven by the motor 11. The refrigerant is introduced into the auxiliary compressor 10 through the first four-way valve 2 and the third four-way valve 9, and is further super-pressurized by the auxiliary compressor 10. The expansion energy in the expander 6 is utilized for the super-pressurizing operation of the auxiliary compressor 10 and power is recovered. The super-pressurized refrigerant is introduced into the indoor heat exchanger 8 through the third four-way valve 9. In the indoor heat exchanger 8, since the refrigerant is not brought into two-phase state, and dissipates heat to outside fluid such as air and water. Then, the $CO_2$ refrigerant is introduced into the expander 6 through the second four-way valve 4 and the pre-expansion valve 5, and is expanded by the expander 6. At that time, an optimal amount of refrigerant flowing into the expander 6 is calculated from a high pressure refrigerant temperature and a high pressure refrigerant pressure detected on the side of the outlet of the indoor heat exchanger 8. The openings of the pre-expansion valve 5 and the bypass valve 7 are adjusted such that when the volume flow rate is greater than the calculated optimal refrigerant amount, the opening of the bypass valve 7 is increased to reduce the volume flow rate of refrigerant flowing into the expander 6, and when the volume flow rate is smaller than the calculated optimal refrigerant amount, the opening of the pre-expansion valve 5 is reduced to increase the volume flow rate. The expanded $CO_2$ refrigerant passes through the second four-way valve 4, and is evaporated and suctions heat in the outdoor heat exchanger 3. The refrigerant which has been evaporated is drawn into the compressor 1 through the first four-way valve 2.

According to this embodiment, the compressor 1 which compresses the refrigerant, and the expander 6 which recovers power as well as the auxiliary compressor 10 are separated from each other, and the refrigeration cycle is switched such that the auxiliary compressor 10 carries out the supercharging operation at the time of the cooling operation mode and carries out the super-pressurizing operation at the time of the heating operation mode. With this structure, it is possible to allow the expander 6 to operate as a supercharging type expander which is suitable for cooling, and as a super-pressurizing type expander which is suitable for heating.

As described above, the embodiment can provide an air conditioner which recovers power using $CO_2$ refrigerant as a refrigerant in which the operation range is wide and refrigeration cycle operation can be carried out efficiently.

In the heat pump type cooling and heating air conditioner of the embodiment, it is preferable that a suction capacity of the expander 6 is set to 1 cc, a suction capacity of the compressor 1 is set to 4 cc, and a suction capacity of the auxiliary compressor 10 is set to 4.3 cc, and the suction capacity of the auxiliary compressor 10 is changed by a ratio of the suction capacity of the compressor 1 and the suction capacity of the auxiliary compressor 10. With this structure, it is possible to set the number of rotation of the expander 6 and the number of rotation of the compressor 1 (frequency in the case of the motor) at the time of cooling and heating operation substantially equally.

In the structure of the suction capacity, if the mode is switched to the heating operation mode, it is possible to suppress the number of rotation of the auxiliary compressor 10 to a value smaller than that of the compressor 1. For example, when a frequency of the compressor 1 is set to about 60 Hz, the number of rotation of the auxiliary compressor 10 can be set to about 40 Hz. With this reduction in the number of rotation, it is possible to reduce the mechanical loss (sliding resistance and viscosity resistance) of the auxiliary compressor 10, and to enhance the operation efficiency.

Next, a heat pump type cooling and heating air conditioner of another embodiment will be explained with reference to FIG. 2.

Figure 2:
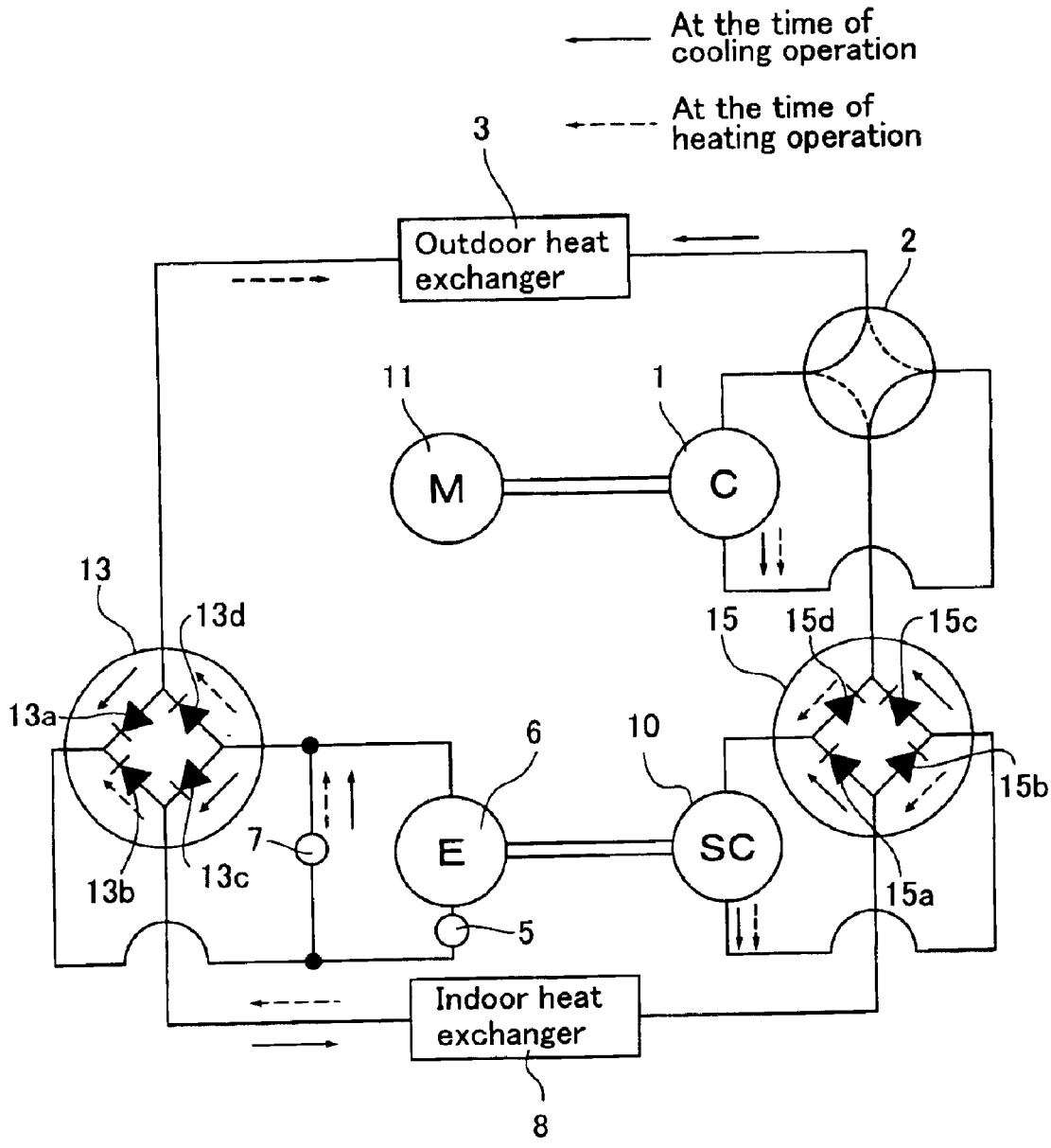
FIG. 2 shows a structure of a heat pump type cooling and heating air conditioner according to another embodiment of the invention.

FIG. 2 shows a structure of the heat pump type cooling and heating air conditioner of the second embodiment.

As shown in FIG. 2, in the heat pump type cooling and heating air conditioner of the second embodiment, the second four-way valve 4 and the third four-way valve 9 in the previous embodiment shown in FIG. 1 are replaced by a first check valve bridge circuit 13 and a second check valve bridge circuit 15, respectively. Other structure is the same as that of the first embodiment shown in FIG. 1.

The first check valve bridge circuit 13 comprises a set of four check valves 13*a*, 13*b*, 13*c* and 13*b* which are connected to one another. The second check valve bridge circuit 15 also comprises a set of four check valves 15*a*, 15*b*, 15*c* and 15*b* which are connected to one another. In the first check valve bridge circuit 13 for example, a refrigerant flows through the check valves 13*a* and 13*c* in a direction shown with solid arrows at the time of cooling operation, and flows through the check valves 13*b* and 13*d* in a direction shown with dashed arrows at the time of heating operation, and the first check valve bridge circuit 13 exhibits the same function as the second four-way valve 4.

As compared with the structure of the complicated semi-hermetical type four-way valve which needs the switching operation, the structure of the check valve of this embodiment is of complete-hermetical type which is simple, and it is preferable in terms of sealing reliability and control performance. Especially when a $CO_2$ refrigerant is used and pressure is increased to a high value up to a supercritical region, the check valve structure of the second embodiment is preferable.

A refrigeration cycle apparatus of another embodiment of the present invention will be explained with reference to the drawing.

Figure 6:
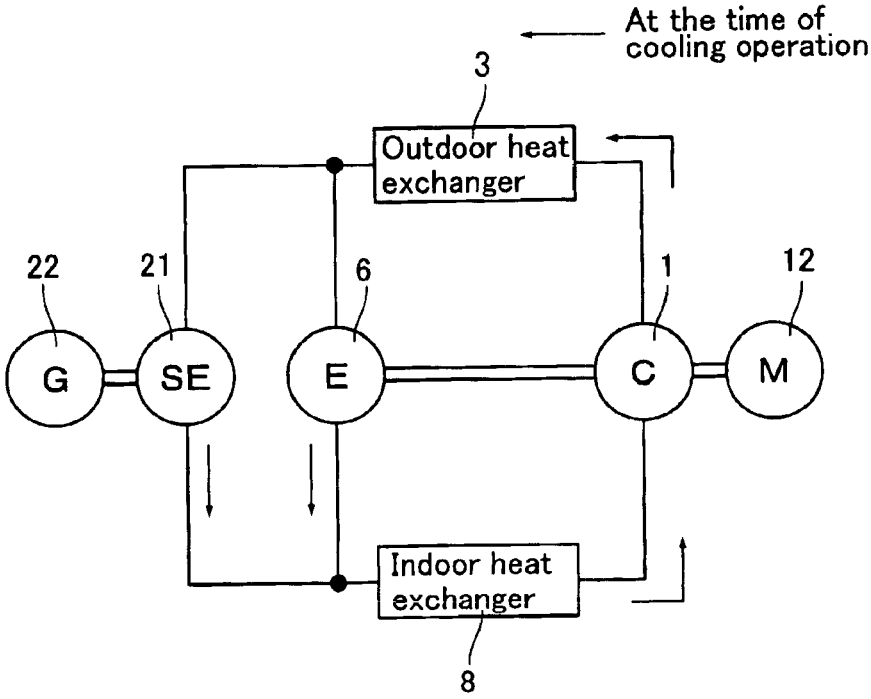
FIG. 6 shows a structure of a heat pump type air conditioner according to another embodiment of the invention.

FIG. 6 shows a structure of a heat pump type air conditioner of this embodiment.

As shown in FIG. 6, the heat pump type air conditioner of the embodiment uses a $CO_2$ refrigerant as a refrigerant, and comprises a refrigerant circuit in which a compressor 1 having a motor 12, an outdoor heat exchanger 3, an expander 6 and an indoor heat exchanger 8 are connected to one another through pipes.

A bypass circuit which bypasses the expander 6 is provided in parallel to the expander 6. The bypass circuit is provided with a sub-expander 21, and an electric generator 22 is connected to a drive shaft of the sub-expander 21.

A drive shaft of the expander 6 and a drive shaft of the compressor 1 are connected to each other, and the compressor 1 utilizes power recover by the expander 6 for driving.

The operation of the heat pump type air conditioner of this embodiment will be explained below.

A refrigerant is compressed at a high temperature and under a high pressure and is discharged by the compressor 1 which is driven by the motor 12. The refrigerant is introduced into the outdoor heat exchanger 3. In the outdoor heat exchanger 3, since $CO_2$ refrigerant is in a supercritical state, the refrigerant is not brought into two-phase state, and dissipates heat to outside fluid such as air and water. Then, the $CO_2$ refrigerant is introduced into the expander 6 and the sub-expander 21, and is expanded by the expander 6 or the sub-expander 21. Power recover by the expander 6 at the time of expanding operation is used for driving the compressor 1. At that time, an optimal amount of refrigerant flowing into the expander 6 is calculated from a high pressure refrigerant temperature and a high pressure refrigerant pressure detected on the side of an outlet of the outdoor heat exchanger 3. If the volume flow rate is greater than the calculated optimal refrigerant amount, torque of the electric generator 22 (load of electric generator) is reduced to increase the amount of refrigerant which is allowed to flow into the bypass circuit, thereby reducing the volume flow rate of refrigerant which flows into the expander 6. If the optimal amount of refrigerant flowing into the expander 6 is smaller than the calculated optimal refrigerant amount, the torque of the electric generator 22 (load of the electric generator) is increased to reduce the amount of refrigerant which is allowed to flow into the bypass circuit, thereby increasing the volume flow rate of the refrigerant flowing into the expander 6.

The $CO_2$ refrigerant expanded by the expander 6 and the sub-expander 21 is evaporated and suctions heat in the indoor heat exchanger 8. A room is cooled by this endotherm. The refrigerant which has been evaporated is drawn into the compressor 1.

As described above, according to this embodiment, the torque of the electric generator 22 (i.e., load of the electric generator) connected to the sub-expander 21 is changed to adjust the amount of refrigerant flowing through the bypass circuit, thereby controlling the amount of refrigerant flowing through the expander 6. Therefore, it is possible to efficiently recover power in the expander 6. During the control of the flow rate of refrigerant through the bypass system, power recover from the sub-expander 21 is utilized for generating electricity of the electric generator 22, and it is possible to recover more power from the refrigeration cycle.

A refrigeration cycle apparatus of another embodiment of the present invention will be explained with reference to the drawing based on a heat pump type cooling and heating air conditioner.

Figure 7:
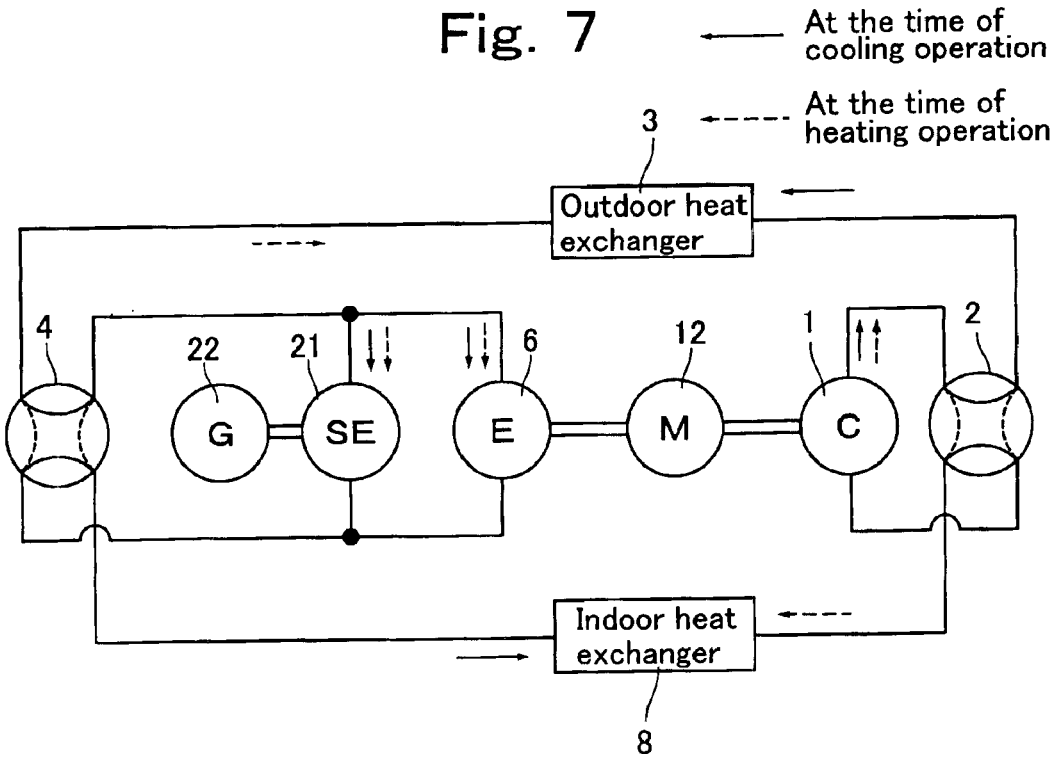
FIG. 7 shows a structure of a heat pump type cooling and heating air conditioner according to another embodiment of the invention.

FIG. 7 shows a structure of the heat pump type cooling and heating air conditioner of this embodiment.

As shown in FIG. 7, the heat pump type cooling and heating air conditioner of this embodiment uses a $CO_2$ refrigerant as a refrigerant, and comprises a refrigerant circuit in which a compressor 1 having a motor 12, an outdoor heat exchanger 3, an expander 6 and an indoor heat exchanger 8 are connected to one another through pipes.

The refrigerant circuit comprises a first four-way valve 2 to which a discharge side pipe and a suction side pipe of the compressor 1 are connected, and a second four-way valve 4 to which a discharge side pipe and a suction side pipe of the expander 6 are connected.

A bypass circuit is provided in parallel to the expander 6. The bypass circuit bypasses the expander 6. The bypass circuit is provided with a sub-expander 21. An electric generator 22 is connected to a drive shaft of the sub-expander 21. The bypass circuit is also connected to the second four-way valve 4 like the expander 6.

A drive shaft of the expander 6 and a drive shaft of the compressor 1 are connected to each other, and the compressor 1 utilizes power recover by the expander 6 for driving.

The operation of the heat pump type cooling and heating air conditioner of this embodiment will be explained.

First, a cooling operation mode in which the outdoor heat exchanger 3 is used as a gas cooler and the indoor heat exchanger 8 is used as an evaporator will be explained. A flow of the refrigerant in the cooling operation mode is shown with solid arrows in the drawing.

Refrigerant at the time of the cooling operation mode is compressed at a high temperature and under a high pressure and is discharged by the compressor 1 which is driven by the motor 12. The refrigerant is introduced into the outdoor heat exchanger 3 through the first four-way valve 2. In the outdoor heat exchanger 3, since $CO_2$ refrigerant is in a supercritical state, the refrigerant is not brought into two-phase state, and dissipates heat to outside fluid such as air and water. Then, the $CO_2$ refrigerant is introduced into the expander 6 and the sub-expander 21 through the second four-way valve 4, and is expanded by the expander 6 or the sub-expander 21. Power recover by the expander 6 at the time of expanding operation is used for driving the compressor 1. At that time, an optimal amount of refrigerant flowing into the expander 6 is calculated from a high pressure refrigerant temperature and a high pressure refrigerant pressure detected on the side of an outlet of the outdoor heat exchanger 3. If the volume flow rate is greater than the calculated optimal refrigerant amount, torque of the electric generator 22 (load of electric generator) is reduced to increase the amount of refrigerant which is allowed to flow into the bypass circuit, thereby reducing the volume flow rate of refrigerant which flows into the expander 6. When the optimal amount of refrigerant flowing into the expander 6 is smaller than the calculated optimal refrigerant amount, the torque of the electric generator 22 (load of the electric generator) is increased to reduce the amount of refrigerant which is allowed to flow into the bypass circuit, thereby increasing the volume flow rate of the refrigerant flowing into the expander 6.

The $CO_2$ refrigerant expanded by the sub-expander 21 and the expander 6 is introduced into the indoor heat exchanger 8 through the second four-way valve 4 and is evaporated and suctions heat in the indoor heat exchanger 8. A room is cooled by this endotherm. The refrigerant which has been evaporated is drawn into the compressor 1.

Next, a heating operation mode in which the outdoor heat exchanger 3 is used as the evaporator and the indoor heat exchanger 8 is used as the gas cooler will be explained. A flow of a refrigerant in this heating operation mode is shown with dashed arrows in the drawing.

Refrigerant at the time of the heating operation mode is compressed at a high temperature and under a high pressure and is discharged by the compressor 1 which is driven by the motor 12. The refrigerant is introduced into the indoor heat exchanger 8 through the first four-way valve 2. In the indoor heat exchanger 8, since $CO_2$ refrigerant is in a supercritical state, the refrigerant is not brought into two-phase state, and dissipates heat to outside fluid such as air and water. A room is heated utilizing this radiation. Then, the $CO_2$ refrigerant is introduced into the expander 6 and the sub-expander 21 through the second four-way valve 4, and is expanded by the expander 6 or the sub-expander 21. Power recover by the expander 6 at the time of expanding operation is used for driving the compressor 1. At that time, an optimal amount of refrigerant flowing into the expander 6 is calculated from a high pressure refrigerant temperature and a high pressure refrigerant pressure detected on the side of an outlet of the indoor heat exchanger 8. If the volume flow rate is greater than the calculated optimal refrigerant amount, torque of the electric generator 22 (load of electric generator) is reduced to increase the amount of refrigerant which is allowed to flow into the bypass circuit, thereby reducing the volume flow rate of refrigerant which flows into the expander 6. When the optimal amount of refrigerant flowing into the expander 6 is smaller than the calculated optimal refrigerant amount, the torque of the electric generator 22 (load of the electric generator) is increased to reduce the amount of refrigerant which is allowed to flow into the bypass circuit, thereby increasing the volume flow rate of the refrigerant flowing into the expander 6.

The $CO_2$ refrigerant expanded by the expander 6 and the sub-expander 21 is introduced into the outdoor heat exchanger 3 through the second four-way valve 4 and is evaporated and suctions heat in the outdoor heat exchanger 3. The refrigerant which has been evaporated is drawn into the compressor 1 through the first four-way valve 2.

As described above, according to this embodiment, the torque of the electric generator 22 (i.e., load of the electric generator) connected to the sub-expander 21 is changed to adjust the amount of refrigerant flowing through the bypass circuit, thereby controlling the amount of refrigerant flowing through the expander 6. Therefore, it is possible to efficiently recover power in the expander 6. During the control of the flow rate of refrigerant through the bypass system, power recover from the sub-expander 21 is utilized for generating electricity of the electric generator 22, and it is possible to recover more power from the refrigeration cycle.

A refrigeration cycle apparatus of another embodiment of the present invention will be explained with reference the drawing.

Figure 8:
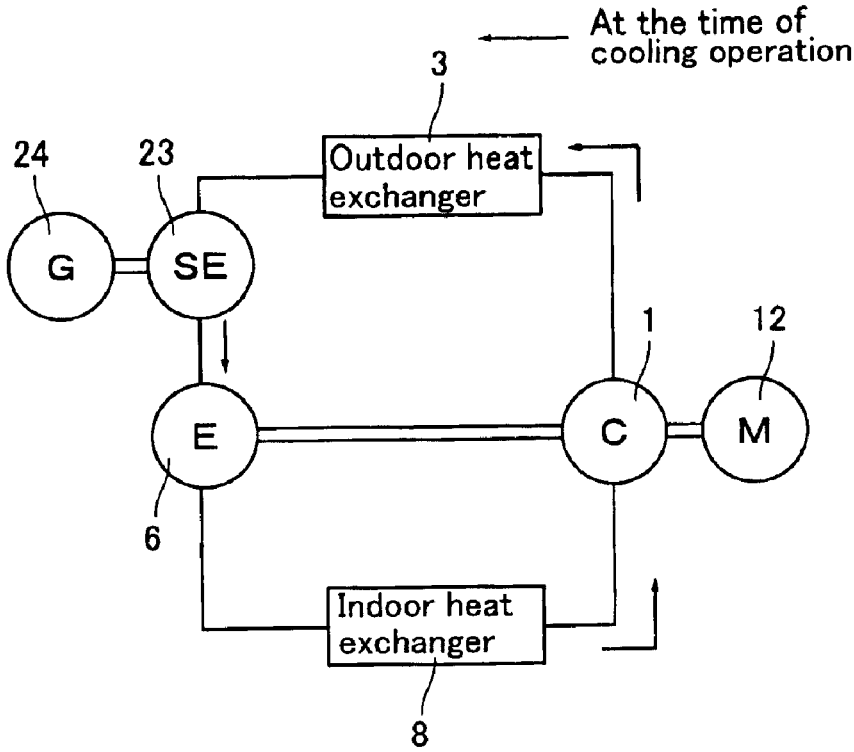
FIG. 8 shows a structure of a heat pump type air conditioner according to another embodiment of the invention.

FIG. 8 shows a structure of a heat pump type air conditioner of this embodiment.

As shown in FIG. 6, the heat pump type air conditioner of the embodiment uses a $CO_2$ refrigerant as a refrigerant, and comprises a refrigerant circuit in which a compressor 1 having a motor 12, an outdoor heat exchanger 3, an expander 6 and an indoor heat exchanger 8 are connected to one another through pipes.

The expander 6 is provided at its inflow side with a sub-expander 23, and an electric generator 24 is connected to a drive shaft of the sub-expander 23.

A drive shaft of the expander 6 and a drive shaft of the compressor 1 are connected to each other, and the compressor 1 utilizes power recover by the expander 6 for driving.

The operation of the heat pump type air conditioner of this embodiment will be explained below.

A refrigerant is compressed at a high temperature and under a high pressure and is discharged by the compressor 1 which is driven by the motor 12. The refrigerant is introduced into the outdoor heat exchanger 3. In the outdoor heat exchanger 3, since $CO_2$ refrigerant is in a supercritical state, the refrigerant is not brought into two-phase state, and dissipates heat to outside fluid such as air and water. Then, the $CO_2$ refrigerant is introduced into the sub-expander 23 and the expander 6, and is expanded by the sub-expander 23 and the expander 6. Power recover by the expander 6 at the time of expanding operation is used for driving the compressor 1. At that time, an optimal amount of refrigerant flowing into the expander 6 is calculated from a high pressure refrigerant temperature and a high pressure refrigerant pressure detected on the side of an outlet of the outdoor heat exchanger 3. If the optimal amount of refrigerant flowing into the expander 6 is smaller than the calculated optimal refrigerant amount, the torque of the electric generator 24 (load of the electric generator) is increased to increase the high pressure side pressure, thereby increasing the volume flow rate of the refrigerant flowing into the expander 6. If the volume flow rate is greater than the calculated optimal refrigerant amount, torque of the electric generator 24 (load of electric generator) is reduced to reduce the high pressure side pressure, thereby reducing the volume flow rate of refrigerant which flows into the expander 6.

The $CO_2$ refrigerant expanded by the expander 6 and the sub-expander 23 is evaporated and suctions heat in the indoor heat exchanger 8. A room is cooled by this endotherm. The refrigerant which has been evaporated is drawn into the compressor 1.

As described above, according to this embodiment, the torque of the electric generator 24 (i.e., load of the electric generator) connected to the sub-expander 23 is changed to adjust the amount of high pressure side pressure, thereby controlling the amount of refrigerant flowing through the expander 6. Therefore, it is possible to efficiently recover power in the expander 6, power recover from the sub-expander 23 is utilized for generating electricity of the electric generator 24, and it is possible to recover more power from the refrigeration cycle.

A refrigeration cycle apparatus of another embodiment of the present invention will be explained with reference to the drawing based on a heat pump type cooling and heating air conditioner.

Figure 9:
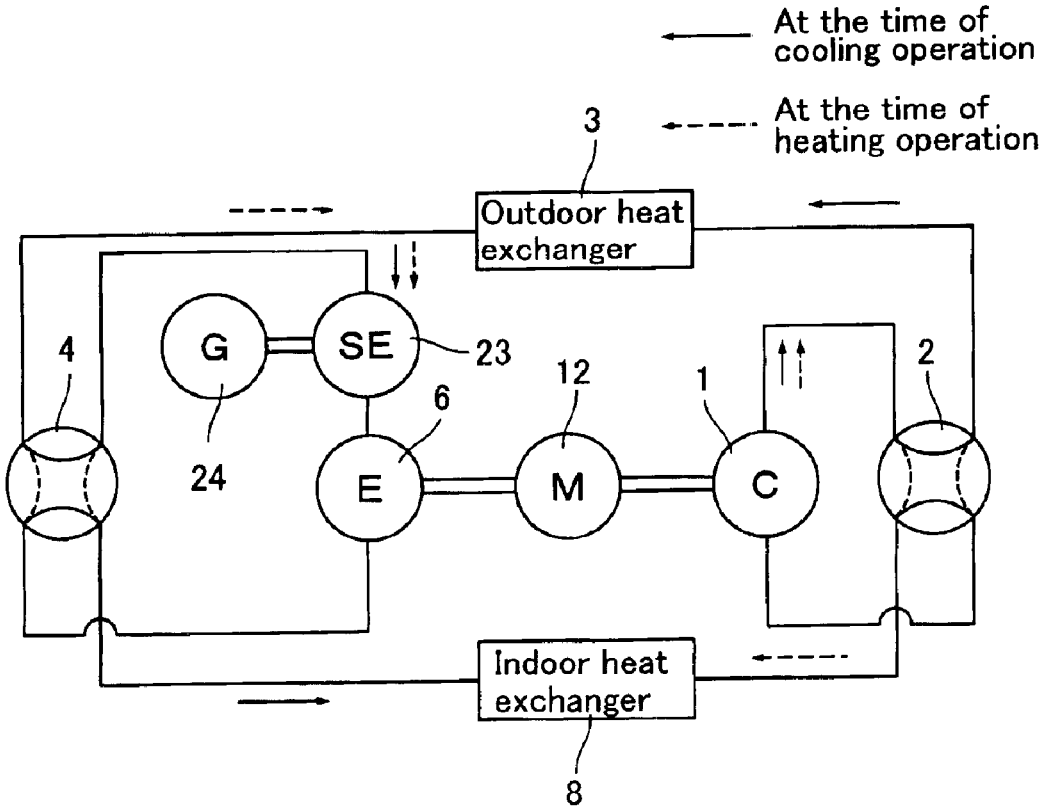
FIG. 9 shows a structure of a heat pump type cooling and heating air conditioner according to another embodiment of the invention.

FIG. 9 shows a structure of the heat pump type cooling and heating air conditioner of this embodiment.

As shown in FIG. 9, the heat pump type cooling and heating air conditioner of this embodiment uses a $CO_2$ refrigerant as a refrigerant, and comprises a refrigerant circuit in which a compressor 1 having a motor 12, an outdoor heat exchanger 3, an expander 6 and an indoor heat exchanger 8 are connected to one another through pipes.

The expander 6 is provided at its inflow side with a sub-expander 23, and an electric generator 24 is connected to a drive shaft of the sub-expander 23.

A drive shaft of the expander 6 and a drive shaft of the compressor 1 are connected to each other, and the compressor 1 utilizes power recover by the expander 6 for driving.

The refrigerant circuit comprises a first four-way valve 2 to which a discharge side pipe and a suction side pipe of the compressor 1 are connected, and a second four-way valve 4 to which a suction side pipe of the sub-expander 23 and a discharge side pipe of the expander 6 are connected.

The operation of the heat pump type cooling and heating air conditioner of this embodiment will be explained.

First, a cooling operation mode in which the outdoor heat exchanger 3 is used as a gas cooler and the indoor heat exchanger 8 is used as an evaporator will be explained. A flow of the refrigerant in the cooling operation mode is shown with solid arrows in the drawing.

Refrigerant at the time of the cooling operation mode is compressed at a high temperature and under a high pressure and is discharged by the compressor 1 which is driven by the motor 12. The refrigerant is introduced into the outdoor heat exchanger 3 through the first four-way valve 2. In the outdoor heat exchanger 3, since $CO_2$ refrigerant is in a supercritical state, the refrigerant is not brought into two-phase state, and dissipates heat to outside fluid such as air and water. Then, the $CO_2$ refrigerant is introduced into the expander 6 and the sub-expander 21 through the second four-way valve 4, and is expanded by the expander 6 or the sub-expander 21. Power recover by the expander 6 at the time of expanding operation is used for driving the compressor 1. At that time, an optimal amount of refrigerant flowing into the expander 6 is calculated from a high pressure refrigerant temperature and a high pressure refrigerant pressure detected on the side of an outlet of the outdoor heat exchanger 3. If the optimal amount of refrigerant flowing into the expander 6 is smaller than the calculated optimal refrigerant amount, the torque of the electric generator 24 (load of the electric generator) is increased to increase the high pressure side pressure, thereby increasing the volume flow rate of the refrigerant flowing into the expander 6. If the volume flow rate is greater than the calculated optimal refrigerant amount, torque of the electric generator 24 (load of electric generator) is reduced to reduce the high pressure side pressure, thereby reducing the volume flow rate of refrigerant which flows into the expander 6.

The $CO_2$ refrigerant expanded by the sub-expander 23 and the expander 6 is introduced into the indoor heat exchanger 8 through the second four-way valve 4 and is evaporated and suctions heat in the indoor heat exchanger 8. A room is cooled by this endotherm. The refrigerant which has been evaporated is drawn into the compressor 1.

Next, a heating operation mode in which the outdoor heat exchanger 3 is used as the evaporator and the indoor heat exchanger 8 is used as the gas cooler will be explained. A flow of a refrigerant in this heating operation mode is shown with dashed arrows in the drawing.

Refrigerant at the time of the heating operation mode is compressed at a high temperature and under a high pressure and is discharged by the compressor 1 which is driven by the motor 12. The refrigerant is introduced into the indoor heat exchanger 8 through the first four-way valve 2. In the indoor heat exchanger 8, since $CO_2$ refrigerant is in a supercritical state, the refrigerant is not brought into two-phase state, and dissipates heat to outside fluid such as air and water. A room is heated utilizing this radiation. Then, the $CO_2$ refrigerant is introduced into the sub-expander 23 and the expander 6 through the second four-way valve 4, and is expanded by the sub-expander 23 and the expander 6. Power recover by the expander 6 at the time of expanding operation is used for driving the compressor 1. At that time, an optimal amount of refrigerant flowing into the expander 6 is calculated from a high pressure refrigerant temperature and a high pressure refrigerant pressure detected on the side of an outlet of the outdoor heat exchanger 3. If the optimal amount of refrigerant flowing into the expander 6 is smaller than the calculated optimal refrigerant amount, the torque of the electric generator 24 (load of the electric generator) is increased to increase the high pressure side pressure, thereby increasing the volume flow rate of the refrigerant flowing into the expander 6. If the volume flow rate is greater than the calculated optimal refrigerant amount, torque of the electric generator 24 (load of electric generator) is reduced to reduce the high pressure side pressure, thereby reducing the volume flow rate of refrigerant which flows into the expander 6.

The $CO_2$ refrigerant expanded by the sub-expander 23 and the expander 6 is evaporated and suctions heat in the outdoor heat exchanger 3. The refrigerant which has been evaporated is drawn into the compressor 1 through the first four-way valve 2.

As described above, according to this embodiment, the torque of the electric generator 24 (i.e., load of the electric generator) connected to the sub-expander 23 is changed to adjust the amount of high pressure side pressure, thereby controlling the amount of refrigerant flowing through the expander 6. Therefore, it is possible to efficiently recover power in the expander 6, power recover from the sub-expander 23 is utilized for generating electricity of the electric generator 24, and it is possible to recover more power from the refrigeration cycle.

A refrigeration cycle apparatus of another embodiment of the present invention will be explained with reference to the drawing.

Figure 10:
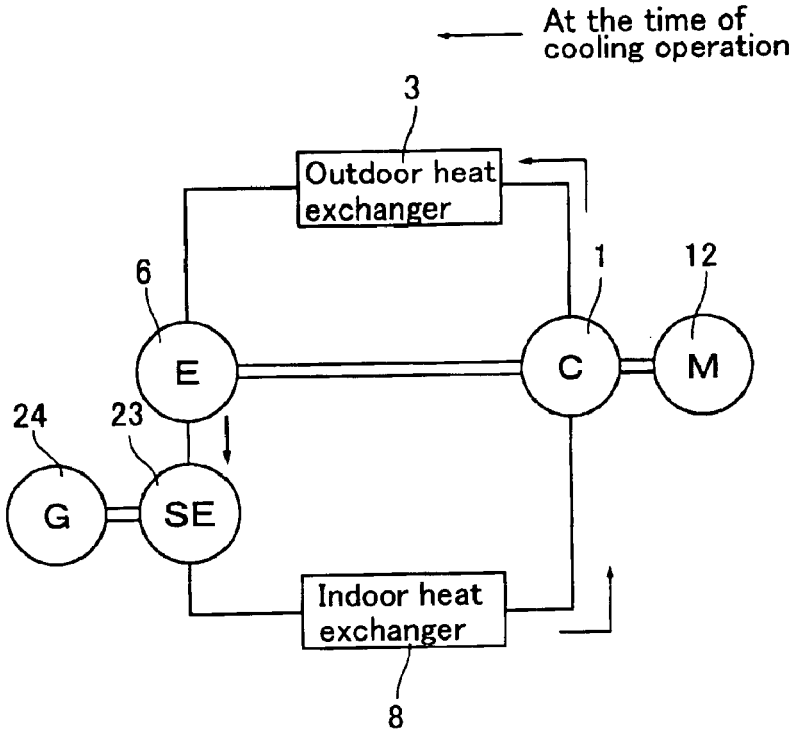
FIG. 10 shows a structure of a heat pump type air conditioner according to another embodiment of the invention.

FIG. 10 shows a structure of the heat pump type air conditioner of this embodiment.

As shown in FIG. 10, the heat pump type air conditioner of this embodiment uses a $CO_2$ refrigerant as a refrigerant, and comprises a refrigerant circuit in which a compressor 1 having a motor 12, an outdoor heat exchanger 3, an expander 6 and an indoor heat exchanger 8 are connected to one another through pipes.

The expander 6 is provided at its discharge side with a sub-expander 23, and an electric generator 24 is connected to a drive shaft of the sub-expander 23.

A drive shaft of the expander 6 and a drive shaft of the compressor 1 are connected to each other, and the compressor 1 utilizes power recover by the expander 6 for driving.

The operation of the heat pump type air conditioner of the embodiment will be explained below.

A refrigerant is compressed at a high temperature and under a high pressure and is discharged by the compressor 1 which is driven by the motor 12. The refrigerant is introduced into the outdoor heat exchanger 3. In the outdoor heat exchanger 3, since $CO_2$ refrigerant is in a supercritical state, the refrigerant is not brought into two-phase state, and dissipates heat to outside fluid such as air and water. Then, the $CO_2$ refrigerant is introduced into the expander 6 and the sub-expander 23, and is expanded by the expander 6 and the sub-expander 23. Power recover by the expander 6 at the time of expanding operation is used for driving the compressor 1. At that time, an optimal amount of refrigerant flowing into the expander 6 is calculated from a high pressure refrigerant temperature and a high pressure refrigerant pressure detected on the side of an outlet of the outdoor heat exchanger 3. If the optimal amount of refrigerant flowing into the expander 6 is smaller than the calculated optimal refrigerant amount, the torque of the electric generator 22 (load of the electric generator) is increased to reduce the low pressure side pressure, thereby increasing the volume flow rate of the refrigerant flowing into the expander 6. If the volume flow rate is greater than the calculated optimal refrigerant amount, torque of the electric generator 22 (load of electric generator) is reduced to increase the low pressure side pressure, thereby reducing the volume flow rate of refrigerant which flows into the expander 6.

The $CO_2$ refrigerant expanded by the sub-expander 23 and the expander 6 is evaporated and suctions heat in the indoor heat exchanger 8. A room is cooled by this endotherm. The refrigerant which has been evaporated is drawn into the compressor 1.

As described above, according to this embodiment, the torque of the electric generator 22 (i.e., load of the electric generator) connected to the sub-expander 23 is changed to adjust the amount of low pressure side pressure, thereby controlling the amount of refrigerant flowing through the expander 6. Therefore, it is possible to efficiently recover power in the expander 6, power recover from the sub-expander 23 is utilized for generating electricity of the electric generator 24, and it is possible to recover more power from the refrigeration cycle.

A refrigeration cycle apparatus of another embodiment of the present invention will be explained with reference to the drawing based on a heat pump type cooling and heating air conditioner.

Figure 11:
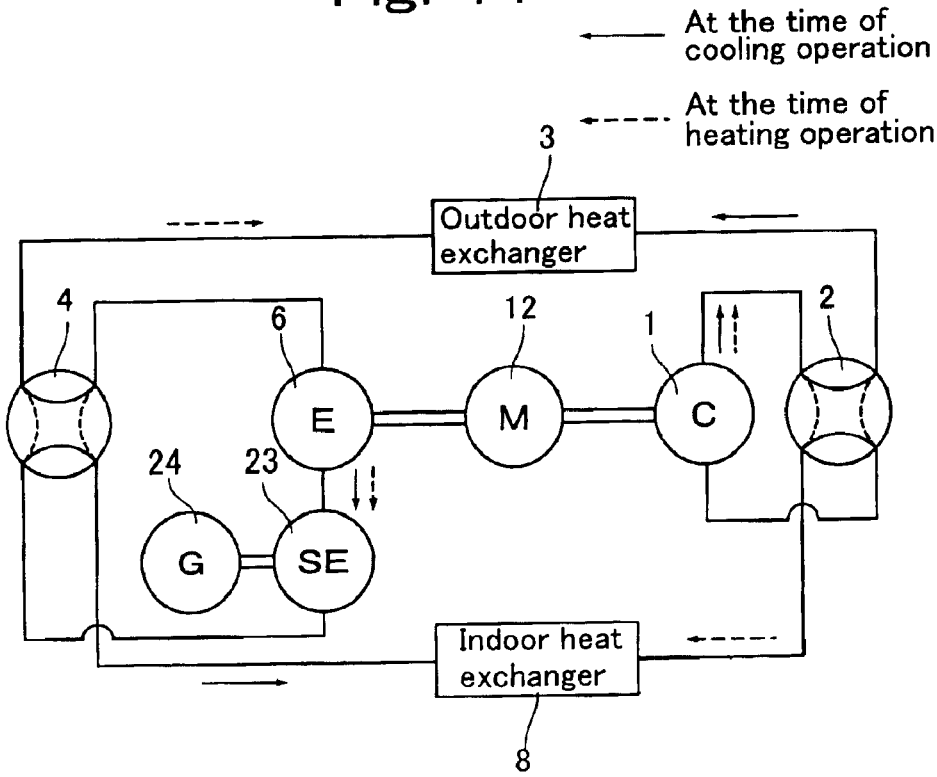
FIG. 11 shows a structure of a heat pump type cooling and heating air conditioner according to another embodiment of the invention.

FIG. 11 shows a structure of the heat pump type cooling and heating air conditioner of this embodiment.

As shown in FIG. 11, the heat pump type cooling and heating air conditioner of this embodiment uses a $CO_2$ refrigerant as a refrigerant, and comprises a refrigerant circuit in which a compressor 1 having a motor 12, an outdoor heat exchanger 3, an expander 6 and an indoor heat exchanger 8 are connected to one another through pipes.

The expander 6 is provided at its discharge side with a sub-expander 23, and an electric generator 24 is connected to a drive shaft of the sub-expander 23.

A drive shaft of the expander 6 and a drive shaft of the compressor 1 are connected to each other, and the compressor 1 utilizes power recover by the expander 6 for driving.

The refrigerant circuit comprises a first four-way valve 2 to which a discharge side pipe and a suction side pipe of the compressor 1 are connected, and a second four-way valve 4 to which a discharge side pipe of the sub-expander 23 and a suction side pipe of the expander 6 are connected.

The operation of the heat pump type cooling and heating air conditioner of this embodiment will be explained.

First, a cooling operation mode in which the outdoor heat exchanger 3 is used as a gas cooler and the indoor heat exchanger 8 is used as an evaporator will be explained. A flow of the refrigerant in the cooling operation mode is shown with solid arrows in the drawing.

Refrigerant at the time of the cooling operation mode is compressed at a high temperature and under a high pressure and is discharged by the compressor 1 which is driven by the motor 12. The refrigerant is introduced into the outdoor heat exchanger 3 through the first four-way valve 2. In the outdoor heat exchanger 3, since $CO_2$ refrigerant is in a supercritical state, the refrigerant is not brought into two-phase state, and dissipates heat to outside fluid such as air and water. Then, the $CO_2$ refrigerant is introduced into the expander 6 and the sub-expander 23 through the second four-way valve 4, and is expanded by the expander 6 and the sub-expander 23. Power recover by the expander 6 at the time of expanding operation is used for driving the compressor 1. At that time, an optimal amount of refrigerant flowing into the expander 6 is calculated from a high pressure refrigerant temperature and a high pressure refrigerant pressure detected on the side of an outlet of the outdoor heat exchanger 3. If the optimal amount of refrigerant flowing into the expander 6 is smaller than the calculated optimal refrigerant amount, the torque of the electric generator 22 (load of the electric generator) is increased to reduce the low pressure side pressure, thereby increasing the volume flow rate of the refrigerant flowing into the expander 6. If the volume flow rate is greater than the calculated optimal refrigerant amount, torque of the electric generator 22 (load of electric generator) is reduced to increase the low pressure side pressure, thereby reducing the volume flow rate of refrigerant which flows into the expander 6.

The $CO_2$ refrigerant expanded by the expander 6 and the sub-expander 23 is introduced into the indoor heat exchanger 8 through the second four-way valve 4 and is evaporated and suctions heat in the indoor heat exchanger 8. A room is cooled by this endotherm. The refrigerant which has been evaporated is drawn into the compressor 1.

Next, a heating operation mode in which the outdoor heat exchanger 3 is used as the evaporator and the indoor heat exchanger 8 is used as the gas cooler will be explained. A flow of a refrigerant in this heating operation mode is shown with dashed arrows in the drawing.

Refrigerant at the time of the heating operation mode is compressed at a high temperature and under a high pressure and is discharged by the compressor 1 which is driven by the motor 12. The refrigerant is introduced into the indoor heat exchanger 8 through the first four-way valve 2. In the indoor heat exchanger 8, since $CO_2$ refrigerant is in a supercritical state, the refrigerant is not brought into two-phase state, and dissipates heat to outside fluid such as air and water. A room is heated utilizing this radiation. Then, the $CO_2$ refrigerant is introduced into the expander 6 and the sub-expander 23 through the second four-way valve 4, and is expanded by the expander 6 or the sub-expander 23. Power recover by the expander 6 at the time of expanding operation is used for driving the compressor 1. At that time, an optimal amount of refrigerant flowing into the expander 6 is calculated from a high pressure refrigerant temperature and a high pressure refrigerant pressure detected on the side of an outlet of the outdoor heat exchanger 3. If the optimal amount of refrigerant flowing into the expander 6 is smaller than the calculated optimal refrigerant amount, the torque of the electric generator 22 (load of the electric generator) is increased to reduce the low pressure side pressure, thereby increasing the volume flow rate of the refrigerant flowing into the expander 6. If the volume flow rate is greater than the calculated optimal refrigerant amount, torque of the electric generator 22 (load of electric generator) is reduced to increase the low pressure side pressure, thereby reducing the volume flow rate of refrigerant which flows into the expander 6.

The $CO_2$ refrigerant expanded by the expander 6 and the sub-expander 23 is evaporated and suctions heat in the outdoor heat exchanger 3. The refrigerant which has been evaporated is drawn into the compressor 1 through the first four-way valve 2.

As described above, according to this embodiment, the torque of the electric generator 22 (i.e., load of the electric generator) connected to the sub-expander 23 is changed to adjust the amount of low pressure side pressure, thereby controlling the amount of refrigerant flowing through the expander 6. Therefore, it is possible to efficiently recover power in the expander 6, power recover from the sub-expander 23 is utilized for generating electricity of the electric generator 24, and it is possible to recover more power from the refrigeration cycle.

A refrigeration cycle apparatus of another embodiment of the present invention will be explained with reference to the drawing.

Figure 12:
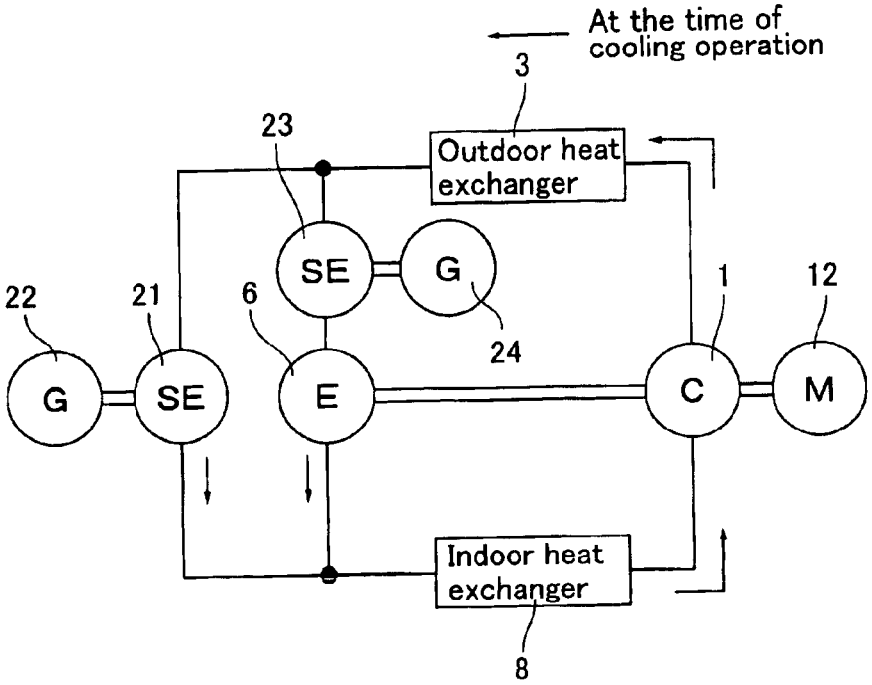
FIG. 12 shows a structure of a heat pump type air conditioner according to another embodiment of the invention.

FIG. 12 shows a structure of the heat pump type air conditioner of this embodiment.

As shown in FIG. 12, the heat pump type air conditioner of this embodiment uses a $CO_2$ refrigerant as a refrigerant, and comprises a refrigerant circuit in which a compressor 1 having a motor 12, an outdoor heat exchanger 3, an expander 6 and an indoor heat exchanger 8 are connected to one another through pipes.

The expander 6 is provided at its inflow side with a sub-expander 23, and an electric generator 24 is connected to a drive shaft of the sub-expander 23.

A bypass circuit which bypasses the sub-expander 23 and the expander 6 is provided in parallel to the sub-expander 23 and the expander 6. The bypass circuit is provided with a sub-expander 21, and an electric generator 22 is connected to a drive shaft of the sub-expander 21.

A drive shaft of the expander 6 and a drive shaft of the compressor 1 are connected to each other, and the compressor 1 utilizes power recover by the expander 6 for driving.

The operation of the heat pump type air conditioner of the embodiment will be explained below.

A refrigerant is compressed at a high temperature and under a high pressure and is discharged by the compressor 1 which is driven by the motor 12. The refrigerant is introduced into the outdoor heat exchanger 3. In the outdoor heat exchanger 3, since $CO_2$ refrigerant is in a supercritical state, the refrigerant is not brought into two-phase state, and dissipates heat to outside fluid such as air and water. Then, the $CO_2$ refrigerant is introduced into the sub-expander 23, the expander 6 and the sub-expander 21, and is expanded by the sub-expander 23, the expander 6 and the sub-expander 21. Power recover by the expander 6 at the time of expanding operation is used for driving the compressor 1. At that time, an optimal amount of refrigerant flowing into the expander 6 is calculated from a high pressure refrigerant temperature and a high pressure refrigerant pressure detected on the side of an outlet of the outdoor heat exchanger 3. If the volume flow rate is greater than the calculated optimal refrigerant amount, torque of the electric generator 22 (load of the electric generator) is reduced to increase the amount of refrigerant which is allowed to flow through the bypass circuit, thereby reducing the volume flow rate of refrigerant flowing into the expander 6. If the volume flow rate is smaller than the calculated optimal refrigerant amount, torque of the electric generator 24 (load of the electric generator) is increased to increase the high pressure side pressure, thereby increasing the volume flow rate of refrigerant flowing into the expander 6.

The $CO_2$ refrigerant expanded by the sub-expander 23 and the expander 6, or the $CO_2$ refrigerant expanded by the sub-expander 21 is evaporated and suctions heat in the indoor heat exchanger 8. A room is cooled by this endotherm. The refrigerant which has been evaporated is drawn into the compressor 1.

As described above, according to this embodiment, by changing torque of the electric generator 22 connected to the sub-expander 21 (load of the electric generator) and adjusting the amount of refrigerant flowing through the bypass circuit, it is possible to control the amount of refrigerant flowing into the expander 6. Further, by changing torque of the electric generator 24 connected to the sub-expander 23 (load of the electric generator) and adjusting the high pressure side pressure, it is possible to control the amount of refrigerant flowing into the expander 6. Therefore, it is possible to efficiently recover power in the expander 6, power recover from the sub-expander 21 and the sub-expander 23 is utilized for generating electricity of the electric generators 22 and 24, and it is possible to recover more power from the refrigeration cycle.

A refrigeration cycle apparatus of another embodiment of the present invention will be explained with reference to the drawing based on a heat pump type cooling and heating air conditioner.

Figure 13:
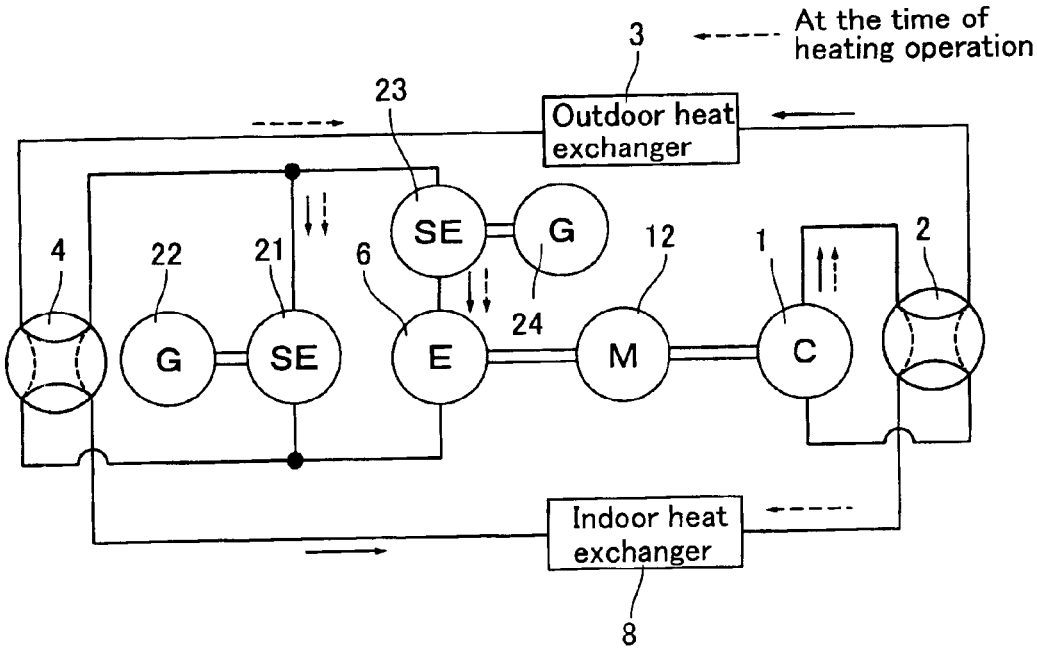
FIG. 13 shows a structure of a heat pump type cooling and heating air conditioner according to another embodiment of the invention.

FIG. 13 shows a structure of the heat pump type cooling and heating air conditioner of this embodiment.

As shown in FIG. 13, the heat pump type cooling and heating air conditioner of this embodiment uses a $CO_2$ refrigerant as a refrigerant, and comprises a refrigerant circuit in which a compressor 1 having a motor 12, an outdoor heat exchanger 3, an expander 6 and an indoor heat exchanger 8 are connected to one another through pipes.

The expander 6 is provided at its inflow side with a sub-expander 23, and an electric generator 24 is connected to a drive shaft of the sub-expander 23.

A bypass circuit which bypasses the sub-expander 23 and the expander 6 is provided in parallel to the sub-expander 23 and the expander 6. The bypass circuit is provided with a sub-expander 21, and an electric generator 22 is connected to a drive shaft of the sub-expander 21. The bypass circuit is connected to the second four-way valve 4 like the sub-expander 23 and the expander 6.

A drive shaft of the expander 6 and a drive shaft of the compressor 1 are connected to each other, and the compressor 1 utilizes power recover by the expander 6 for driving.

The refrigerant circuit includes a first four-way valve 2 to which a discharge side pipe and a suction side pipe of the compressor 1 are connected, and a second four-way valve 4 to which a suction side pipe of the sub-expander 23, a discharge side pipe of the expander 6 and the bypass circuit are connected.

The operation of the heat pump type cooling and heating air conditioner of this embodiment will be explained.

First, a cooling operation mode in which the outdoor heat exchanger 3 is used as a gas cooler and the indoor heat exchanger 8 is used as an evaporator will be explained. A flow of the refrigerant in the cooling operation mode is shown with solid arrows in the drawing.

Refrigerant at the time of the cooling operation mode is compressed at a high temperature and under a high pressure and is discharged by the compressor 1 which is driven by the motor 12. The refrigerant is introduced into the outdoor heat exchanger 3 through the first four-way valve 2. In the outdoor heat exchanger 3, since $CO_2$ refrigerant is in a supercritical state, the refrigerant is not brought into two-phase state, and dissipates heat to outside fluid such as air and water. Then, the $CO_2$ refrigerant is introduced into the sub-expander 23, the expander 6 and the sub-expander 21, and is expanded by the sub-expander 23, the expander 6 and the sub-expander 21. Power recover by the expander 6 at the time of expanding operation is used for driving the compressor 1. At that time, an optimal amount of refrigerant flowing into the expander 6 is calculated from a high pressure refrigerant temperature and a high pressure refrigerant pressure detected on the outlet side of the outdoor heat exchanger 3. If the volume flow rate is greater than the calculated optimal refrigerant amount, torque of the electric generator 22 (load of the electric generator) is reduced to increase the amount of refrigerant which is allowed to flow into the bypass circuit, thereby reducing the volume flow rate of refrigerant flowing into the expander 6. If the volume flow rate is smaller than the calculated optimal refrigerant amount, torque of the electric generator 24 (load of the electric generator) is increased to increase the high pressure side pressure, thereby increasing the volume flow rate of refrigerant flowing into the expander 6.

The $CO_2$ refrigerant expanded by the sub-expander 23 and the expander 6, or the $CO_2$ refrigerant expanded by the sub-expander 21 is introduced to the indoor heat exchanger 8 through the second four-way valve 4, and is evaporated and suctions heat in the indoor heat exchanger 8. A room is heated utilizing this radiation. The refrigerant which has been evaporated is drawn into the compressor 1.

Next, a heating operation mode in which the outdoor heat exchanger 3 is used as the evaporator and the indoor heat exchanger 8 is used as the gas cooler will be explained. A flow of a refrigerant in this heating operation mode is shown with dashed arrows in the drawing.

Refrigerant at the time of the heating operation mode is compressed at a high temperature and under a high pressure and is discharged by the compressor 1 which is driven by the motor 12. The refrigerant is introduced into the indoor heat exchanger 8 through the first four-way valve 2. In the indoor heat exchanger 8, since $CO_2$ refrigerant is in a supercritical state, the refrigerant is not brought into two-phase state, and dissipates heat to outside fluid such as air and water. A room is heated utilizing this radiation. Then, the $CO_2$ refrigerant is introduced into the sub-expander 23, the expander 6, and the sub-expander 21, and is expanded by the sub-expander 23, the expander 6, and the sub-expander 21. Power recover by the expander 6 at the time of expanding operation is used for driving the compressor 1. At that time, an optimal amount of refrigerant flowing into the expander 6 is calculated from a high pressure refrigerant temperature and a high pressure refrigerant pressure detected on the side of an outlet of the indoor heat exchanger 8. If the volume flow rate is greater than the calculated optimal refrigerant amount, torque of the electric generator 22 (load of the electric generator) is reduced to increase the amount of refrigerant which is allowed to flow into the bypass circuit, thereby reducing the volume flow rate of refrigerant flowing into the expander 6. If the volume flow rate is smaller than the calculated optimal refrigerant amount, torque of the electric generator 24 (load of the electric generator) is increased to increase the high pressure side pressure, thereby increasing the volume flow rate of refrigerant flowing into the expander 6.

The $CO_2$ refrigerant expanded by the sub-expander 23 and the expander 6, or the $CO_2$ refrigerant expanded by the sub-expander 21 is introduced to the outdoor heat exchanger 3 through the second four-way valve 4, and is evaporated and suctions heat in the outdoor heat exchanger 3. The refrigerant which has been evaporated is drawn into the compressor 1 through the first four-way valve 2.

As described above, according to this embodiment, by changing torque of the electric generator 22 connected to the sub-expander 21 (load of the electric generator) and adjusting the amount of refrigerant flowing through the bypass circuit, it is possible to control the amount of refrigerant flowing into the expander 6. Further, by changing torque of the electric generator 24 connected to the sub-expander 23 (load of the electric generator) and adjusting the high pressure side pressure, it is possible to control the amount of refrigerant flowing into the expander 6. Therefore, it is possible to efficiently recover power in the expander 6, power recover from the sub-expander 21 and the sub-expander 23 is utilized for generating electricity of the electric generators 22 and 24, and it is possible to recover more power from the refrigeration cycle.

A refrigeration cycle apparatus of another embodiment of the present invention will be explained with reference to the drawing.

Figure 14:
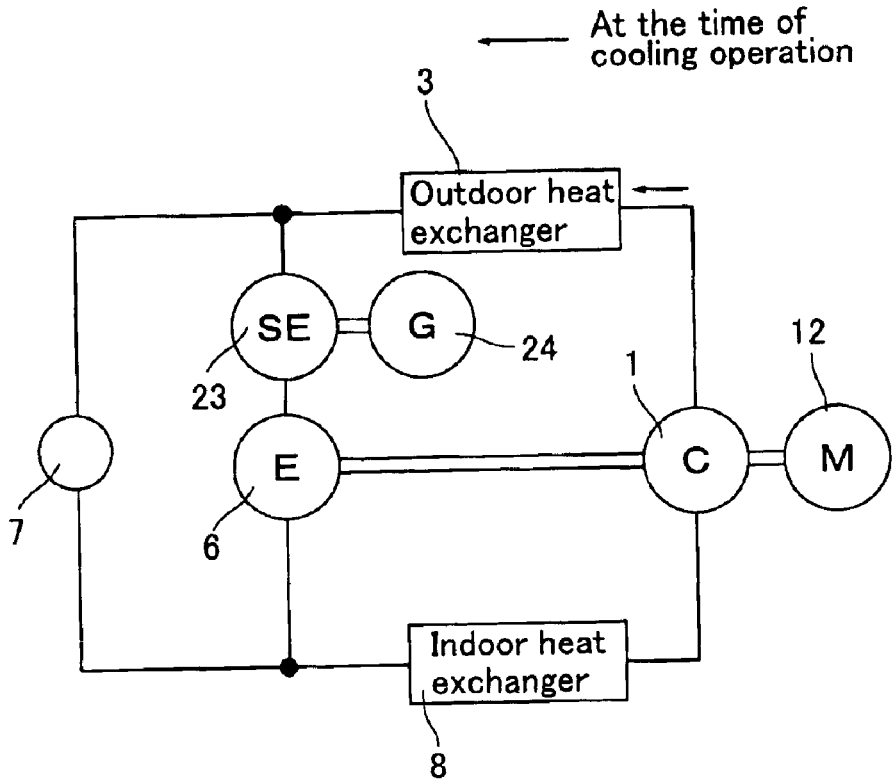
FIG. 14 shows a structure of a heat pump type air conditioner according to another embodiment of the invention.

FIG. 14 shows a structure of the heat pump type air conditioner of this embodiment.

As shown in FIG. 14, the heat pump type air conditioner of this embodiment uses a $CO_2$ refrigerant as a refrigerant, and comprises a refrigerant circuit in which a compressor 1 having a motor 12, an outdoor heat exchanger 3, an expander 6 and an indoor heat exchanger 8 are connected to one another through pipes.

The expander 6 is provided at its inflow side with a sub-expander 23, and an electric generator 24 is connected to a drive shaft of the sub-expander 23.

A bypass circuit which bypasses the sub-expander 23 and the expander 6 is provided in parallel to the sub-expander 23 and the expander 6. The bypass circuit is provided with a bypass valve 7.

A drive shaft of the expander 6 and a drive shaft of the compressor 1 are connected to each other, and the compressor 1 utilizes power recover by the expander 6 for driving.

The operation of the heat pump type air conditioner of the embodiment will be explained below.

A refrigerant is compressed at a high temperature and under a high pressure and is discharged by the compressor 1 which is driven by the motor 12. The refrigerant is introduced into the outdoor heat exchanger 3. In the outdoor heat exchanger 3, since $CO_2$ refrigerant is in a supercritical state, the refrigerant is not brought into two-phase state, and dissipates heat to outside fluid such as air and water. Then, the $CO_2$ refrigerant is introduced into the sub-expander 23 and the expander 6, and is expanded by the sub-expander 23 and the expander 6. Power recover by the expander 6 at the time of expanding operation is used for driving the compressor 1. At that time, an optimal amount of refrigerant flowing into the expander 6 is calculated from a high pressure refrigerant temperature and a high pressure refrigerant pressure detected on the side of an outlet of the outdoor heat exchanger 3. If the volume flow rate is greater than the calculated optimal refrigerant amount, the opening of the bypass valve 7 is increased to increase the amount of refrigerant which is allowed to flow into the bypass circuit, thereby reducing the volume flow rate of refrigerant flowing into the expander 6. If the volume flow rate is smaller than the calculated optimal refrigerant amount, torque of the electric generator 24 (load of the electric generator) is increased to increase the high pressure side pressure, thereby increasing the volume flow rate of refrigerant flowing into the expander 6.

The $CO_2$ refrigerant expanded by the sub-expander 23 and the expander 6 is evaporated and suctions heat in the indoor heat exchanger 8. A room is cooled by this endotherm. The refrigerant which has been evaporated is drawn into the compressor 1.

As described above, according to this embodiment, by changing the opening of the bypass valve 7 and adjusting the amount of refrigerant flowing through the bypass circuit, it is possible to control the amount of refrigerant flowing into the expander 6. Further, by changing torque of the electric generator 24 connected to the sub-expander 23 (load of the electric generator) and adjusting the high pressure side pressure, it is possible to control the amount of refrigerant flowing into the expander 6. Therefore, it is possible to efficiently recover power in the expander 6, power recover from the sub-expander 23 is utilized for generating electricity of the electric generators 22 and 24, and it is possible to recover more power from the refrigeration cycle.

A refrigeration cycle apparatus of another embodiment of the present invention will be explained with reference to the drawing based on a heat pump type cooling and heating air conditioner.

Figure 15:
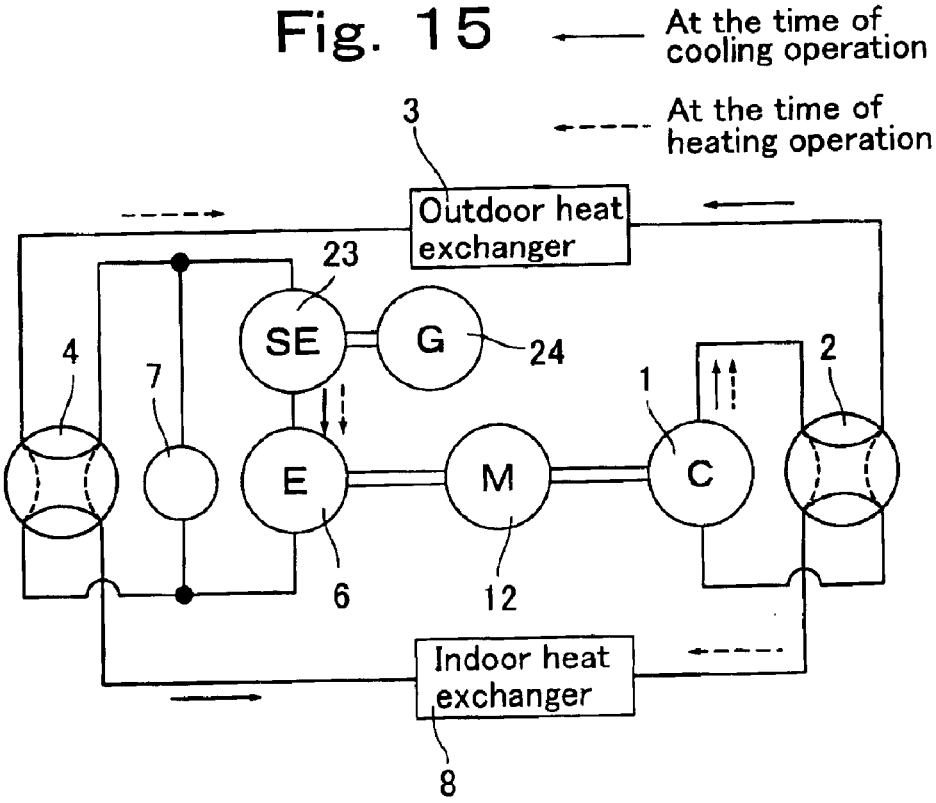
FIG. 15 shows a structure of a heat pump type cooling and heating air conditioner according to another embodiment of the invention.

FIG. 15 shows a structure of the heat pump type cooling and heating air conditioner of this embodiment.

As shown in FIG. 15, the heat pump type cooling and heating air conditioner of this embodiment uses a $CO_2$ refrigerant as a refrigerant, and comprises a refrigerant circuit in which a compressor 1 having a motor 12, an outdoor heat exchanger 3, an expander 6 and an indoor heat exchanger 8 are connected to one another through pipes.

The expander 6 is provided at its inflow side with a sub-expander 23, and an electric generator 24 is connected to a drive shaft of the sub-expander 23.

A bypass circuit which bypasses the sub-expander 23 and the expander 6 is provided in parallel to the sub-expander 23 and the expander 6. The bypass circuit is provided with a bypass valve 7. The bypass circuit is connected to the second four-way valve 4 like the sub-expander 23 and the expander 6.

A drive shaft of the expander 6 and a drive shaft of the compressor 1 are connected to each other, and the compressor 1 utilizes power recover by the expander 6 for driving.

The refrigerant circuit includes a first four-way valve 2 to which a discharge side pipe and a suction side pipe of the compressor 1 are connected, and a second four-way valve 4 to which a suction side pipe of the sub-expander 23, a discharge side pipe of the expander 6 and the bypass circuit are connected.

The operation of the heat pump type cooling and heating air conditioner of this embodiment will be explained.

First, a cooling operation mode in which the outdoor heat exchanger 3 is used as a gas cooler and the indoor heat exchanger 8 is used as an evaporator will be explained. A flow of the refrigerant in the cooling operation mode is shown with solid arrows in the drawing.

Refrigerant at the time of the cooling operation mode is compressed at a high temperature and under a high pressure and is discharged by the compressor 1 which is driven by the motor 12. The refrigerant is introduced into the outdoor heat exchanger 3 through the first four-way valve 2. In the outdoor heat exchanger 3, since $CO_2$ refrigerant is in a supercritical state, the refrigerant is not brought into two-phase state, and dissipates heat to outside fluid such as air and water. Then, the $CO_2$ refrigerant is introduced into the sub-expander 23 and the expander 6, and is expanded by the sub-expander 23 and the expander 6. Power recover by the expander 6 at the time of expanding operation is used for driving the compressor 1. At that time, an optimal amount of refrigerant flowing into the expander 6 is calculated from a high pressure refrigerant temperature and a high pressure refrigerant pressure detected on the outlet side of the outdoor heat exchanger 3. If the volume flow rate is greater than the calculated optimal refrigerant amount, the opening of the bypass valve 7 is increased to increase the amount of refrigerant which is allowed to flow into the bypass circuit, thereby reducing the volume flow rate of refrigerant flowing into the expander 6. If the volume flow rate is smaller than the calculated optimal refrigerant amount, torque of the electric generator 24 (load of the electric generator) is increased to increase the high pressure side pressure, thereby increasing the volume flow rate of refrigerant flowing into the expander 6.

The $CO_2$ refrigerant expanded by the sub-expander 23 and the expander 6 is introduced into the indoor heat exchanger 8 through the second four-way valve 4 and evaporated and suctions heat in the indoor heat exchanger 8. A room is cooled by this endotherm. The refrigerant which has been evaporated is drawn into the compressor 1.

Next, a heating operation mode in which the outdoor heat exchanger 3 is used as the evaporator and the indoor heat exchanger 8 is used as the gas cooler will be explained. A flow of a refrigerant in this heating operation mode is shown with dashed arrows in the drawing.

Refrigerant at the time of the heating operation mode is compressed at a high temperature and under a high pressure and is discharged by the compressor 1 which is driven by the motor 12. The refrigerant is introduced into the indoor heat exchanger 8 through the first four-way valve 2. In the indoor heat exchanger 8, since $CO_2$ refrigerant is in a supercritical state, the refrigerant is not brought into two-phase state, and dissipates heat to outside fluid such as air and water. A room is heated utilizing this radiation. Then, the $CO_2$ refrigerant is introduced into the sub-expander 23 and the expander 6 and is expanded by the sub-expander 23 and the expander 6. Power recover by the expander 6 at the time of expanding operation is used for driving the compressor 1. At that time, an optimal amount of refrigerant flowing into the expander 6 is calculated from a high pressure refrigerant temperature and a high pressure refrigerant pressure detected on the side of an outlet of the indoor heat exchanger 8. If the volume flow rate is greater than the calculated optimal refrigerant amount, the opening of the bypass valve 7 is increased to increase the amount of refrigerant which is allowed to flow into the bypass circuit, thereby reducing the volume flow rate of refrigerant flowing into the expander 6. If the volume flow rate is smaller than the calculated optimal refrigerant amount, torque of the electric generator 24 (load of the electric generator) is increased to increase the high pressure side pressure, thereby increasing the volume flow rate of refrigerant flowing into the expander 6.

The $CO_2$ refrigerant expanded by the sub-expander 23 and the expander 6 is introduced into the outdoor heat exchanger 3 through the second four-way valve 4 and is evaporated and suctions heat in the outdoor heat exchanger 3. The refrigerant which has been evaporated is drawn into the compressor 1 through the first four-way valve 2.

As described above, according to this embodiment, by changing the opening of the bypass valve 7 and adjusting the amount of refrigerant flowing through the bypass circuit, it is possible to control the amount of refrigerant flowing into the expander 6. Further, by changing torque of the electric generator 24 connected to the sub-expander 23 (load of the electric generator) and adjusting the high pressure side pressure, it is possible to control the amount of refrigerant flowing into the expander 6. Therefore, it is possible to efficiently recover power in the expander 6, power recover from the sub-expander 23 is utilized for generating electricity of the electric generator 24, and it is possible to recover more power from the refrigeration cycle.

A refrigeration cycle apparatus of another embodiment of the present invention will be explained with reference to the drawing.

Figure 16:
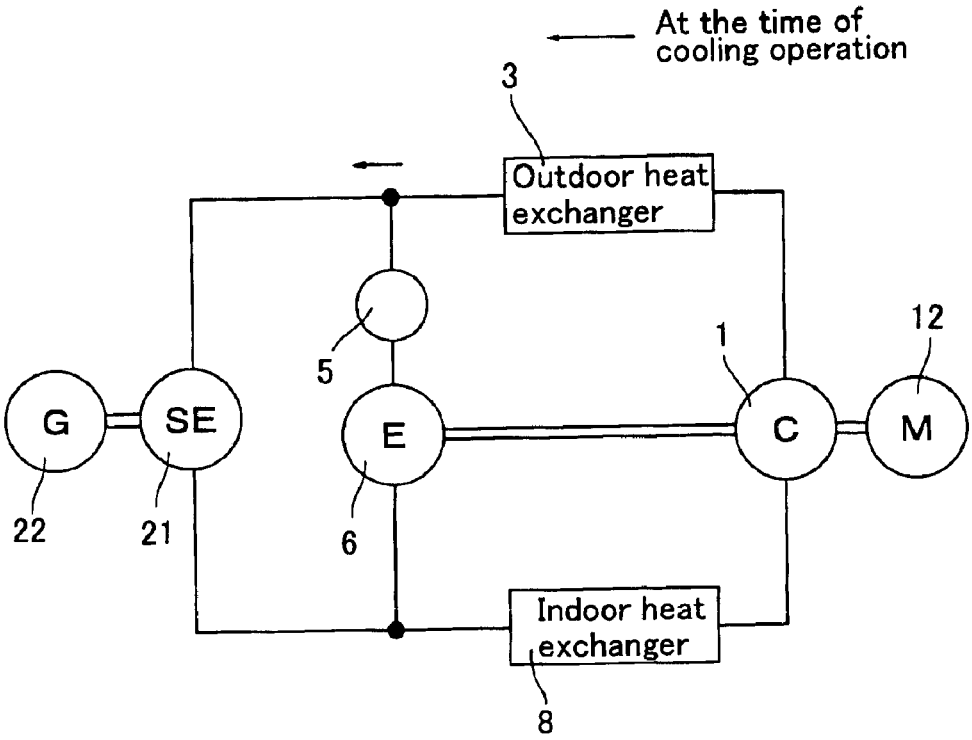
FIG. 16 shows a structure of a heat pump type air conditioner according to another embodiment of the invention.

FIG. 16 shows a structure of the heat pump type air conditioner of this embodiment.

As shown in FIG. 16, the heat pump type air conditioner of this embodiment uses a $CO_2$ refrigerant as a refrigerant, and comprises a refrigerant circuit in which a compressor 1 having a motor 12, an outdoor heat exchanger 3, an expander 6 and an indoor heat exchanger 8 are connected to one another through pipes.

The expander 6 is provided at its inflow side with a pre-expansion valve 5.

A bypass circuit which bypasses the pre-expansion valve 5 and the expander 6 is provided in parallel to the pre-expansion valve 5 and the expander 6. The bypass circuit is provided with a sub-expander 21, and an electric generator 22 is connected to a drive shaft of the sub-expander 21.

A drive shaft of the expander 6 and a drive shaft of the compressor 1 are connected to each other, and the compressor 1 utilizes power recover by the expander 6 for driving.

The operation of the heat pump type air conditioner of the embodiment will be explained below.

A refrigerant is compressed at a high temperature and under a high pressure and is discharged by the compressor 1 which is driven by the motor 12. The refrigerant is introduced into the outdoor heat exchanger 3. In the outdoor heat exchanger 3, since $CO_2$ refrigerant is in a supercritical state, the refrigerant is not brought into two-phase state, and dissipates heat to outside fluid such as air and water. Then, the $CO_2$ refrigerant is introduced into the pre-expansion valve 5, the expander 6 and the sub-expander 21 is expanded by the pre-expansion valve 5, the expander 6 and the sub-expander 21. Power recover by the expander 6 at the time of expanding operation is used for driving the compressor 1. At that time, an optimal amount of refrigerant flowing into the expander 6 is calculated from a high pressure refrigerant temperature and a high pressure refrigerant pressure detected on the side of an outlet of the outdoor heat exchanger 3. If the volume flow rate is greater than the calculated optimal refrigerant amount, torque of the electric generator 22 (load of the electric generator) is reduced to increase the amount of refrigerant which is allowed to flow into the bypass circuit, thereby reducing the volume flow rate of refrigerant flowing into the expander 6. If the volume flow rate is smaller than the calculated optimal refrigerant amount, the opening of the pre-expansion valve 5 is reduced to increase the high pressure side pressure, thereby increasing the volume flow rate of refrigerant flowing into the expander 6.

The $CO_2$ refrigerant expanded by the pre-expansion valve 5 and the expander 6 or the $CO_2$ refrigerant expanded by the sub-expander 21 is evaporated and suctions heat in the indoor heat exchanger 8. A room is cooled by this endotherm. The refrigerant which has been evaporated is drawn into the compressor 1.

As described above, according to this embodiment, by changing the torque of the electric generator 22 connected to the sub-expander 21 (load of the electric generator) to adjust the amount of refrigerant flowing through the bypass circuit, it is possible to control the amount of refrigerant flowing into the expander 6. Further, by changing the opening of the pre-expansion valve 5 to adjust the high pressure side pressure, it is possible to control the amount of refrigerant flowing into the expander 6. Therefore, it is possible to efficiently recover power in the expander 6, power recover from the sub-expander 21 is utilized for generating electricity of the electric generators 22 and 24, and it is possible to recover more power from the refrigeration cycle.

A refrigeration cycle apparatus of another embodiment of the present invention will be explained with reference to the drawing based on a heat pump type cooling and heating air conditioner.

Figure 17:
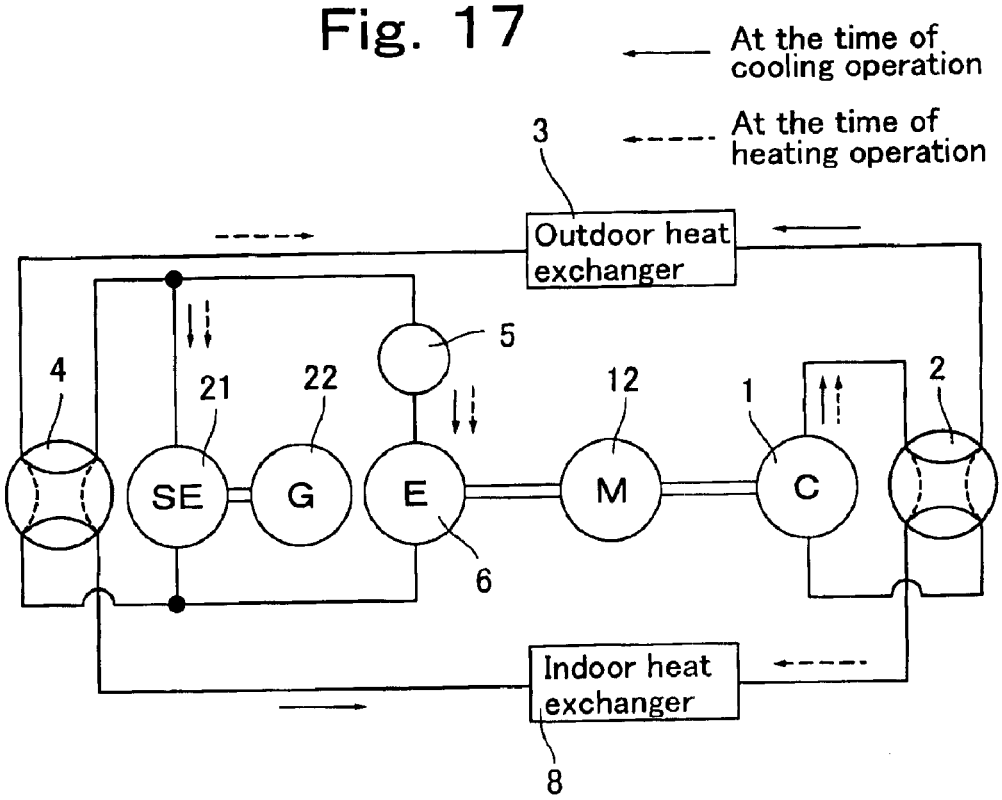
FIG. 17 shows a structure of a heat pump type cooling and heating air conditioner according to another embodiment of the invention.

FIG. 17 shows a structure of the heat pump type cooling and heating air conditioner of this embodiment.

As shown in FIG. 17, the heat pump type cooling and heating air conditioner of this embodiment uses a $CO_2$ refrigerant as a refrigerant, and comprises a refrigerant circuit in which a compressor 1 having a motor 12, an outdoor heat exchanger 3, an expander 6 and an indoor heat exchanger 8 are connected to one another through pipes.

The expander 6 is provided at its inflow side with a pre-expansion valve 5.

A bypass circuit which bypasses the pre-expansion valve 5 and the expander 6 is provided in parallel to the pre-expansion valve 5 and the expander 6. The bypass circuit is provided with a sub-expander 21, and an electric generator 22 is connected to a drive shaft of the sub-expander 21. The bypass circuit is connected to the second four-way valve 4 like the sub-expander 23 and the expander 6.

A drive shaft of the expander 6 and a drive shaft of the compressor 1 are connected to each other, and the compressor 1 utilizes power recover by the expander 6 for driving.

The refrigerant circuit includes a first four-way valve 2 to which a discharge side pipe and a suction side pipe of the compressor 1 are connected, and a second four-way valve 4 to which a suction side pipe of the pre-expansion valve 5, a discharge side pipe of the expander 6 and the bypass circuit are connected.

The operation of the heat pump type cooling and heating air conditioner of this embodiment will be explained.

First, a cooling operation mode in which the outdoor heat exchanger 3 is used as a gas cooler and the indoor heat exchanger 8 is used as an evaporator will be explained. A flow of the refrigerant in the cooling operation mode is shown with solid arrows in the drawing.

Refrigerant at the time of the cooling operation mode is compressed at a high temperature and under a high pressure and is discharged by the compressor 1 which is driven by the motor 12. The refrigerant is introduced into the outdoor heat exchanger 3. In the outdoor heat exchanger 3, since $CO_2$ refrigerant is in a supercritical state, the refrigerant is not brought into two-phase state, and dissipates heat to outside fluid such as air and water. Then, the $CO_2$ refrigerant is introduced into the pre-expansion valve 5, the expander 6 and the sub-expander 21 is expanded by the pre-expansion valve 5, the expander 6 and the sub-expander 21. Power recover by the expander 6 at the time of expanding operation is used for driving the compressor 1. At that time, an optimal amount of refrigerant flowing into the expander 6 is calculated from a high pressure refrigerant temperature and a high pressure refrigerant pressure detected on the side of an outlet of the outdoor heat exchanger 3. If the volume flow rate is greater than the calculated optimal refrigerant amount, torque of the electric generator 22 (load of the electric generator) is reduced to increase the amount of refrigerant which is allowed to flow into the bypass circuit, thereby reducing the volume flow rate of refrigerant flowing into the expander 6. If the volume flow rate is smaller than the calculated optimal refrigerant amount, the opening of the pre-expansion valve 5 is reduced to increase the high pressure side pressure, thereby increasing the volume flow rate of refrigerant flowing into the expander 6.

The $CO_2$ refrigerant expanded by the pre-expansion valve 5 and the expander 6 or the $CO_2$ refrigerant expanded by the sub-expander 21 is introduced into the indoor heat exchanger 8 through the second four-way valve 4 and evaporated and suctions heat in the indoor heat exchanger 8. A room is cooled by this endotherm. The refrigerant which has been evaporated is drawn into the compressor 1.

Next, a heating operation mode in which the outdoor heat exchanger 3 is used as the evaporator and the indoor heat exchanger 8 is used as the gas cooler will be explained. A flow of a refrigerant in this heating operation mode is shown with dashed arrows in the drawing.

Refrigerant at the time of the heating operation mode is compressed at a high temperature and under a high pressure and is discharged by the compressor 1 which is driven by the motor 12. The refrigerant is introduced into the indoor heat exchanger 8 through the first four-way valve 2. In the indoor heat exchanger 8, since $CO_2$ refrigerant is in a supercritical state, the refrigerant is not brought into two-phase state, and dissipates heat to outside fluid such as air and water. A room is heated utilizing this radiation. Then, the $CO_2$ refrigerant is introduced into the pre-expansion valve 5, the expander 6 and the sub-expander 21, and is expanded by the pre-expansion valve 5, the expander 6 and the sub-expander 21. Power recover by the expander 6 at the time of expanding operation is used for driving the compressor 1. At that time, an optimal amount of refrigerant flowing into the expander 6 is calculated from a high pressure refrigerant temperature and a high pressure refrigerant pressure detected on the side of an outlet of the indoor heat exchanger 8. If the volume flow rate is greater than the calculated optimal refrigerant amount, torque of the electric generator 22 (load of the electric generator) is reduced to increase the amount of refrigerant which is allowed to flow into the bypass circuit, thereby reducing the volume flow rate of refrigerant flowing into the expander 6. If the volume flow rate is smaller than the calculated optimal refrigerant amount, the opening of the pre-expansion valve 5 is reduced to increase the high pressure side pressure, thereby increasing the volume flow rate of refrigerant flowing into the expander 6.

The $CO_2$ refrigerant expanded by the pre-expansion valve 5 and the expander 6 or the $CO_2$ refrigerant expanded by the sub-expander 21 is introduced into the outdoor heat exchanger 3 through the second four-way valve 4 and evaporated and suctions heat in the outdoor heat exchanger 3. The refrigerant which has been evaporated is drawn into the compressor 1 through the first four-way valve 2.

As described above, according to this embodiment, by changing the torque of the electric generator 22 connected to the sub-expander 21 (load of the electric generator) to adjust the amount of refrigerant flowing through the bypass circuit, it is possible to control the amount of refrigerant flowing into the expander 6. Further, by changing the opening of the pre-expansion valve 5 to adjust the high pressure side pressure, it is possible to control the amount of refrigerant flowing into the expander 6. Therefore, it is possible to efficiently recover power in the expander 6, power recover from the sub-expander 21 is utilized for generating electricity of the electric generator 22, and it is possible to recover more power from the refrigeration cycle.

A refrigeration cycle apparatus of another embodiment of the present invention will be explained with reference to the drawing.

Figure 18:
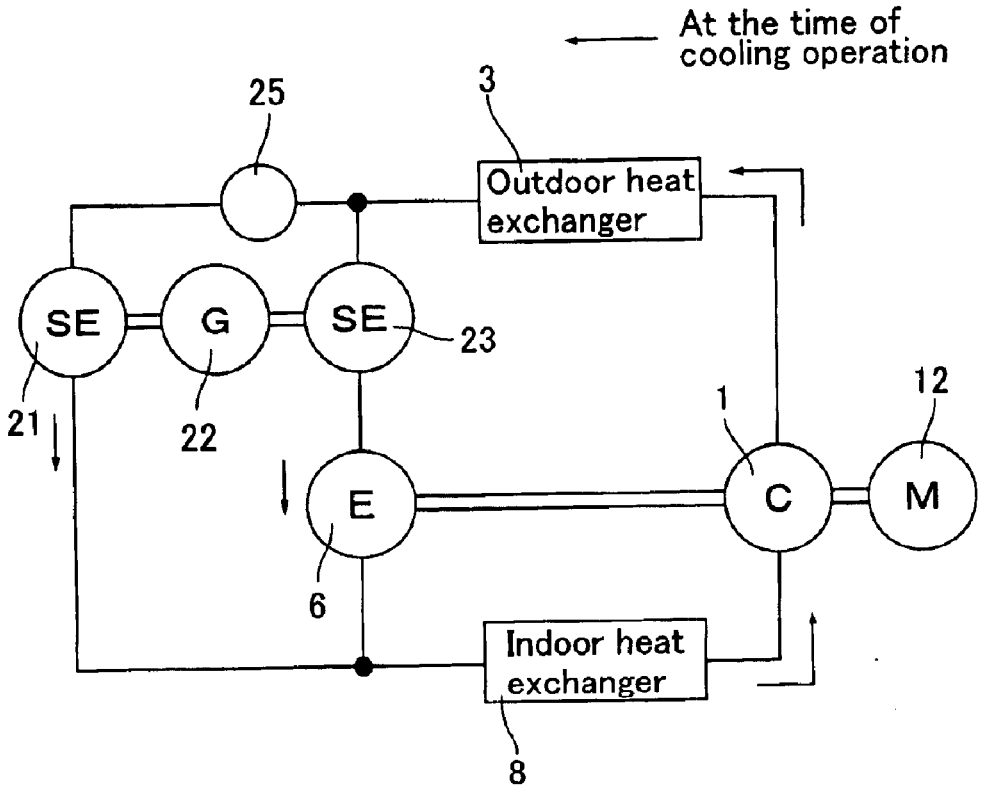
FIG. 18 shows a structure of a heat pump type air conditioner according to another embodiment of the invention.

FIG. 18 shows a structure of the heat pump type air conditioner of this embodiment.

As shown in FIG. 18, the heat pump type air conditioner of this embodiment uses a $CO_2$ refrigerant as a refrigerant, and comprises a refrigerant circuit in which a compressor 1 having a motor 12, an outdoor heat exchanger 3, an expander 6 and an indoor heat exchanger 8 are connected to one another through pipes.

The expander 6 is provided at its inflow side with a sub-expander 23, and an electric generator 22 is connected to a drive shaft of the sub-expander 23.

A bypass circuit which bypasses the sub-expander 23 and the expander 6 is provided in parallel to the sub-expander 23 and the expander 6. The bypass circuit is provided with a sub-expander 21, and an electric generator 22 is connected to a drive shaft of the sub-expander 21.

Here, the electric generator 22 includes a clutch mechanism which is connected to one of the sub-expander 21 and the sub-expander 23. The bypass circuit is provided at its inflow side with a flow path valve 25.

A drive shaft of the expander 6 and a drive shaft of the compressor 1 are connected to each other, and the compressor 1 utilizes power recover by the expander 6 for driving.

The operation of the heat pump type air conditioner of the embodiment will be explained below.

A refrigerant is compressed at a high temperature and under a high pressure and is discharged by the compressor 1 which is driven by the motor 12. The refrigerant is introduced into the outdoor heat exchanger 3. In the outdoor heat exchanger 3, since $CO_2$ refrigerant is in a supercritical state, the refrigerant is not brought into two-phase state, and dissipates heat to outside fluid such as air and water. Then, the $CO_2$ refrigerant is introduced into the sub-expander 23 and the expander 6 and is expanded by the sub-expander 23 and the expander 6. Power recover by the expander 6 at the time of expanding operation is used for driving the compressor 1. At that time, an optimal amount of refrigerant flowing into the expander 6 is calculated from a high pressure refrigerant temperature and a high pressure refrigerant pressure detected on the side of an outlet of the outdoor heat exchanger 3. If the volume flow rate is greater than the calculated optimal refrigerant amount, the flow path valve 25 is opened, the electric generator 22 is connected to the sub-expander 21 to allow refrigerant to flow into the bypass circuit, thereby reducing the volume flow rate of refrigerant flowing into the expander 6. In this case, the sub-expander 23 is not allowed to operate. It is preferable that torque of the electric generator 22 is adjusted to change the bypass amount. If the volume flow rate is smaller than the calculated optimal refrigerant amount, the flow path valve 25 is closed, the electric generator 22 is connected to the sub-expander 23, the high pressure side pressure is increased, and the volume flow rate of refrigerant flowing into the expander 6 is increased. In this case, the sub-expander 21 is not allowed to operate. It is preferable that torque of the electric generator 22 is adjusted to change the high pressure side pressure.

The $CO_2$ refrigerant expanded by the sub-expander 23 and the expander 6 or the $CO_2$ refrigerant expanded by the sub-expander 21 and the expander 6 is evaporated and suctions heat in the indoor heat exchanger 8. A room is cooled by this endotherm. The refrigerant which has been evaporated is drawn into the compressor 1.

As described above, according to this embodiment, the open/close valve 25 is opened, the sub-expander 21 is connected to the electric generator 22, thereby adjusting the amount of refrigerant flowing through the bypass circuit, and it is possible to control the amount of refrigerant flowing into the expander 6. The open/close valve 25 is closed, torque of the electric generator 24 connected to the sub-expander 23 (load of the electric generator) is changed to adjust the high pressure side pressure, and it is possible to control the amount of refrigerant flowing into the expander 6. Therefore, it is possible to efficiently recover power in the expander 6. Power recover from the sub-expander 21 or the sub-expander 23 is utilized for generating electricity of the electric generators 22 and 24, and it is possible to recover more power from the refrigeration cycle.

A refrigeration cycle apparatus of another embodiment of the present invention will be explained with reference to the drawing.

Figure 19:
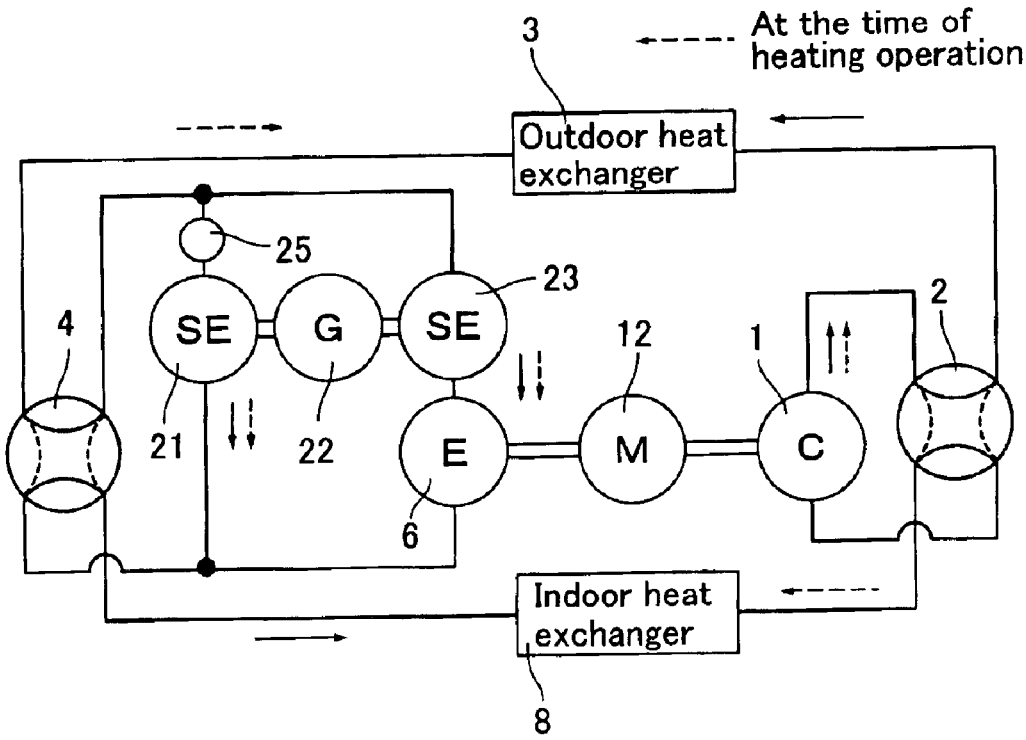
FIG. 19 shows a structure of a heat pump type cooling and heating air conditioner according to another embodiment of the invention.

FIG. 19 shows a structure of the heat pump type air conditioner of this embodiment.

As shown in FIG. 19, the heat pump type air conditioner of this embodiment uses a $CO_2$ refrigerant as a refrigerant, and comprises a refrigerant circuit in which a compressor 1 having a motor 12, an outdoor heat exchanger 3, an expander 6 and an indoor heat exchanger 8 are connected to one another through pipes.

The expander 6 is provided at its inflow side with a sub-expander 23, and an electric generator 22 is connected to a drive shaft of the sub-expander 23.

A bypass circuit which bypasses the sub-expander 23 and the expander 6 is provided in parallel to the sub-expander 23 and the expander 6. The bypass circuit is provided with a sub-expander 21, and an electric generator 22 is connected to a drive shaft of the sub-expander 21. The bypass circuit is connected to the second four-way valve 4 like the sub-expander 23 and the expander 6.

Here, the electric generator 22 includes a clutch mechanism which is connected to one of the sub-expander 21 and the sub-expander 23. The bypass circuit is provided at its inflow side with a flow path valve 25.

A drive shaft of the expander 6 and a drive shaft of the compressor 1 are connected to each other, and the compressor 1 utilizes power recover by the expander 6 for driving.

The refrigerant circuit includes a first four-way valve 2 to which a discharge side pipe and a suction side pipe of the compressor 1 are connected, and a second four-way valve 4 to which a suction side pipe of the pre-sub-expander 23, a discharge side pipe of the expander 6 and the bypass circuit are connected.

The operation of the heat pump type cooling and heating air conditioner of this embodiment will be explained.

First, a cooling operation mode in which the outdoor heat exchanger 3 is used as a gas cooler and the indoor heat exchanger 8 is used as an evaporator will be explained. A flow of the refrigerant in the cooling operation mode is shown with solid arrows in the drawing.

Refrigerant at the time of the cooling operation mode is compressed at a high temperature and under a high pressure and is discharged by the compressor 1 which is driven by the motor 12. The refrigerant is introduced into the outdoor heat exchanger 3. In the outdoor heat exchanger 3, since $CO_2$ refrigerant is in a supercritical state, the refrigerant is not brought into two-phase state, and dissipates heat to outside fluid such as air and water. Then, the $CO_2$ refrigerant is introduced into the sub-expander 23 and the expander 6 is expanded by the sub-expander 23 and the expander 6. Power recover by the expander 6 at the time of expanding operation is used for driving the compressor 1. At that time, an optimal amount of refrigerant flowing into the expander 6 is calculated from a high pressure refrigerant temperature and a high pressure refrigerant pressure detected on the side of an outlet of the outdoor heat exchanger 3. If the volume flow rate is greater than the calculated optimal refrigerant amount, the flow path valve 25 is opened, the electric generator 22 is connected to the sub-expander 21 to allow refrigerant to flow into the bypass circuit, thereby reducing the volume flow rate of refrigerant flowing into the expander 6. In this case, the sub-expander 23 is not allowed to operate. It is preferable that torque of the electric generator 22 is adjusted to change the bypass amount. If the volume flow rate is smaller than the calculated optimal refrigerant amount, the flow path valve 25 is closed, the electric generator 22 is connected to the sub-expander 23, the high pressure side pressure is increased, and the volume flow rate of refrigerant flowing into the expander 6 is increased. In this case, the sub-expander 21 is not allowed to operate. It is preferable that torque of the electric generator 22 is adjusted to change the high pressure side pressure.

The $CO_2$ refrigerant expanded by the sub-expander 23 and the expander 6 or the $CO_2$ refrigerant expanded by the sub-expander 21 and the expander 6 is introduced into the indoor heat exchanger 8 through the second four-way valve 4 and is evaporated and suctions heat in the indoor heat exchanger 8. A room is cooled by this endotherm. The refrigerant which has been evaporated is drawn into the compressor 1.

Next, a heating operation mode in which the outdoor heat exchanger 3 is used as the evaporator and the indoor heat exchanger 8 is used as the gas cooler will be explained. A flow of a refrigerant in this heating operation mode is shown with dashed arrows in the drawing.

Refrigerant at the time of the heating operation mode is compressed at a high temperature and under a high pressure and is discharged by the compressor 1 which is driven by the motor 12. The refrigerant is introduced into the indoor heat exchanger 8 through the first four-way valve 2. In the indoor heat exchanger 8, since $CO_2$ refrigerant is in a supercritical state, the refrigerant is not brought into two-phase state, and dissipates heat to outside fluid such as air and water. A room is heated utilizing this radiation. Then, the $CO_2$ refrigerant is introduced into the sub-expander 23 and the expander 6, and is expanded by the sub-expander 23 and the expander 6. Power recover by the expander 6 at the time of expanding operation is used for driving the compressor 1. At that time, an optimal amount of refrigerant flowing into the expander 6 is calculated from a high pressure refrigerant temperature and a high pressure refrigerant pressure detected on the side of an outlet of the indoor heat exchanger 8. If the volume flow rate is greater than the calculated optimal refrigerant amount, the flow path valve 25 is opened, the electric generator 22 is connected to the sub-expander 21 to allow refrigerant to flow into the bypass circuit, thereby reducing the volume flow rate of refrigerant flowing into the expander 6. In this case, the sub-expander 23 is not allowed to operate. It is preferable that torque of the electric generator 22 is adjusted to change the bypass amount. If the volume flow rate is smaller than the calculated optimal refrigerant amount, the flow path valve 25 is closed, the electric generator 22 is connected to the sub-expander 23, the high pressure side pressure is increased, and the volume flow rate of refrigerant flowing into the expander 6 is increased. In this case, the sub-expander 21 is not allowed to operate. It is preferable that torque of the electric generator 22 is adjusted to change the high pressure side pressure.

The $CO_2$ refrigerant expanded by the sub-expander 23 and the expander 6 or the $CO_2$ refrigerant expanded by the sub-expander 21 and the expander 6 is introduced into the outdoor heat exchanger 3 through the second four-way valve 4 and is evaporated and suctions heat in the outdoor heat exchanger 3. The refrigerant which has been evaporated is drawn into the compressor 1 through the first four-way valve 2.

As described above, according to this embodiment, the open/close valve 25 is opened, the sub-expander 21 is connected to the electric generator 22, thereby adjusting the amount of refrigerant flowing through the bypass circuit, and it is possible to control the amount of refrigerant flowing into the expander 6. The open/close valve 25 is closed, torque of the electric generator 24 connected to the sub-expander 23 (load of the electric generator) is changed to adjust the high pressure side pressure, and it is possible to control the amount of refrigerant flowing into the expander 6. Therefore, it is possible to efficiently recover power in the expander 6. Power recover from the sub-expander 21 or the sub-expander 23 is utilized for generating electricity of the electric generators 22 and 24, and it is possible to recover more power from the refrigeration cycle.

A refrigeration cycle apparatus of another embodiment of the present invention will be explained with reference to the drawing.

Figure 20:
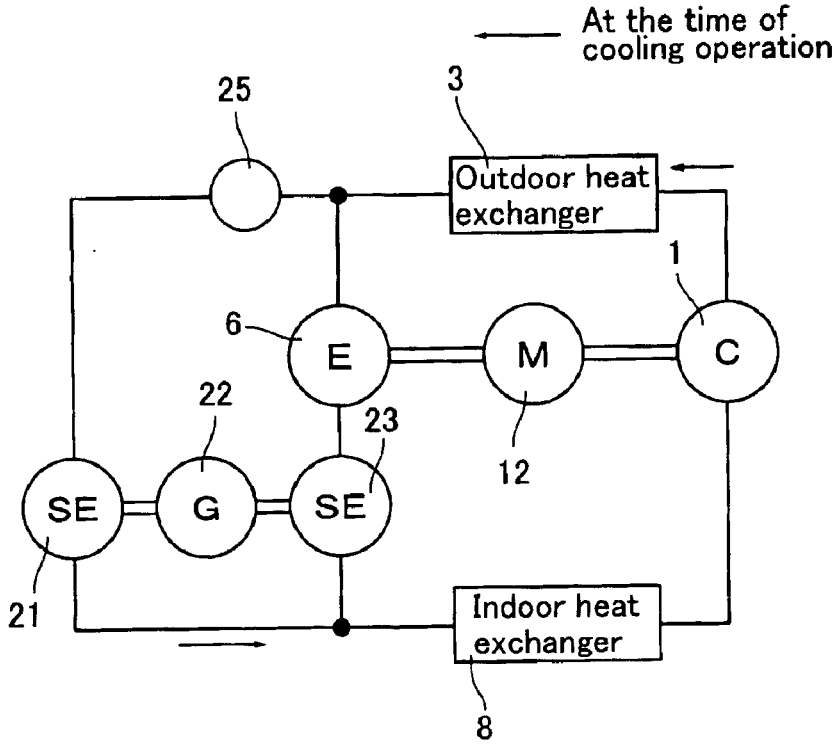
FIG. 20 shows a structure of a heat pump type air conditioner according to another embodiment of the invention.

FIG. 20 shows a structure of the heat pump type air conditioner of this embodiment.

As shown in FIG. 20, the heat pump type air conditioner of this embodiment uses a $CO_2$ refrigerant as a refrigerant, and comprises a refrigerant circuit in which a compressor 1 having a motor 12, an outdoor heat exchanger 3, an expander 6 and an indoor heat exchanger 8 are connected to one another through pipes.

The expander 6 is provided at its discharge side with a sub-expander 23, and an electric generator 22 is connected to a drive shaft of the sub-expander 23.

A bypass circuit which bypasses the sub-expander 23 and the expander 6 is provided in parallel to the sub-expander 23 and the expander 6. The bypass circuit is provided with a sub-expander 21, and an electric generator 22 is connected to a drive shaft of the sub-expander 21.

Here, the electric generator 22 includes a clutch mechanism which is connected to one of the sub-expander 21 and the sub-expander 23. The bypass circuit is provided at its inflow side with a flow path valve 25.

A drive shaft of the expander 6 and a drive shaft of the compressor 1 are connected to each other, and the compressor 1 utilizes power recover by the expander 6 for driving.

The operation of the heat pump type air conditioner of the embodiment will be explained below.

A refrigerant is compressed at a high temperature and under a high pressure and is discharged by the compressor 1 which is driven by the motor 12. The refrigerant is introduced into the outdoor heat exchanger 3. In the outdoor heat exchanger 3, since $CO_2$ refrigerant is in a supercritical state, the refrigerant is not brought into two-phase state, and dissipates heat to outside fluid such as air and water. Then, the $CO_2$ refrigerant is introduced into the expander 6 and the sub-expander 23 and is expanded by the expander 6 and the sub-expander 23. Power recover by the expander 6 at the time of expanding operation is used for driving the compressor 1. At that time, an optimal amount of refrigerant flowing into the expander 6 is calculated from a high pressure refrigerant temperature and a high pressure refrigerant pressure detected on the side of an outlet of the outdoor heat exchanger 3. If the volume flow rate is greater than the calculated optimal refrigerant amount, the flow path valve 25 is opened, the electric generator 22 is connected to the sub-expander 21 to allow refrigerant to flow into the bypass circuit, thereby reducing the volume flow rate of refrigerant flowing into the expander 6. In this case, the sub-expander 23 is not allowed to operate. It is preferable that torque of the electric generator 22 is adjusted to change the bypass amount. If the volume flow rate is smaller than the calculated optimal refrigerant amount, the flow path valve 25 is closed, the electric generator 22 is connected to the sub-expander 23, the low pressure side pressure is reduced, and the volume flow rate of refrigerant flowing into the expander 6 is increased. In this case, the sub-expander 21 is not allowed to operate. It is preferable that torque of the electric generator 22 is adjusted to change the low pressure side pressure.

The $CO_2$ refrigerant expanded by the sub-expander 23 and the expander 6 or the $CO_2$ refrigerant expanded by the sub-expander 21 and the expander 6 is evaporated and suctions heat in the indoor heat exchanger 8. A room is cooled by this endotherm. The refrigerant which has been evaporated is drawn into the compressor 1.

As described above, according to this embodiment, the open/close valve 25 is opened, the sub-expander 21 is connected to the electric generator 22, thereby adjusting the amount of refrigerant flowing through the bypass circuit, and it is possible to control the amount of refrigerant flowing into the expander 6. The open/close valve 25 is closed, torque of the electric generator 24 connected to the sub-expander 23 (load of the electric generator) is changed to adjust the low pressure side pressure, and it is possible to control the amount of refrigerant flowing into the expander 6. Therefore, it is possible to efficiently recover power in the expander 6. Power recover from the sub-expander 21 or the sub-expander 23 is utilized for generating electricity of the electric generators 22 and 24, and it is possible to recover more power from the refrigeration cycle.

A refrigeration cycle apparatus of another embodiment of the present invention will be explained with reference to the drawing.

Figure 21:
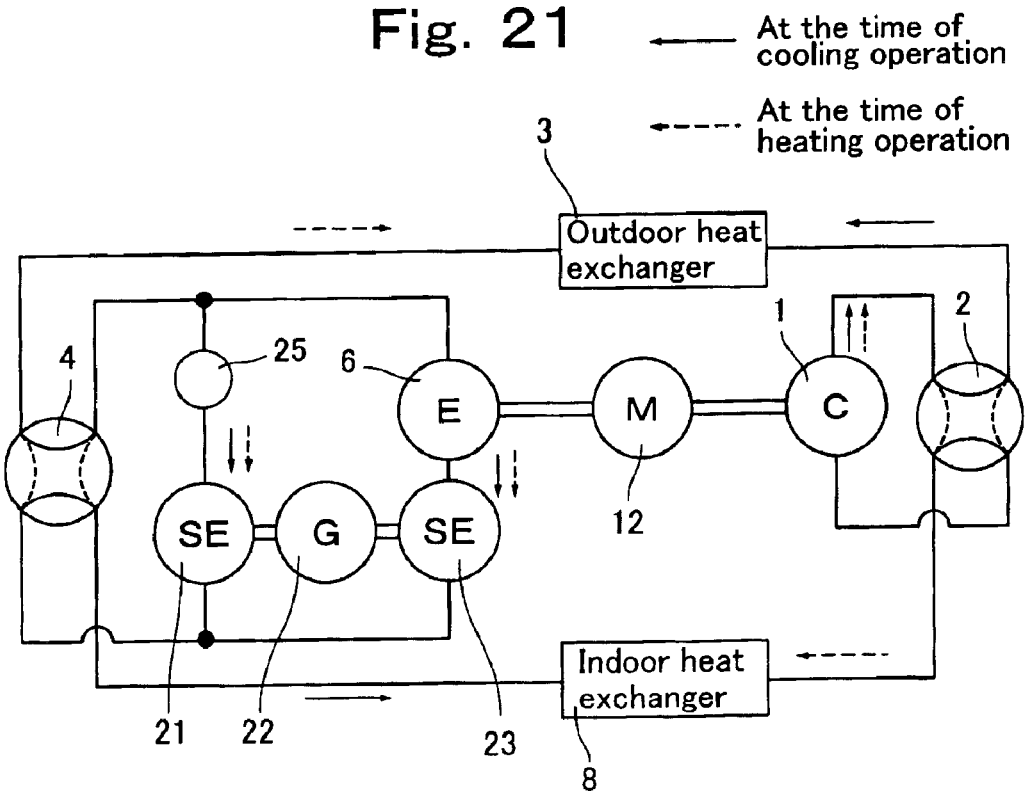
FIG. 21 shows a structure of a heat pump type cooling and heating air conditioner according to another embodiment of the invention.

FIG. 21 shows a structure of the heat pump type air conditioner of this embodiment.

As shown in FIG. 21, the heat pump type air conditioner of this embodiment uses a $CO_2$ refrigerant as a refrigerant, and comprises a refrigerant circuit in which a compressor 1 having a motor 12, an outdoor heat exchanger 3, an expander 6 and an indoor heat exchanger 8 are connected to one another through pipes.

The expander 6 is provided at its discharge side with a sub-expander 23, and an electric generator 22 is connected to a drive shaft of the sub-expander 23.

A bypass circuit which bypasses the sub-expander 23 and the expander 6 is provided in parallel to the sub-expander 23 and the expander 6. The bypass circuit is provided with a sub-expander 21, and an electric generator 22 is connected to a drive shaft of the sub-expander 21. The bypass circuit is connected to the second four-way valve 4 like the sub-expander 23 and the expander 6.

Here, the electric generator 22 includes a clutch mechanism which is connected to one of the sub-expander 21 and the sub-expander 23. The bypass circuit is provided at its inflow side with a flow path valve 25.

A drive shaft of the expander 6 and a drive shaft of the compressor 1 are connected to each other, and the compressor 1 utilizes power recover by the expander 6 for driving.

The refrigerant circuit includes a first four-way valve 2 to which a discharge side pipe and a suction side pipe of the compressor 1 are connected, and a second four-way valve 4 to which a discharge side pipe of the pre-sub-expander 23, a inflow side pipe of the expander 6 and the bypass circuit are connected.

The operation of the heat pump type cooling and heating air conditioner of this embodiment will be explained.

First, a cooling operation mode in which the outdoor heat exchanger 3 is used as a gas cooler and the indoor heat exchanger 8 is used as an evaporator will be explained. A flow of the refrigerant in the cooling operation mode is shown with solid arrows in the drawing.

Refrigerant at the time of the cooling operation mode is compressed at a high temperature and under a high pressure and is discharged by the compressor 1 which is driven by the motor 12. The refrigerant is introduced into the outdoor heat exchanger 3. In the outdoor heat exchanger 3, since $CO_2$ refrigerant is in a supercritical state, the refrigerant is not brought into two-phase state, and dissipates heat to outside fluid such as air and water. Then, the $CO_2$ refrigerant is introduced into the expander 6 and the sub-expander 23 is expanded by the expander 6 and the sub-expander 23. Power recover by the expander 6 at the time of expanding operation is used for driving the compressor 1. At that time, an optimal amount of refrigerant flowing into the expander 6 is calculated from a high pressure refrigerant temperature and a high pressure refrigerant pressure detected on the side of an outlet of the outdoor heat exchanger 3. If the volume flow rate is greater than the calculated optimal refrigerant amount, the flow path valve 25 is opened, the electric generator 22 is connected to the sub-expander 21 to allow refrigerant to flow into the bypass circuit, thereby reducing the volume flow rate of refrigerant flowing into the expander 6. In this case, the sub-expander 23 is not allowed to operate. It is preferable that torque of the electric generator 22 is adjusted to change the bypass amount. If the volume flow rate is smaller than the calculated optimal refrigerant amount, the flow path valve 25 is closed, the electric generator 22 is connected to the sub-expander 23, the low pressure side pressure is reduced, and the volume flow rate of refrigerant flowing into the expander 6 is increased. In this case, the sub-expander 21 is not allowed to operate. It is preferable that torque of the electric generator 22 is adjusted to change the low pressure side pressure.

The $CO_2$ refrigerant expanded by the sub-expander 23 and the expander 6 or the $CO_2$ refrigerant expanded by the sub-expander 21 and the expander 6 is introduced into the indoor heat exchanger 8 through the second four-way valve 4 and is evaporated and suctions heat in the indoor heat exchanger 8. A room is cooled by this endotherm. The refrigerant which has been evaporated is drawn into the compressor 1.

Next, a heating operation mode in which the outdoor heat exchanger 3 is used as the evaporator and the indoor heat exchanger 8 is used as the gas cooler will be explained. A flow of a refrigerant in this heating operation mode is shown with dashed arrows in the drawing.

Refrigerant at the time of the heating operation mode is compressed at a high temperature and under a high pressure and is discharged by the compressor 1 which is driven by the motor 12. The refrigerant is introduced into the indoor heat exchanger 8 through the first four-way valve 2. In the indoor heat exchanger 8, since $CO_2$ refrigerant is in a supercritical state, the refrigerant is not brought into two-phase state, and dissipates heat to outside fluid such as air and water. A room is heated utilizing this radiation. Then, the $CO_2$ refrigerant is introduced into the expander 6 and the sub-expander 23, and is expanded by the expander 6 and the sub-expander 23. Power recover by the expander 6 at the time of expanding operation is used for driving the compressor 1. At that time, an optimal amount of refrigerant flowing into the expander 6 is calculated from a high pressure refrigerant temperature and a high pressure refrigerant pressure detected on the side of an outlet of the indoor heat exchanger 8. If the volume flow rate is greater than the calculated optimal refrigerant amount, the flow path valve 25 is opened, the electric generator 22 is connected to the sub-expander 21 to allow refrigerant to flow into the bypass circuit, thereby reducing the volume flow rate of refrigerant flowing into the expander 6. In this case, the sub-expander 23 is not allowed to operate. It is preferable that torque of the electric generator 22 is adjusted to change the bypass amount. If the volume flow rate is smaller than the calculated optimal refrigerant amount, the flow path valve 25 is closed, the electric generator 22 is connected to the sub-expander 23, the low pressure side pressure is reduced, and the volume flow rate of refrigerant flowing into the expander 6 is increased. In this case, the sub-expander 21 is not allowed to operate. It is preferable that torque of the electric generator 22 is adjusted to change the low pressure side pressure.

The $CO_2$ refrigerant expanded by the sub-expander 23 and the expander 6 or the $CO_2$ refrigerant expanded by the sub-expander 21 and the expander 6 is introduced into the outdoor heat exchanger 3 through the second four-way valve 4 and is evaporated and suctions heat in the outdoor heat exchanger 3. The refrigerant which has been evaporated is drawn into the compressor 1 through the first four-way valve 2.

As described above, according to this embodiment, the open/close valve 25 is opened, the sub-expander 21 is connected to the electric generator 22, thereby adjusting the amount of refrigerant flowing through the bypass circuit, and it is possible to control the amount of refrigerant flowing into the expander 6. The open/close valve 25 is closed, torque of the electric generator 22 connected to the sub-expander 23 (load of the electric generator) is changed to adjust the low pressure side pressure, and it is possible to control the amount of refrigerant flowing into the expander 6. Therefore, it is possible to efficiently recover power in the expander 6. Power recover from the sub-expander 21 or the sub-expander 23 is utilized for generating electricity of the electric generator 22, and it is possible to recover more power from the refrigeration cycle.

A refrigeration cycle apparatus of another embodiment of the present invention will be explained with reference to the drawing.

Figure 22:
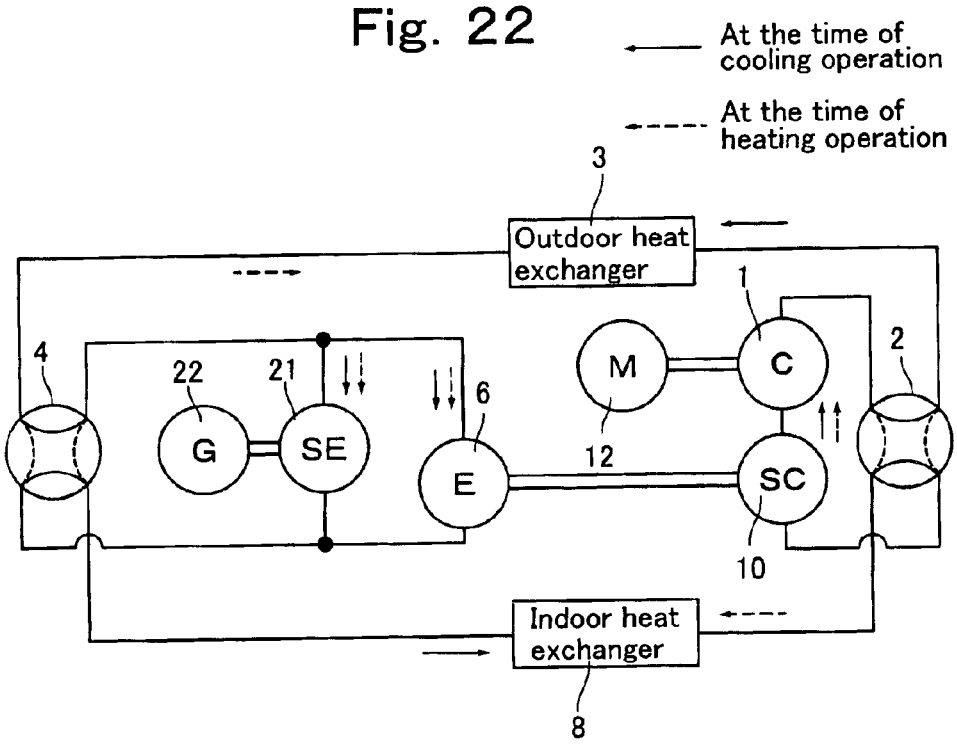
FIG. 22 shows a structure of a heat pump type cooling and heating air conditioner according to another embodiment of the invention.

FIG. 22 shows a structure of the heat pump type air conditioner of this embodiment.

As shown in FIG. 22, the heat pump type air conditioner of this embodiment uses a $CO_2$ refrigerant as a refrigerant, and comprises a refrigerant circuit in which a compressor 1 having a motor 12, an outdoor heat exchanger 3, an expander 6, an indoor heat exchanger 8 and an auxiliary compressor 10 are connected to one another through pipes.

The refrigerant circuit includes a first four-way valve 2 to which a discharge side pipe of the compressor 1 and a suction side pipe of the auxiliary compressor 10 are connected, and a second four-way valve 4 to which a discharge side pipe and a suction side pipe of heat exchanger expander 6 are connected A bypass circuit for bypassing the expander 6 is provided in parallel to the expander 6. The bypass circuit is provided with a sub-expander 21. An electric generator 22 is connected to a drive shaft of the sub-expander 21. The bypass circuit is connected to the second four-way valve 4 like the expander 6.

The drive shaft of the expander 6 and a drive shaft of the auxiliary compressor 10 are connected to each other, and the auxiliary compressor 10 is driven by power recover by the expander 6.

The operation of the heat pump type cooling and heating air conditioner of this embodiment will be explained.

First, a cooling operation mode in which the outdoor heat exchanger 3 is used as a gas cooler and the indoor heat exchanger 8 is used as an evaporator will be explained. A flow of the refrigerant in the cooling operation mode is shown with solid arrows in the drawing.

Refrigerant at the time of the cooling operation mode is compressed at a high temperature and under a high pressure and is discharged by the compressor 1 which is driven by the motor 12. The refrigerant is introduced into the outdoor heat exchanger 3. In the outdoor heat exchanger 3, since $CO_2$ refrigerant is in a supercritical state, the refrigerant is not brought into two-phase state, and dissipates heat to outside fluid such as air and water. Then, the $CO_2$ refrigerant is introduced into the expander 6 and the sub-expander 21 through the second four-way valve 4 and is expanded by the expander 6 and the sub-expander 21. Power recover by the expander 6 at the time of expanding operation is used for driving the auxiliary compressor 10. At that time, an optimal amount of refrigerant flowing into the expander 6 is calculated from a high pressure refrigerant temperature and a high pressure refrigerant pressure detected on the side of an outlet of the outdoor heat exchanger 3. If the volume flow rate is greater than the calculated optimal refrigerant amount, torque of the electric generator 22 (load of the electric generator) is reduced to increase the amount of refrigerant which is allowed to flow into the bypass circuit, thereby reducing the volume flow rate of refrigerant flowing into the expander 6. If the optimal amount of refrigerant flowing into the expander 6 is smaller than the calculated optimal refrigerant amount, torque of the electric generator 22 (load of the electric generator) is increased to reduce the amount of refrigerant which is allowed to flow into the bypass circuit, thereby increasing the volume flow rate of refrigerant flowing into the expander 6.

The $CO_2$ refrigerant expanded by the sub-expander 21 and the expander 6 is introduced into the indoor heat exchanger 8 through the second four-way valve 4 and is evaporated and suctions heat in the indoor heat exchanger 8. A room is cooled by this endotherm. The refrigerant which has been evaporated is drawn into the auxiliary compressor 10 through the first four-way valve 2, supercharged by the auxiliary compressor 10 and is drawn into the compressor 1.

Next, a heating operation mode in which the outdoor heat exchanger 3 is used as the evaporator and the indoor heat exchanger 8 is used as the gas cooler will be explained. A flow of a refrigerant in this heating operation mode is shown with dashed arrows in the drawing.

Refrigerant at the time of the heating operation mode is compressed at a high temperature and under a high pressure and is discharged by the compressor 1 which is driven by the motor 12. The refrigerant is introduced into the indoor heat exchanger 8 through the first four-way valve 2. In the indoor heat exchanger 8, since $CO_2$ refrigerant is in a supercritical state, the refrigerant is not brought into two-phase state, and dissipates heat to outside fluid such as air and water. A room is heated utilizing this radiation. Then, the $CO_2$ refrigerant is introduced into the expander 6 and the sub-expander 21 through the second four-way valve 4 and is expanded by the expander 6 and the sub-expander 21. Power recover by the expander 6 at the time of expanding operation is used for driving the auxiliary compressor 10. At that time, an optimal amount of refrigerant flowing into the expander 6 is calculated from a high pressure refrigerant temperature and a high pressure refrigerant pressure detected on the side of an outlet of the outdoor heat exchanger 3. If the volume flow rate is greater than the calculated optimal refrigerant amount, torque of the electric generator 22 (load of the electric generator) is reduced to increase the amount of refrigerant which is allowed to flow into the bypass circuit, thereby reducing the volume flow rate of refrigerant flowing into the expander 6. If the optimal amount of refrigerant flowing into the expander 6 is smaller than the calculated optimal refrigerant amount, torque of the electric generator 22 (load of the electric generator) is increased to reduce the amount of refrigerant which is allowed to flow into the bypass circuit, thereby increasing the volume flow rate of refrigerant flowing into the expander 6.

The $CO_2$ refrigerant expanded by the expander 6 and the sub-expander 21 is introduced into the outdoor heat exchanger 3 through the second four-way valve 4 and is evaporated and suctions heat in the outdoor heat exchanger 3. The refrigerant which has been evaporated is introduced into the auxiliary compressor 10 through the first four-way valve 2, supercharged by the auxiliary compressor 10 and is drawn into the compressor 1.

As described above, according to this embodiment, the torque of the electric generator 22 (i.e., load of the electric generator) connected to the sub-expander 21 is changed to adjust the amount of refrigerant flowing through the bypass circuit, thereby controlling the amount of refrigerant flowing through the expander 6. Therefore, it is possible to efficiently recover power in the expander 6. During the control of the flow rate of refrigerant through the bypass system, power recover from the sub-expander 21 is utilized for generating electricity of the electric generator 22, and it is possible to recover more power from the refrigeration cycle.

A refrigeration cycle apparatus of another embodiment of the present invention will be explained with reference to the drawing.

Figure 23:
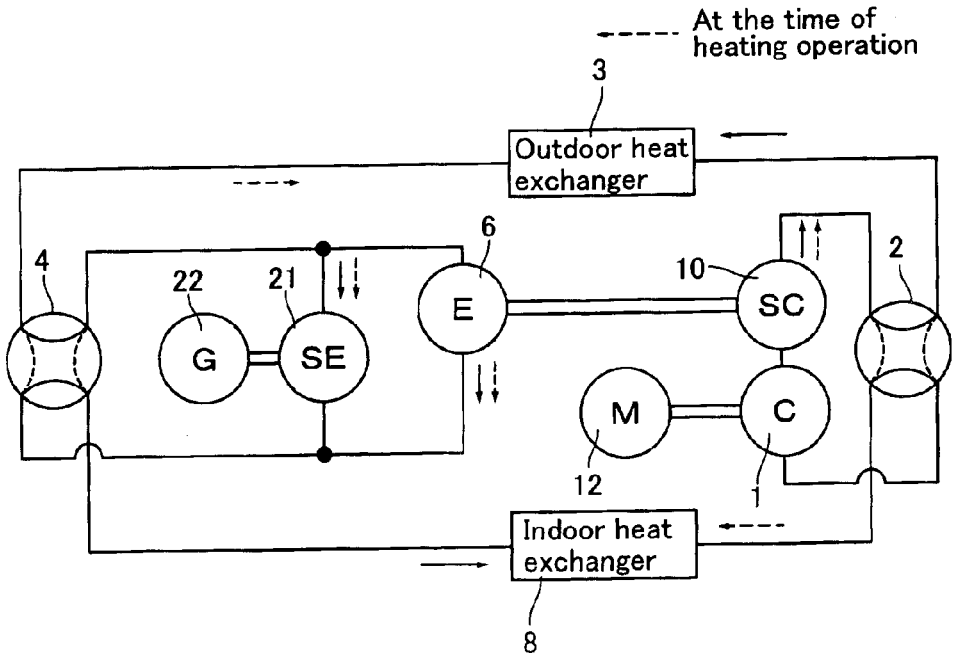
FIG. 23 shows a structure of a heat pump type cooling and heating air conditioner according to another embodiment of the invention.

FIG. 23 shows a structure of the heat pump type air conditioner of this embodiment.

As shown in FIG. 23, the heat pump type air conditioner of this embodiment uses a $CO_2$ refrigerant as a refrigerant, and comprises a refrigerant circuit in which a compressor 1 having a motor 12, an auxiliary compressor 10, an outdoor heat exchanger 3, an expander 6 and an indoor heat exchanger 8 are connected to one another through pipes.

The refrigerant circuit includes a first four-way valve 2 to which a suction side pipe of the compressor 1 and a discharge side pipe of the auxiliary compressor 10 are connected, and a second four-way valve 4 to which a discharge side pipe and a suction side pipe of heat exchanger expander 6 are connected A bypass circuit for bypassing the expander 6 is provided in parallel to the expander 6. The bypass circuit is provided with a sub-expander 21. An electric generator 22 is connected to a drive shaft of the sub-expander 21. The bypass circuit is connected to the second four-way valve 4 like the expander 6.

The drive shaft of the expander 6 and a drive shaft of the auxiliary compressor 10 are connected to each other, and the auxiliary compressor 10 is driven by power recover by the expander 6.

The operation of the heat pump type cooling and heating air conditioner of this embodiment will be explained.

First, a cooling operation mode in which the outdoor heat exchanger 3 is used as a gas cooler and the indoor heat exchanger 8 is used as an evaporator will be explained. A flow of the refrigerant in the cooling operation mode is shown with solid arrows in the drawing.

Refrigerant at the time of the cooling operation mode is compressed at a high temperature and under a high pressure and is discharged by the compressor 1 which is driven by the motor 12, and is introduced into the auxiliary compressor 10. The refrigerant is further super-pressurized by the auxiliary compressor 10 and then, introduced into the outdoor heat exchanger 3 through the first four-way valve 2. In the outdoor heat exchanger 3, since $CO_2$ refrigerant is in a supercritical state, the refrigerant is not brought into two-phase state, and dissipates heat to outside fluid such as air and water. Then, the $CO_2$ refrigerant is introduced into the expander 6 and the sub-expander 21 through the second four-way valve 4 and is expanded by the expander 6 and the sub-expander 21. Power recover by the expander 6 at the time of expanding operation is used for driving the auxiliary compressor 10. At that time, an optimal amount of refrigerant flowing into the expander 6 is calculated from a high pressure refrigerant temperature and a high pressure refrigerant pressure detected on the side of an outlet of the outdoor heat exchanger 3. If the volume flow rate is greater than the calculated optimal refrigerant amount, torque of the electric generator 22 (load of the electric generator) is reduced to increase the amount of refrigerant which is allowed to flow into the bypass circuit, thereby reducing the volume flow rate of refrigerant flowing into the expander 6. If the optimal amount of refrigerant flowing into the expander 6 is smaller than the calculated optimal refrigerant amount, torque of the electric generator 22 (load of the electric generator) is increased to reduce the amount of refrigerant which is allowed to flow into the bypass circuit, thereby increasing the volume flow rate of refrigerant flowing into the expander 6.

The $CO_2$ refrigerant expanded by the sub-expander 21 and the expander 6 is introduced into the indoor heat exchanger 8 through the second four-way valve 4 and is evaporated and suctions heat in the indoor heat exchanger 8. A room is cooled by this endotherm. The refrigerant which has been evaporated is drawn into the auxiliary compressor 10 through the first four-way valve 2.

Next, a heating operation mode in which the outdoor heat exchanger 3 is used as the evaporator and the indoor heat exchanger 8 is used as the gas cooler will be explained. A flow of a refrigerant in this heating operation mode is shown with dashed arrows in the drawing.

Refrigerant at the time of the heating operation mode is compressed at a high temperature and under a high pressure and is discharged by the compressor 1 which is driven by the motor 12, and is introduced into the auxiliary compressor 10. The refrigerant is further super-pressurized by the auxiliary compressor 10 and then, introduced into the indoor heat exchanger 8 through the first four-way valve 2. In the indoor heat exchanger 8, since $CO_2$ refrigerant is in a supercritical state, the refrigerant is not brought into two-phase state, and dissipates heat to outside fluid such as air and water and a room is heated by this endotherm. Then, the $CO_2$ refrigerant is introduced into the expander 6 and the sub-expander 21 through the second four-way valve 4 and is expanded by the expander 6 and the sub-expander 21. Power recover by the expander 6 at the time of expanding operation is used for driving the auxiliary compressor 10. At that time, an optimal amount of refrigerant flowing into the expander 6 is calculated from a high pressure refrigerant temperature and a high pressure refrigerant pressure detected on the side of an outlet of the outdoor heat exchanger 3. If the volume flow rate is greater than the calculated optimal refrigerant amount, torque of the electric generator 22 (load of the electric generator) is reduced to increase the amount of refrigerant which is allowed to flow into the bypass circuit, thereby reducing the volume flow rate of refrigerant flowing into the expander 6. If the optimal amount of refrigerant flowing into the expander 6 is smaller than the calculated optimal refrigerant amount, torque of the electric generator 22 (load of the electric generator) is increased to reduce the amount of refrigerant which is allowed to flow into the bypass circuit, thereby increasing the volume flow rate of refrigerant flowing into the expander 6.

The $CO_2$ refrigerant expanded by the expander 6 and the sub-expander 21 is introduced into the outdoor heat exchanger 3 through the second four-way valve 4 and is evaporated and suctions heat in the outdoor heat exchanger 3. The refrigerant which has been evaporated is drawn into the compressor 1 through the first four-way valve 2.

As described above, according to this embodiment, the torque of the electric generator 22 (i.e., load of the electric generator) connected to the sub-expander 21 is changed to adjust the amount of refrigerant flowing through the bypass circuit, thereby controlling the amount of refrigerant flowing through the expander 6. Therefore, it is possible to efficiently recover power in the expander 6. During the control of the flow rate of refrigerant through the bypass system, power recover from the sub-expander 21 is utilized for generating electricity of the electric generator 22, and it is possible to recover more power from the refrigeration cycle.

A refrigeration cycle apparatus of another embodiment of the present invention will be explained with reference to the drawing.

Figure 24:
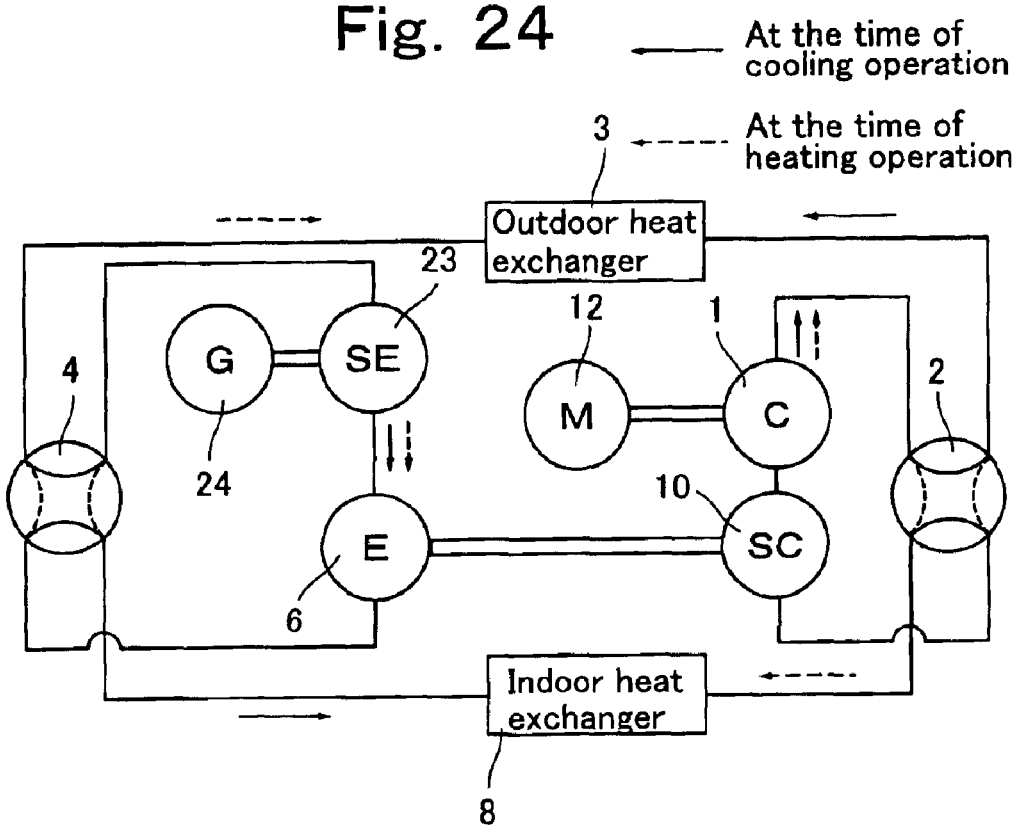
FIG. 24 shows a structure of a heat pump type cooling and heating air conditioner according to another embodiment of the invention.

FIG. 24 shows a structure of the heat pump type air conditioner of this embodiment.

As shown in FIG. 24, the heat pump type air conditioner of this embodiment uses a $CO_2$ refrigerant as a refrigerant, and comprises a refrigerant circuit in which a compressor 1 having a motor 12, an outdoor heat exchanger 3, an expander 6, an indoor heat exchanger 8 and an auxiliary compressor 10 are connected to one another through pipes.

The expander 6 is provided at its inflow side with a sub-expander 23, and an electric generator 24 is connected to a drive shaft of the sub-expander 23.

A drive shaft of the expander 6 and a drive shaft of the auxiliary compressor 10 are connected to each other, and the auxiliary compressor 10 is driven by power recover by the expander 6.

The refrigerant circuit includes a first four-way valve 2 to which a discharge side pipe of the compressor 1 and a suction side pipe of the auxiliary compressor 10 are connected, and a second four-way valve 4 to which a suction side pipe of the sub-expander 23 and a discharge side pipe of the expander 6 are connected.

The operation of the heat pump type cooling and heating air conditioner of this embodiment will be explained.

First, a cooling operation mode in which the outdoor heat exchanger 3 is used as a gas cooler and the indoor heat exchanger 8 is used as an evaporator will be explained. A flow of the refrigerant in the cooling operation mode is shown with solid arrows in the drawing.

Refrigerant at the time of the cooling operation mode is compressed at a high temperature and under a high pressure and is discharged by the compressor 1 which is driven by the motor 12. The refrigerant is introduced into the outdoor heat exchanger 3. In the outdoor heat exchanger 3, since $CO_2$ refrigerant is in a supercritical state, the refrigerant is not brought into two-phase state, and dissipates heat to outside fluid such as air and water. Then, the $CO_2$ refrigerant is introduced into the sub-expander 23 and the expander 6 through the second four-way valve 4 and is expanded by the sub-expander 23 and the expander 6. Power recover by the expander 6 at the time of expanding operation is used for driving the auxiliary compressor 10. At that time, an optimal amount of refrigerant flowing into the expander 6 is calculated from a high pressure refrigerant temperature and a high pressure refrigerant pressure detected on the side of an outlet of the outdoor heat exchanger 3. If the volume flow rate is smaller than the calculated optimal refrigerant amount, torque of the electric generator 24 (load of the electric generator) is increased to increase the high pressure side pressure, thereby increasing the volume flow rate of refrigerant flowing into the expander 6. If the optimal amount of refrigerant flowing into the expander 6 is greater than the calculated optimal refrigerant amount, torque of the electric generator 24 (load of the electric generator) is reduced to reduce the high pressure side pressure, thereby reducing the volume flow rate of refrigerant flowing into the expander 6.

The $CO_2$ refrigerant expanded by the sub-expander 23 and the expander 6 is introduced into the indoor heat exchanger 8 through the second four-way valve 4 and is evaporated and suctions heat in the indoor heat exchanger 8. A room is cooled by this endotherm. The refrigerant which has been evaporated is introduced into the auxiliary compressor 10 through the first four-way valve 2 and is supercharged by the auxiliary compressor 10 and is drawn into the compressor 1.

Next, a heating operation mode in which the outdoor heat exchanger 3 is used as the evaporator and the indoor heat exchanger 8 is used as the gas cooler will be explained. A flow of a refrigerant in this heating operation mode is shown with dashed arrows in the drawing.

Refrigerant at the time of the heating operation mode is compressed at a high temperature and under a high pressure and is discharged by the compressor 1 which is driven by the motor 12, and is introduced into the indoor heat exchanger 8 through the first four-way valve 2. In the indoor heat exchanger 8, since $CO_2$ refrigerant is in a supercritical state, the refrigerant is not brought into two-phase state, and dissipates heat to outside fluid such as air and water and a room is heated by this endotherm. Then, the $CO_2$ refrigerant is introduced into the sub-expander 23 and the expander 6 through the second four-way valve 4 and is expanded by the sub-expander 23 and the expander 6. Power recover by the expander 6 at the time of expanding operation is used for driving the auxiliary compressor 10. At that time, an optimal amount of refrigerant flowing into the expander 6 is calculated from a high pressure refrigerant temperature and a high pressure refrigerant pressure detected on the side of an outlet of the outdoor heat exchanger 3. If the volume flow rate is smaller than the calculated optimal refrigerant amount, torque of the electric generator 24 (load of the electric generator) is increased to increase the high pressure side pressure, thereby increasing the volume flow rate of refrigerant flowing into the expander 6. If the optimal amount of refrigerant flowing into the expander 6 is greater than the calculated optimal refrigerant amount, torque of the electric generator 24 (load of the electric generator) is reduced to reduce the high pressure side pressure, thereby reducing the volume flow rate of refrigerant flowing into the expander 6.

The $CO_2$ refrigerant expanded by the expansion sub-expander 23 and the expander 6 is evaporated and suctions heat in the outdoor heat exchanger 3. The refrigerant which has been evaporated is introduced into the auxiliary compressor 10 through the first four-way valve 2 and supercharged by the auxiliary compressor 10 and drawn into the compressor 1.

As described above, according to this embodiment, the torque of the electric generator 24 (i.e., load of the electric generator) connected to the sub-expander 23 is changed to adjust the high pressure side pressure, thereby controlling the amount of refrigerant flowing through the expander 6. Therefore, it is possible to efficiently recover power in the expander 6. Power recover from the sub-expander 23 is utilized for generating electricity of the electric generator 24, and it is possible to recover more power from the refrigeration cycle.

A refrigeration cycle apparatus of another embodiment of the present invention will be explained with reference to the drawing.

Figure 25:
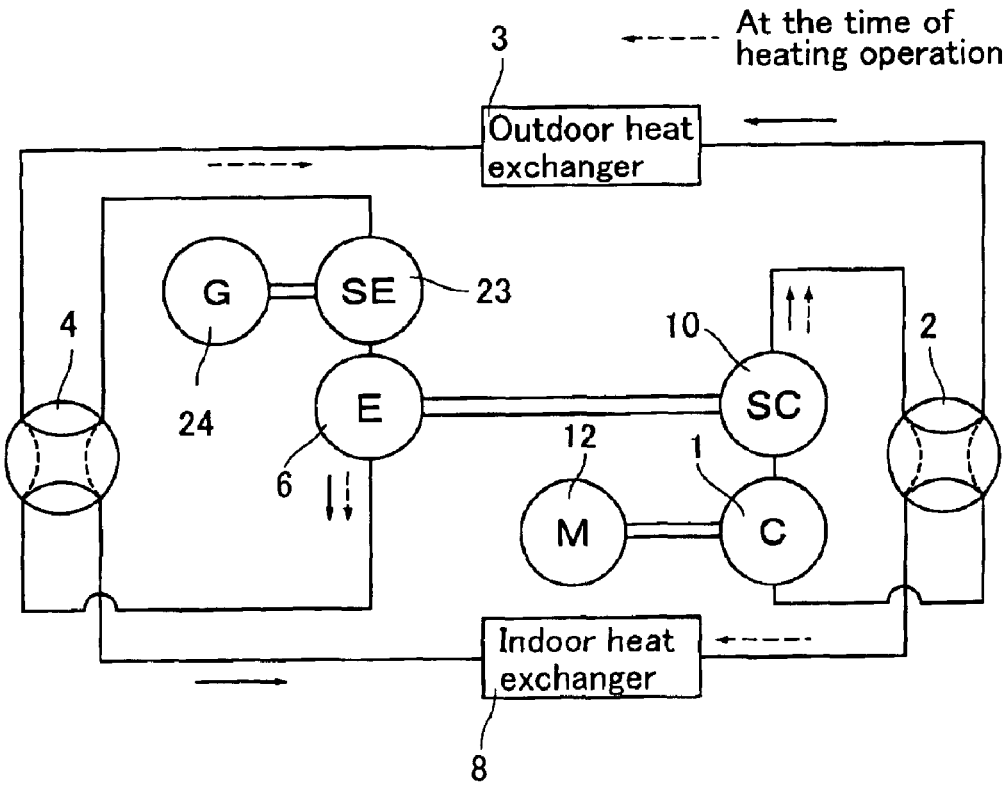
FIG. 25 shows a structure of a heat pump type cooling and heating air conditioner according to another embodiment of the invention.

FIG. 25 shows a structure of the heat pump type air conditioner of this embodiment.

As shown in FIG. 25, the heat pump type air conditioner of this embodiment uses a $CO_2$ refrigerant as a refrigerant, and comprises a refrigerant circuit in which a compressor 1 having a motor 12, an auxiliary compressor 10, an outdoor heat exchanger 3, an expander 6 and an indoor heat exchanger 8 are connected to one another through pipes.

The expander 6 is provided at its inflow side with a sub-expander 23, and an electric generator 24 is connected to a drive shaft of the sub-expander 23.

A drive shaft of the expander 6 and a drive shaft of the auxiliary compressor 10 are connected to each other, and the auxiliary compressor 10 is driven by power recover by the expander 6.

The refrigerant circuit includes a first four-way valve 2 to which a suction side pipe of the compressor 1 and a discharge side pipe of the auxiliary compressor 10 are connected, and a second four-way valve 4 to which a suction side pipe of the sub-expander 23 and a discharge side pipe of the expander 6 are connected.

The operation of the heat pump type cooling and heating air conditioner of this embodiment will be explained.

First, a cooling operation mode in which the outdoor heat exchanger 3 is used as a gas cooler and the indoor heat exchanger 8 is used as an evaporator will be explained. A flow of the refrigerant in the cooling operation mode is shown with solid arrows in the drawing.

Refrigerant at the time of the cooling operation mode is compressed at a high temperature and under a high pressure and is discharged by the compressor 1 which is driven by the motor 12, and is introduced into the auxiliary compressor 10 and further super-pressurized by the auxiliary compressor 10 and then introduced into the outdoor heat exchanger 3 through the first four-way valve 2. In the outdoor heat exchanger 3, since $CO_2$ refrigerant is in a supercritical state, the refrigerant is not brought into two-phase state, and dissipates heat to outside fluid such as air and water. Then, the $CO_2$ refrigerant is introduced into the sub-expander 21 and the expander 6 through the second four-way valve 4 and is expanded by the sub-expander 23 and the expander 6. Power recover by the expander 6 at the time of expanding operation is used for driving the auxiliary compressor 10. At that time, an optimal amount of refrigerant flowing into the expander 6 is calculated from a high pressure refrigerant temperature and a high pressure refrigerant pressure detected on the side of an outlet of the outdoor heat exchanger 3. If the volume flow rate is smaller than the calculated optimal refrigerant amount, torque of the electric generator 24 (load of the electric generator) is increased to increase the high pressure side pressure, thereby increasing the volume flow rate of refrigerant flowing into the expander 6. If the optimal amount of refrigerant flowing into the expander 6 is greater than the calculated optimal refrigerant amount, torque of the electric generator 24 (load of the electric generator) is reduced to reduce the high pressure side pressure, thereby reducing the volume flow rate of refrigerant flowing into the expander 6.

The $CO_2$ refrigerant expanded by the sub-expander 23 and the expander 6 is introduced into the indoor heat exchanger 8 through the second four-way valve 4 and is evaporated in the indoor heat exchanger 8. A room is cooled by this endotherm. The refrigerant which has been evaporated is drawn into the compressor 1 through the first four-way valve 2.

Next, a heating operation mode in which the outdoor heat exchanger 3 is used as the evaporator and the indoor heat exchanger 8 is used as the gas cooler will be explained. A flow of a refrigerant in this heating operation mode is shown with dashed arrows in the drawing.

Refrigerant at the time of the heating operation mode is compressed at a high temperature and under a high pressure and is discharged by the compressor 1 which is driven by the motor 12, and is introduced into the auxiliary compressor 10 and further super-pressurized by the auxiliary compressor 10 and then introduced into the indoor heat exchanger 8 through the first four-way valve 2. In the indoor heat exchanger 8, since $CO_2$ refrigerant is in a supercritical state, the refrigerant is not brought into two-phase state, and dissipates heat to outside fluid such as air and water. A room is heated by this endotherm. Then, the $CO_2$ refrigerant is introduced into the sub-expander 23 and the expander 6 through the second four-way valve 4 and is expanded by the sub-expander 23 and the expander 6. Power recover by the expander 6 at the time of expanding operation is used for driving the auxiliary compressor 10. At that time, an optimal amount of refrigerant flowing into the expander 6 is calculated from a high pressure refrigerant temperature and a high pressure refrigerant pressure detected on the side of an outlet of the outdoor heat exchanger 3. If the volume flow rate is smaller than the calculated optimal refrigerant amount, torque of the electric generator 24 (load of the electric generator) is increased to increase the high pressure side pressure, thereby increasing the volume flow rate of refrigerant flowing into the expander 6. If the optimal amount of refrigerant flowing into the expander 6 is greater than the calculated optimal refrigerant amount, torque of the electric generator 24 (load of the electric generator) is reduced to reduce the high pressure side pressure, thereby reducing the volume flow rate of refrigerant flowing into the expander 6.

The $CO_2$ refrigerant expanded by the sub-expander 23 and the expander 6 is evaporated and suctions heat in the outdoor heat exchanger 3. The refrigerant which has been evaporated is drawn into the compressor 1 through the first four-way valve 2.

As described above, according to this embodiment, the torque of the electric generator 24 (i.e., load of the electric generator) connected to the sub-expander 23 is changed to adjust the high pressure side pressure, thereby controlling the amount of refrigerant flowing through the expander 6. Therefore, it is possible to efficiently recover power in the expander 6. Power recover from the sub-expander 23 is utilized for generating electricity of the electric generator 24, and it is possible to recover more power from the refrigeration cycle.

A refrigeration cycle apparatus of another embodiment of the present invention will be explained with reference to the drawing.

Figure 26:
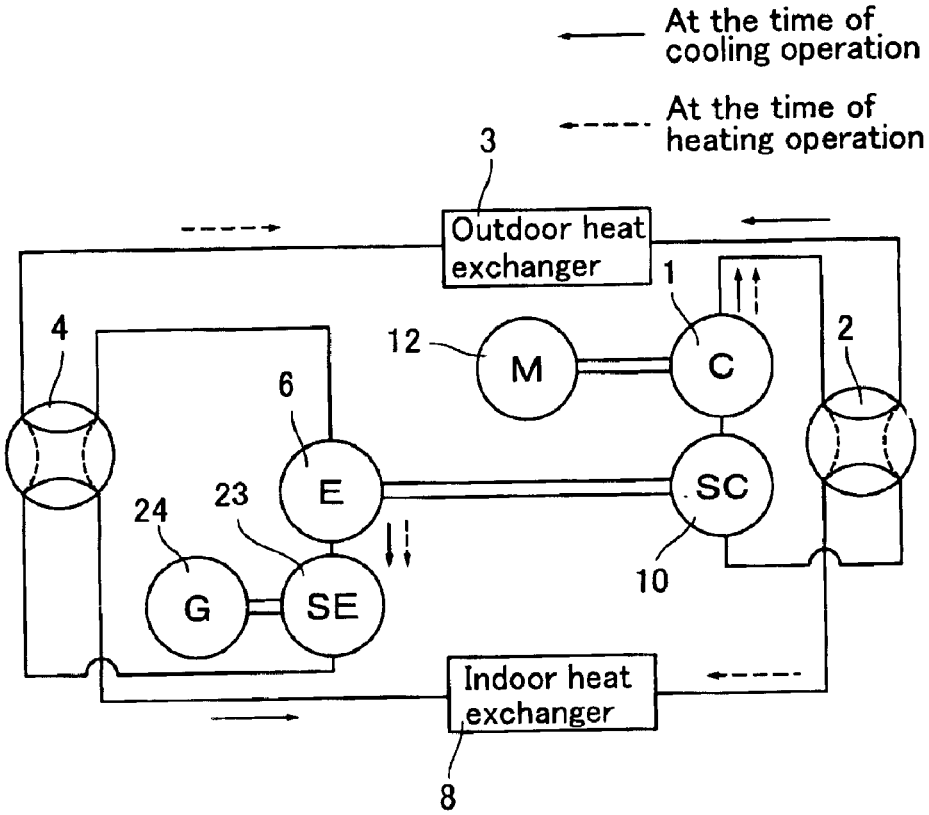
FIG. 26 shows a structure of a heat pump type cooling and heating air conditioner according to another embodiment of the invention.

FIG. 26 shows a structure of the heat pump type air conditioner of this embodiment.

As shown in FIG. 26, the heat pump type air conditioner of this embodiment uses a $CO_2$ refrigerant as a refrigerant, and comprises a refrigerant circuit in which a compressor 1 having a motor 12, an outdoor heat exchanger 3, an expander 6, an indoor heat exchanger 8 and an auxiliary compressor 10 are connected to one another through pipes.

The expander 6 is provided at its discharge side with a sub-expander 23, and an electric generator 24 is connected to a drive shaft of the sub-expander 23.

A drive shaft of the expander 6 and a drive shaft of the auxiliary compressor 10 are connected to each other, and the auxiliary compressor 10 is driven by power recover by the expander 6.

The refrigerant circuit includes a first four-way valve 2 to which a discharge side pipe of the compressor 1 and a suction side pipe of the auxiliary compressor 10 are connected, and a second four-way valve 4 to which a discharge side pipe of the sub-expander 23 and a suction side pipe of the expander 6 are connected.

The operation of the heat pump type cooling and heating air conditioner of this embodiment will be explained.

First, a cooling operation mode in which the outdoor heat exchanger 3 is used as a gas cooler and the indoor heat exchanger 8 is used as an evaporator will be explained. A flow of the refrigerant in the cooling operation mode is shown with solid arrows in the drawing.

Refrigerant at the time of the cooling operation mode is compressed at a high temperature and under a high pressure and is discharged by the compressor 1 which is driven by the motor 12. The refrigerant is introduced into the outdoor heat exchanger 3. In the outdoor heat exchanger 3, since $CO_2$ refrigerant is in a supercritical state, the refrigerant is not brought into two-phase state, and dissipates heat to outside fluid such as air and water. Then, the $CO_2$ refrigerant is introduced into the expander 6 and the sub-expander 23 through the second four-way valve 4 and is expanded by the expander 6 and the sub-expander 23. Power recover by the expander 6 at the time of expanding operation is used for driving the auxiliary compressor 10. At that time, an optimal amount of refrigerant flowing into the expander 6 is calculated from a high pressure refrigerant temperature and a high pressure refrigerant pressure detected on the side of an outlet of the outdoor heat exchanger 3. If the volume flow rate is smaller than the calculated optimal refrigerant amount, torque of the electric generator 22 (load of the electric generator) is increased to reduce the low pressure side pressure, thereby increasing the volume flow rate of refrigerant flowing into the expander 6. If the optimal amount of refrigerant flowing into the expander 6 is greater than the calculated optimal refrigerant amount, torque of the electric generator 22 (load of the electric generator) is reduced to increase the low pressure side pressure, thereby reducing the volume flow rate of refrigerant flowing into the expander 6.

The $CO_2$ refrigerant expanded by the sub-expander 23 and the expander 6 is introduced into the indoor heat exchanger 8 through the second four-way valve 4 and is evaporated and suctions heat in the indoor heat exchanger 8. A room is cooled by this endotherm. The refrigerant which has been evaporated is introduced into the auxiliary compressor 10 through the first four-way valve 2 and is supercharged by the auxiliary compressor 10 and is drawn into the compressor 1.

Next, a heating operation mode in which the outdoor heat exchanger 3 is used as the evaporator and the indoor heat exchanger 8 is used as the gas cooler will be explained. A flow of a refrigerant in this heating operation mode is shown with dashed arrows in the drawing.

Refrigerant at the time of the heating operation mode is compressed at a high temperature and under a high pressure and is discharged by the compressor 1 which is driven by the motor 12, and is introduced into the indoor heat exchanger 8 through the first four-way valve 2. In the indoor heat exchanger 8, since $CO_2$ refrigerant is in a supercritical state, the refrigerant is not brought into two-phase state, and dissipates heat to outside fluid such as air and water and a room is heated by this endotherm. Then, the $CO_2$ refrigerant is introduced into the expander 6 and the sub-expander 23 through the second four-way valve 4 and is expanded by the expander 6 and the sub-expander 23. Power recover by the expander 6 at the time of expanding operation is used for driving the auxiliary compressor 10. At that time, an optimal amount of refrigerant flowing into the expander 6 is calculated from a high pressure refrigerant temperature and a high pressure refrigerant pressure detected on the side of an outlet of the outdoor heat exchanger 3. If the volume flow rate is smaller than the calculated optimal refrigerant amount, torque of the electric generator 22 (load of the electric generator) is increased to reduce the low pressure side pressure, thereby increasing the volume flow rate of refrigerant flowing into the expander 6. If the optimal amount of refrigerant flowing into the expander 6 is greater than the calculated optimal refrigerant amount, torque of the electric generator 22 (load of the electric generator) is reduced to increase the low pressure side pressure, thereby reducing the volume flow rate of refrigerant flowing into the expander 6.

The $CO_2$ refrigerant expanded by the expander 6 and the sub-expander 23 is evaporated and suctions heat in the outdoor heat exchanger 3. The refrigerant which has been evaporated is introduced into the auxiliary compressor 10 through the first four-way valve 2 and supercharged by the auxiliary compressor 10 and drawn into the compressor 1.

As described above, according to this embodiment, the torque of the electric generator 24 (i.e., load of the electric generator) connected to the sub-expander 23 is changed to adjust the low pressure side pressure, thereby controlling the amount of refrigerant flowing through the expander 6. Therefore, it is possible to efficiently recover power in the expander 6. Power recover from the sub-expander 23 is utilized for generating electricity of the electric generator 24, and it is possible to recover more power from the refrigeration cycle.

A refrigeration cycle apparatus of another embodiment of the present invention will be explained with reference to the drawing.

Figure 27:
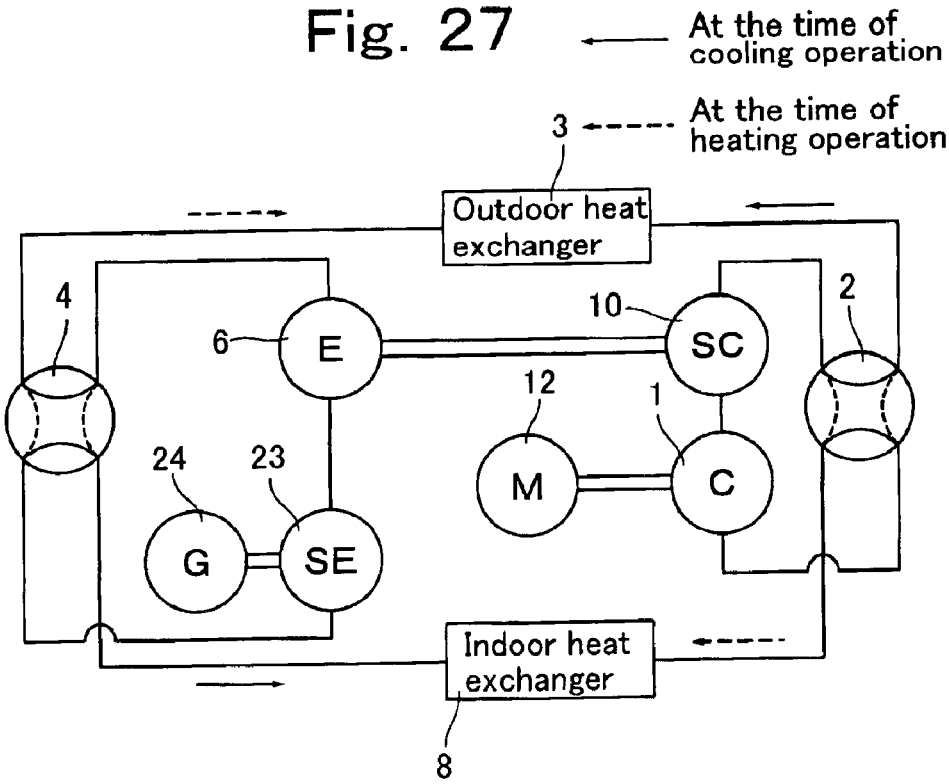
FIG. 27 shows a structure of a heat pump type cooling and heating air conditioner according to another embodiment of the invention.

FIG. 27 shows a structure of the heat pump type air conditioner of this embodiment.

As shown in FIG. 27, the heat pump type air conditioner of this embodiment uses a $CO_2$ refrigerant as a refrigerant, and comprises a refrigerant circuit in which a compressor 1 having a motor 12, an auxiliary compressor 10, an outdoor heat exchanger 3, an expander 6 and an indoor heat exchanger 8 are connected to one another through pipes.

The expander 6 is provided at its discharge side with a sub-expander 23, and an electric generator 24 is connected to a drive shaft of the sub-expander 23.

A drive shaft of the expander 6 and a drive shaft of the auxiliary compressor 10 are connected to each other, and the auxiliary compressor 10 is driven by power recover by the expander 6.

The refrigerant circuit includes a first four-way valve 2 to which a suction side pipe of the compressor 1 and a discharge side pipe of the auxiliary compressor 10 are connected, and a second four-way valve 4 to which a discharge side pipe of the sub-expander 23 and a suction side pipe of the expander 6 are connected.

The operation of the heat pump type cooling and heating air conditioner of this embodiment will be explained.

First, a cooling operation mode in which the outdoor heat exchanger 3 is used as a gas cooler and the indoor heat exchanger 8 is used as an evaporator will be explained. A flow of the refrigerant in the cooling operation mode is shown with solid arrows in the drawing.

Refrigerant at the time of the cooling operation mode is compressed at a high temperature and under a high pressure and is discharged by the compressor 1 which is driven by the motor 12, and is introduced into the auxiliary compressor 10 and further super-pressurized by the auxiliary compressor 10 and then introduced into the outdoor heat exchanger 3 through the first four-way valve 2. In the outdoor heat exchanger 3, since $CO_2$ refrigerant is in a supercritical state, the refrigerant is not brought into two-phase state, and dissipates heat to outside fluid such as air and water. Then, the $CO_2$ refrigerant is introduced into the expander 6 and the sub-expander 23 through the second four-way valve 4 and is expanded by the expander 6 and the sub-expander 23. Power recover by the expander 6 at the time of expanding operation is used for driving the auxiliary compressor 10. At that time, an optimal amount of refrigerant flowing into the expander 6 is calculated from a high pressure refrigerant temperature and a high pressure refrigerant pressure detected on the side of an outlet of the outdoor heat exchanger 3. If the volume flow rate is smaller than the calculated optimal refrigerant amount, torque of the electric generator 22 (load of the electric generator) is increased to reduce the low pressure side pressure, thereby increasing the volume flow rate of refrigerant flowing into the expander 6. If the optimal amount of refrigerant flowing into the expander 6 is greater than the calculated optimal refrigerant amount, torque of the electric generator 22 (load of the electric generator) is reduced to increase the low pressure side pressure, thereby reducing the volume flow rate of refrigerant flowing into the expander 6.

The $CO_2$ refrigerant expanded by the expander 6 and the sub-expander 23 is introduced into the indoor heat exchanger 8 through the second four-way valve 4 and is evaporated in the indoor heat exchanger 8. A room is cooled by this endotherm. The refrigerant which has been evaporated is drawn into the compressor 1 through the first four-way valve 2.

Next, a heating operation mode in which the outdoor heat exchanger 3 is used as the evaporator and the indoor heat exchanger 8 is used as the gas cooler will be explained. A flow of a refrigerant in this heating operation mode is shown with dashed arrows in the drawing.

Refrigerant at the time of the heating operation mode is compressed at a high temperature and under a high pressure and is discharged by the compressor 1 which is driven by the motor 12, and is introduced into the auxiliary compressor 10 and further super-pressurized by the auxiliary compressor 10 and then introduced into the outdoor heat exchanger 3 through the first four-way valve 2. In the outdoor heat exchanger 3, since $CO_2$ refrigerant is in a supercritical state, the refrigerant is not brought into two-phase state, and dissipates heat to outside fluid such as air and water. A room is heated utilizing this radiation. Then, the $CO_2$ refrigerant is introduced into the expander 6 and the sub-expander 23 through the second four-way valve 4 and is expanded by the expander 6 and the sub-expander 23. Power recover by the expander 6 at the time of expanding operation is used for driving the auxiliary compressor 10. At that time, an optimal amount of refrigerant flowing into the expander 6 is calculated from a high pressure refrigerant temperature and a high pressure refrigerant pressure detected on the side of an outlet of the outdoor heat exchanger 3. If the volume flow rate is smaller than the calculated optimal refrigerant amount, torque of the electric generator 22 (load of the electric generator) is increased to reduce the low pressure side pressure, thereby increasing the volume flow rate of refrigerant flowing into the expander 6. If the optimal amount of refrigerant flowing into the expander 6 is greater than the calculated optimal refrigerant amount, torque of the electric generator 22 (load of the electric generator) is reduced to increase the low pressure side pressure, thereby reducing the volume flow rate of refrigerant flowing into the expander 6.

The $CO_2$ refrigerant expanded by the expander 6 and the sub-expander 23 is evaporated and suctions heat in the outdoor heat exchanger 3. The refrigerant which has been evaporated is drawn into the compressor 1 through the first four-way valve 2.

As described above, according to this embodiment, the torque of the electric generator 24 (i.e., load of the electric generator) connected to the sub-expander 23 is changed to adjust the low pressure side pressure, thereby controlling the amount of refrigerant flowing through the expander 6. Therefore, it is possible to efficiently recover power in the expander 6. Power recover from the sub-expander 23 is utilized for generating electricity of the electric generator 24, and it is possible to recover more power from the refrigeration cycle.

A refrigeration cycle apparatus of another embodiment of the present invention will be explained with reference to the drawing.

Figure 28:
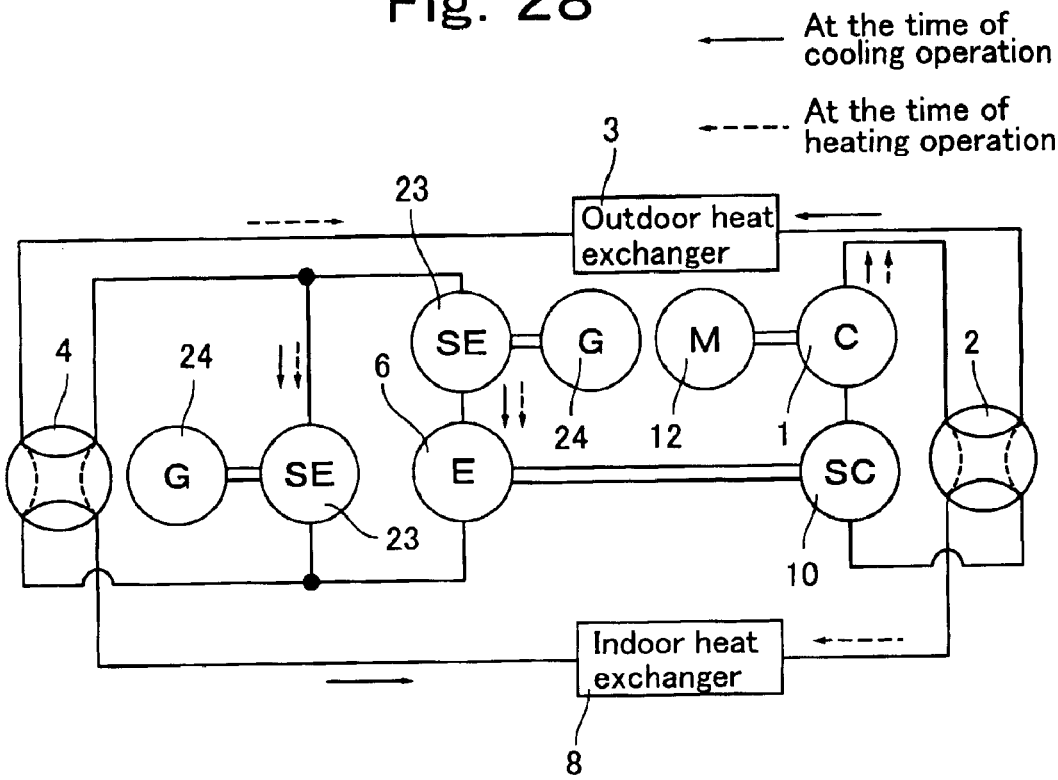
FIG. 28 shows a structure of a heat pump type cooling and heating air conditioner according to another embodiment of the invention.

FIG. 28 shows a structure of the heat pump type air conditioner of this embodiment.

As shown in FIG. 28, the heat pump type air conditioner of this embodiment uses a $CO_2$ refrigerant as a refrigerant, and comprises a refrigerant circuit in which a compressor 1 having a motor 12, an outdoor heat exchanger 3, an expander 6, an indoor heat exchanger 8 and an auxiliary compressor 10 are connected to one another through pipes.

The expander 6 is provided at its inflow side with a sub-expander 23, and an electric generator 24 is connected to a drive shaft of the sub-expander 23.

A bypass circuit for bypassing the sub-expander 23 and the expander 6 is provided in parallel to the sub-expander 23 and the expander 6. The bypass circuit is provided with a sub-expander 21. An electric generator 22 is connected to a drive shaft of the sub-expander 21. The bypass circuit is connected to the second four-way valve 4 like the sub-expander 23 and the expander 6.

A drive shaft of the expander 6 and a drive shaft of the auxiliary compressor 10 are connected to each other, and the auxiliary compressor 10 is driven by power recover by the expander 6.

The refrigerant circuit includes a first four-way valve 2 to which a discharge side pipe of the compressor 1 and a suction side pipe of the auxiliary compressor 10 are connected, and a second four-way valve 4 to which a suction side pipe of the sub-expander 23, a discharge side pipe of the expander 6 and the bypass circuit are connected.

The operation of the heat pump type cooling and heating air conditioner of this embodiment will be explained.

First, a cooling operation mode in which the outdoor heat exchanger 3 is used as a gas cooler and the indoor heat exchanger 8 is used as an evaporator will be explained. A flow of the refrigerant in the cooling operation mode is shown with solid arrows in the drawing.

Refrigerant at the time of the cooling operation mode is compressed at a high temperature and under a high pressure and is discharged by the compressor 1 which is driven by the motor 12, and is introduced into the indoor heat exchanger 8 through the first four-way valve 2. In the outdoor heat exchanger 3, since $CO_2$ refrigerant is in a supercritical state, the refrigerant is not brought into two-phase state, and dissipates heat to outside fluid such as air and water. Then, the $CO_2$ refrigerant is introduced into the sub-expander 23, the expander 6 and the sub-expander 21 and is expanded by the sub-expander 23, the expander 6 and the sub-expander 21. Power recover by the expander 6 at the time of expanding operation is used for driving the auxiliary compressor 10. At that time, an optimal amount of refrigerant flowing into the expander 6 is calculated from a high pressure refrigerant temperature and a high pressure refrigerant pressure detected on the side of an outlet of the outdoor heat exchanger 3. If the volume flow rate is greater than the calculated optimal refrigerant amount, torque of the electric generator 22 (load of the electric generator) is reduced to increase the amount of refrigerant which is allowed to flow into the bypass circuit, thereby reducing the volume flow rate of refrigerant flowing into the expander 6. If the volume flow rate is smaller than the calculated optimal refrigerant amount, torque of the electric generator 24 (load of the electric generator) is increased to increase the high pressure side pressure, thereby increasing the volume flow rate of refrigerant flowing into the expander 6.

The $CO_2$ refrigerant expanded by the sub-expander 23 and the expander 6 is introduced into the indoor heat exchanger 8 through the second four-way valve 4, and is evaporated and suctions heat in the indoor heat exchanger 8. A room is cooled by this endotherm. The refrigerant which has been evaporated is introduced into the auxiliary compressor 10 through the first four-way valve 2 and supercharged by the auxiliary compressor 10 and drawn into the compressor 1.

Next, a heating operation mode in which the outdoor heat exchanger 3 is used as the evaporator and the indoor heat exchanger 8 is used as the gas cooler will be explained. A flow of a refrigerant in this heating operation mode is shown with dashed arrows in the drawing.

Refrigerant at the time of the heating operation mode is compressed at a high temperature and under a high pressure and is discharged by the compressor 1 which is driven by the motor 12, and is introduced into the indoor heat exchanger 8 through the first four-way valve 2. In the indoor heat exchanger 8, since $CO_2$ refrigerant is in a supercritical state, the refrigerant is not brought into two-phase state, and dissipates heat to outside fluid such as air and water and a room is heated utilizing the endotherm. Then, the $CO_2$ refrigerant is introduced into the sub-expander 23, the expander 6 and the sub-expander 21 and is expanded by the sub-expander 23, the expander 6 and the sub-expander 21. Power recover by the expander 6 at the time of expanding operation is used for driving the auxiliary compressor 10. At that time, an optimal amount of refrigerant flowing into the expander 6 is calculated from a high pressure refrigerant temperature and a high pressure refrigerant pressure detected on the side of an outlet of the outdoor heat exchanger 3. If the volume flow rate is greater than the calculated optimal refrigerant amount, torque of the electric generator 22 (load of the electric generator) is reduced to increase the amount of refrigerant which is allowed to flow into the bypass circuit, thereby reducing the volume flow rate of refrigerant flowing into the expander 6. If the volume flow rate is smaller than the calculated optimal refrigerant amount, torque of the electric generator 24 (load of the electric generator) is increased to increase the high pressure side pressure, thereby increasing the volume flow rate of refrigerant flowing into the expander 6.

The $CO_2$ refrigerant expanded by the sub-expander 23 and the expander 6 or the $CO_2$ refrigerant expanded by the sub-expander 21 is introduced into the outdoor heat exchanger 3 through the second four-way valve 4, and is evaporated and suctions heat in the outdoor heat exchanger 3. The refrigerant which has been evaporated is introduced into the auxiliary compressor 10 through the first four-way valve 2 and supercharged by the auxiliary compressor 10 and drawn into the compressor 1.

As described above, according to this embodiment, the torque of the electric generator 22 (i.e., load of the electric generator) is changed to adjust the amount of refrigerant flowing through the bypass circuit, thereby controlling the amount of refrigerant flowing through the expander 6, and torque of the electric generator 24 connected to the sub-expander 23 (i.e., load of the electric generator) is changed to adjust the high pressure side pressure, thereby controlling the amount of refrigerant flowing into the expander 6. Therefore, it is possible to efficiently recover power in the expander 6. Power recover from the sub-expander 21 and the sub-expander 23 is utilized for generating electricity of the electric generators 22 and 24, and it is possible to recover more power from the refrigeration cycle.

A refrigeration cycle apparatus of another embodiment of the present invention will be explained with reference to the drawing.

Figure 29:
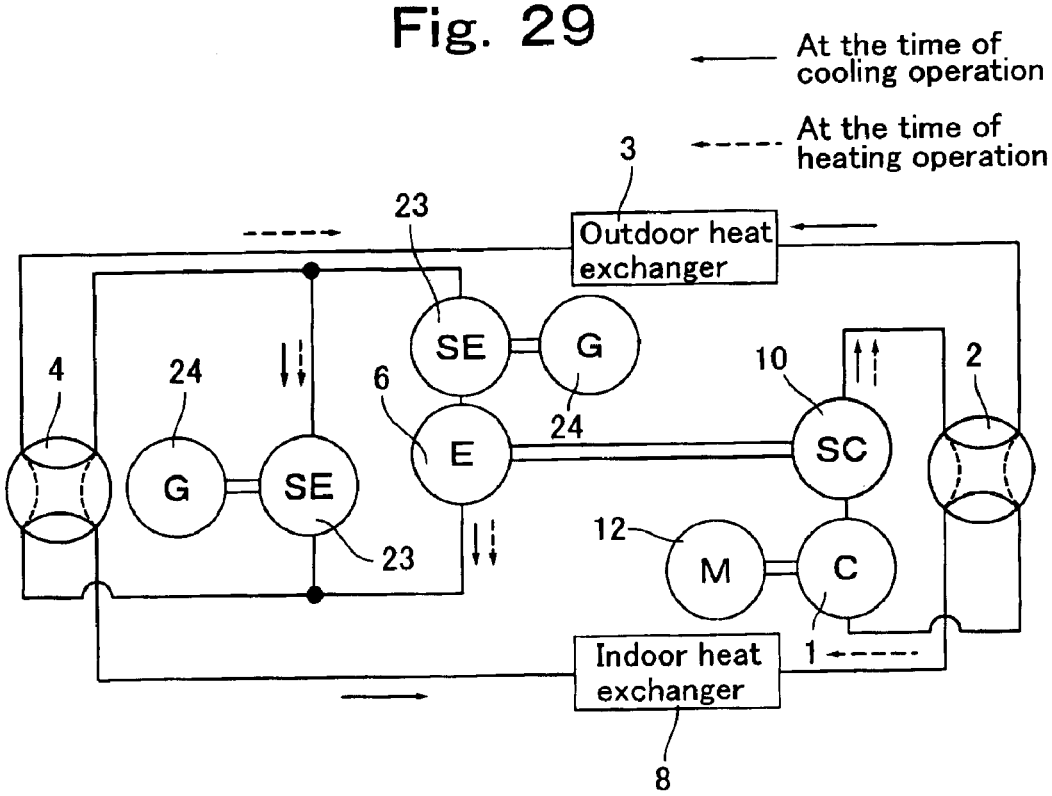
FIG. 29 shows a structure of a heat pump type cooling and heating air conditioner according to another embodiment of the invention.

FIG. 29 shows a structure of the heat pump type air conditioner of this embodiment.

As shown in FIG. 29, the heat pump type air conditioner of this embodiment uses a $CO_2$ refrigerant as a refrigerant, and comprises a refrigerant circuit in which a compressor 1 having a motor 12, an auxiliary compressor 10, an outdoor heat exchanger 3, an expander 6 and an indoor heat exchanger 8 are connected to one another through pipes.

The expander 6 is provided at its inflow side with a sub-expander 23, and an electric generator 24 is connected to a drive shaft of the sub-expander 23.

A bypass circuit for bypassing the sub-expander 23 and the expander 6 is provided in parallel to the sub-expander 23 and the expander 6. The bypass circuit is provided with a sub-expander 21. An electric generator 22 is connected to a drive shaft of the sub-expander 21. The bypass circuit is connected to the second four-way valve 4 like the sub-expander 23 and the expander 6.

A drive shaft of the expander 6 and a drive shaft of the auxiliary compressor 10 are connected to each other, and the auxiliary compressor 10 is driven by power recover by the expander 6.

The refrigerant circuit includes a first four-way valve 2 to which a suction side pipe of the compressor 1 and a discharge side pipe of the auxiliary compressor 10 are connected, and a second four-way valve 4 to which a suction side pipe of the sub-expander 23, a discharge side pipe of the expander 6 and the bypass circuit are connected.

The operation of the heat pump type cooling and heating air conditioner of this embodiment will be explained.

First, a cooling operation mode in which the outdoor heat exchanger 3 is used as a gas cooler and the indoor heat exchanger 8 is used as an evaporator will be explained. A flow of the refrigerant in the cooling operation mode is shown with solid arrows in the drawing.

Refrigerant at the time of the cooling operation mode is compressed at a high temperature and under a high pressure and is discharged by the compressor 1 which is driven by the motor 12, and is introduced into the auxiliary compressor 10 and further super-pressurized by the auxiliary compressor 10 and then introduced into the outdoor heat exchanger 3 through the first four-way valve 2. In the outdoor heat exchanger 3, since $CO_2$ refrigerant is in a supercritical state, the refrigerant is not brought into two-phase state, and dissipates heat to outside fluid such as air and water. Then, the $CO_2$ refrigerant is introduced into the sub-expander 23, the expander 6 and the sub-expander 21 and is expanded by the sub-expander 23, the expander 6 and the sub-expander 21. Power recover by the expander 6 at the time of expanding operation is used for driving the auxiliary compressor 10. At that time, an optimal amount of refrigerant flowing into the expander 6 is calculated from a high pressure refrigerant temperature and a high pressure refrigerant pressure detected on the side of an outlet of the outdoor heat exchanger 3. If the volume flow rate is greater than the calculated optimal refrigerant amount, torque of the electric generator 22 (load of the electric generator) is reduced to increase the amount of refrigerant which is allowed to flow into the bypass circuit, thereby reducing the volume flow rate of refrigerant flowing into the expander 6. If the volume flow rate is smaller than the calculated optimal refrigerant amount, torque of the electric generator 24 (load of the electric generator) is increased to increase the high pressure side pressure, thereby increasing the volume flow rate of refrigerant flowing into the expander 6.

The $CO_2$ refrigerant expanded by the sub-expander 23 and the expander 6 or the $CO_2$ refrigerant expanded by the sub-expander 21 is introduced into the indoor heat exchanger 8 through the second four-way valve 4, and is evaporated and suctions heat in the indoor heat exchanger 8. A room is cooled by the endotherm. The refrigerant which has been evaporated is drawn into the compressor 1 through the first four-way valve 2.

Next, a heating operation mode in which the outdoor heat exchanger 3 is used as the evaporator and the indoor heat exchanger 8 is used as the gas cooler will be explained. A flow of a refrigerant in this heating operation mode is shown with dashed arrows in the drawing.

Refrigerant at the time of the heating operation mode is compressed at a high temperature and under a high pressure and is discharged by the compressor 1 which is driven by the motor 12, and is introduced into the auxiliary compressor 10 and further super-pressurized by the auxiliary compressor 10 and then introduced into the outdoor heat exchanger 3 through the first four-way valve 2. In the outdoor heat exchanger 3, since $CO_2$ refrigerant is in a supercritical state, the refrigerant is not brought into two-phase state, and dissipates heat to outside fluid such as air and water. A room is heated utilizing this radiation. Then, the $CO_2$ refrigerant is introduced into the sub-expander 23, the expander 6 and the sub-expander 21 and is expanded by the sub-expander 23, the expander 6 and the sub-expander 21. Power recover by the expander 6 at the time of expanding operation is used for driving the auxiliary compressor 10. At that time, an optimal amount of refrigerant flowing into the expander 6 is calculated from a high pressure refrigerant temperature and a high pressure refrigerant pressure detected on the side of an outlet of the outdoor heat exchanger 3. If the volume flow rate is greater than the calculated optimal refrigerant amount, torque of the electric generator 22 (load of the electric generator) is reduced to increase the amount of refrigerant which is allowed to flow into the bypass circuit, thereby reducing the volume flow rate of refrigerant flowing into the expander 6. If the volume flow rate is smaller than the calculated optimal refrigerant amount, torque of the electric generator 24 (load of the electric generator) is increased to increase the high pressure side pressure, thereby increasing the volume flow rate of refrigerant flowing into the expander 6.

The $CO_2$ refrigerant expanded by the sub-expander 23 and the expander 6 or the $CO_2$ refrigerant expanded by the sub-expander 21 is introduced into the outdoor heat exchanger 3 through the second four-way valve 4 and is evaporated and suctions heat in the outdoor heat exchanger 3. The refrigerant which has been evaporated is drawn into the compressor 1 through the first four-way valve 2.

As described above, according to this embodiment, the torque of the electric generator 22 (i.e., load of the electric generator) is changed to adjust the amount of refrigerant flowing through the bypass circuit, thereby controlling the amount of refrigerant flowing through the expander 6, and torque of the electric generator 24 connected to the sub-expander 23 (i.e., load of the electric generator) is changed to adjust the high pressure side pressure, thereby controlling the amount of refrigerant flowing into the expander 6. Therefore, it is possible to efficiently recover power in the expander 6. Power recover from the sub-expander 21 and the sub-expander 23 is utilized for generating electricity of the electric generators 22 and 24, and it is possible to recover more power from the refrigeration cycle.

A refrigeration cycle apparatus of another embodiment of the present invention will be explained with reference to the drawing.

Figure 30:
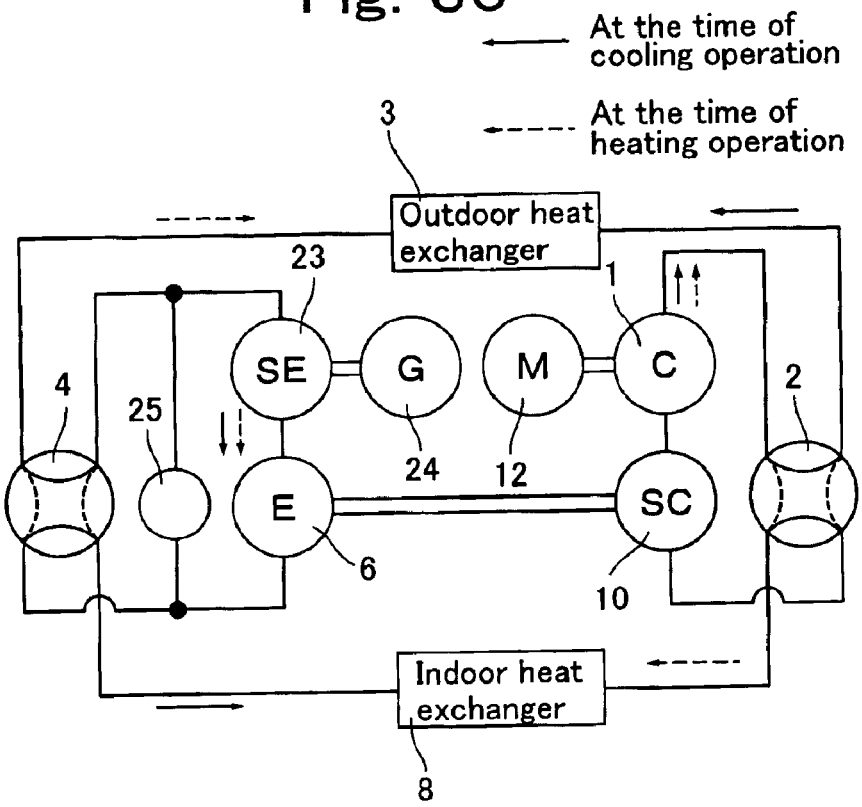
FIG. 30 shows a structure of a heat pump type cooling and heating air conditioner according to another embodiment of the invention.

FIG. 30 shows a structure of the heat pump type air conditioner of this embodiment.

As shown in FIG. 30, the heat pump type air conditioner of this embodiment uses a $CO_2$ refrigerant as a refrigerant, and comprises a refrigerant circuit in which a compressor 1 having a motor 12, an outdoor heat exchanger 3, an expander 6, an indoor heat exchanger 8 and an auxiliary compressor 10 are connected to one another through pipes.

The expander 6 is provided at its inflow side with a sub-expander 23, and an electric generator 24 is connected to a drive shaft of the sub-expander 23.

A bypass circuit for bypassing the sub-expander 23 and the expander 6 is provided in parallel to the sub-expander 23 and the expander 6. The bypass circuit is provided with a bypass valve 7. The bypass circuit is connected to the second four-way valve 4 like the sub-expander 23 and the expander 6.

A drive shaft of the expander 6 and a drive shaft of the auxiliary compressor 10 are connected to each other, and the auxiliary compressor 10 is driven by power recover by the expander 6.

The refrigerant circuit includes a first four-way valve 2 to which a discharge side pipe of the compressor 1 and a suction side pipe of the auxiliary compressor 10 are connected, and a second four-way valve 4 to which a suction side pipe of the sub-expander 23, a discharge side pipe of the expander 6 and the bypass circuit are connected.

The operation of the heat pump type cooling and heating air conditioner of this embodiment will be explained.

First, a cooling operation mode in which the outdoor heat exchanger 3 is used as a gas cooler and the indoor heat exchanger 8 is used as an evaporator will be explained. A flow of the refrigerant in the cooling operation mode is shown with solid arrows in the drawing.

Refrigerant at the time of the cooling operation mode is compressed at a high temperature and under a high pressure and is discharged by the compressor 1 which is driven by the motor 12, and is introduced into the outdoor heat exchanger 3 through the first four-way valve 2. In the outdoor heat exchanger 3, since $CO_2$ refrigerant is in a supercritical state, the refrigerant is not brought into two-phase state, and dissipates heat to outside fluid such as air and water. Then, the $CO_2$ refrigerant is introduced into the sub-expander 23 and the expander 6 and is expanded by the sub-expander 23 and the expander 6. Power recover by the expander 6 at the time of expanding operation is used for driving the auxiliary compressor 10. At that time, an optimal amount of refrigerant flowing into the expander 6 is calculated from a high pressure refrigerant temperature and a high pressure refrigerant pressure detected on the side of an outlet of the outdoor heat exchanger 3. If the volume flow rate is greater than the calculated optimal refrigerant amount, the opening of the bypass valve 7 is increased to increase the amount of refrigerant which is allowed to flow into the bypass circuit, thereby reducing the volume flow rate of refrigerant flowing into the expander 6. If the volume flow rate is smaller than the calculated optimal refrigerant amount, torque of the electric generator 24 (load of the electric generator) is increased to increase the high pressure side pressure, thereby increasing the volume flow rate of refrigerant flowing into the expander 6.

The $CO_2$ refrigerant expanded by the sub-expander 23 and the expander 6 is introduced into the indoor heat exchanger 8 through the second four-way valve 4, and is evaporated and suctions heat in the indoor heat exchanger 8. A room is cooled by the endotherm. The refrigerant which has been evaporated is introduced into the auxiliary compressor 10 through the first four-way valve 2 and supercharged by the auxiliary compressor 10 and drawn into the compressor 1.

Next, a heating operation mode in which the outdoor heat exchanger 3 is used as the evaporator and the indoor heat exchanger 8 is used as the gas cooler will be explained. A flow of a refrigerant in this heating operation mode is shown with dashed arrows in the drawing.

Refrigerant at the time of the heating operation mode is compressed at a high temperature and under a high pressure and is discharged by the compressor 1 which is driven by the motor 12, and is introduced into the indoor heat exchanger 8 through the first four-way valve 2. In the indoor heat exchanger 8, since $CO_2$ refrigerant is in a supercritical state, the refrigerant is not brought into two-phase state, and dissipates heat to outside fluid such as air and water. A room is heated utilizing this radiation. Then, the $CO_2$ refrigerant is introduced into the sub-expander 23 and the expander 6 and is expanded by the sub-expander 23 and the expander 6. Power recover by the expander 6 at the time of expanding operation is used for driving the auxiliary compressor 10. At that time, an optimal amount of refrigerant flowing into the expander 6 is calculated from a high pressure refrigerant temperature and a high pressure refrigerant pressure detected on the side of an outlet of the indoor heat exchanger 8. If the volume flow rate is greater than the calculated optimal refrigerant amount, the opening of the bypass valve 7 is increased to increase the amount of refrigerant which is allowed to flow into the bypass circuit, thereby reducing the volume flow rate of refrigerant flowing into the expander 6. If the volume flow rate is smaller than the calculated optimal refrigerant amount, torque of the electric generator 24 (load of the electric generator) is increased to increase the high pressure side pressure, thereby increasing the volume flow rate of refrigerant flowing into the expander 6.

The $CO_2$ refrigerant expanded by the sub-expander 23 and the expander 6 is introduced into the outdoor heat exchanger 3 through the second four-way valve 4, and is evaporated and suctions heat in the outdoor heat exchanger 3. The refrigerant which has been evaporated is introduced into the auxiliary compressor 10 through the first four-way valve 2 and supercharged by the auxiliary compressor 10 and drawn into the compressor 1.

As described above, according to this embodiment, the opening of the bypass valve 7 is changed to adjust the amount of refrigerant flowing through the bypass circuit, thereby controlling the amount of refrigerant flowing into the expander 6, and torque of the electric generator 24 connected to the sub-expander 23 (i.e., load of the electric generator) is changed to adjust the high pressure side pressure, thereby controlling the amount of refrigerant flowing into the expander 6. Therefore, it is possible to efficiently recover power in the expander 6. Power recover from the sub-expander 23 is utilized for generating electricity of the electric generator 24, and it is possible to recover more power from the refrigeration cycle.

A refrigeration cycle apparatus of another embodiment of the present invention will be explained with reference to the drawing.

Figure 31:
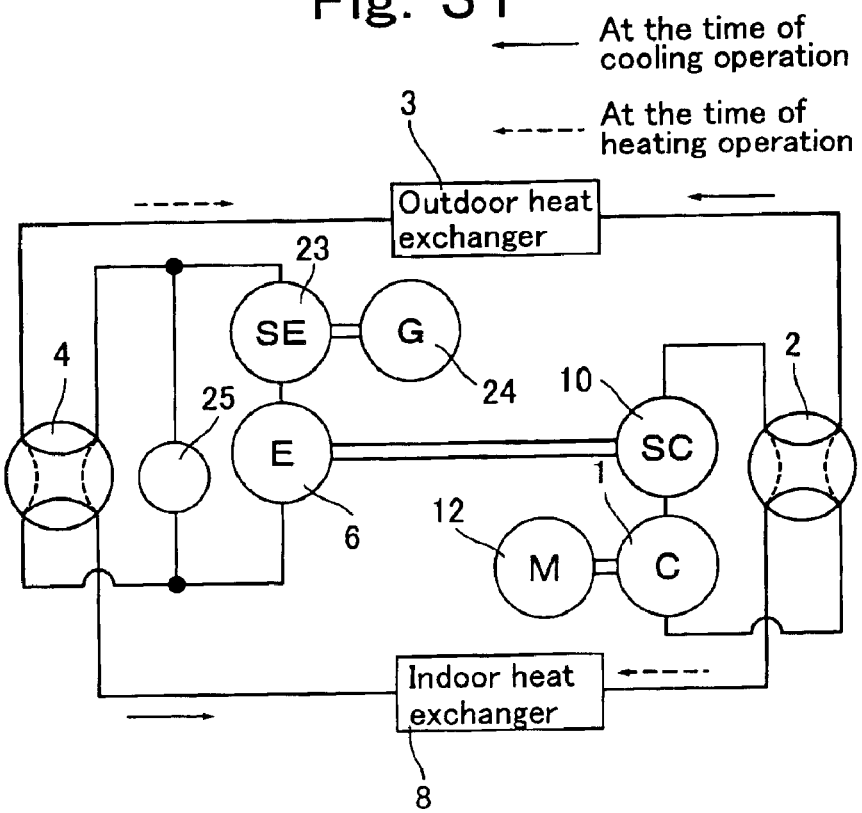
FIG. 31 shows a structure of a heat pump type cooling and heating air conditioner according to another embodiment of the invention.

FIG. 31 shows a structure of the heat pump type air conditioner of this embodiment.

As shown in FIG. 31, the heat pump type air conditioner of this embodiment uses a $CO_2$ refrigerant as a refrigerant, and comprises a refrigerant circuit in which a compressor 1 having a motor 12, an auxiliary compressor 10, an outdoor heat exchanger 3, an expander 6 and an indoor heat exchanger 8 are connected to one another through pipes.

The expander 6 is provided at its inflow side with a sub-expander 23, and an electric generator 24 is connected to a drive shaft of the sub-expander 23.

A bypass circuit for bypassing the sub-expander 23 and the expander 6 is provided in parallel to the sub-expander 23 and the expander 6. The bypass circuit is provided with a bypass valve 7. The bypass circuit is connected to the second four-way valve 4 like the sub-expander 23 and the expander 6.

A drive shaft of the expander 6 and a drive shaft of the auxiliary compressor 10 are connected to each other, and the auxiliary compressor 10 is driven by power recover by the expander 6.

The refrigerant circuit includes a first four-way valve 2 to which a suction side pipe of the compressor 1 and a discharge side pipe of the auxiliary compressor 10 are connected, and a second four-way valve 4 to which a suction side pipe of the sub-expander 23, a discharge side pipe of the expander 6 and the bypass circuit are connected.

The operation of the heat pump type cooling and heating air conditioner of this embodiment will be explained.

First, a cooling operation mode in which the outdoor heat exchanger 3 is used as a gas cooler and the indoor heat exchanger 8 is used as an evaporator will be explained. A flow of the refrigerant in the cooling operation mode is shown with solid arrows in the drawing.

Refrigerant at the time of the cooling operation mode is compressed at a high temperature and under a high pressure and is discharged by the compressor 1 which is driven by the motor 12, and is introduced into the outdoor heat exchanger 3 through the first four-way valve 2. In the outdoor heat exchanger 3, since $CO_2$ refrigerant is in a supercritical state, the refrigerant is not brought into two-phase state, and dissipates heat to outside fluid such as air and water. Then, the $CO_2$ refrigerant is introduced into the sub-expander 23 and the expander 6 and is expanded by the sub-expander 23 and the expander 6. Power recover by the expander 6 at the time of expanding operation is used for driving the auxiliary compressor 10. At that time, an optimal amount of refrigerant flowing into the expander 6 is calculated from a high pressure refrigerant temperature and a high pressure refrigerant pressure detected on the side of an outlet of the outdoor heat exchanger 3. If the volume flow rate is greater than the calculated optimal refrigerant amount, the opening of the bypass valve 7 is increased to increase the amount of refrigerant which is allowed to flow into the bypass circuit, thereby reducing the volume flow rate of refrigerant flowing into the expander 6. If the volume flow rate is smaller than the calculated optimal refrigerant amount, torque of the electric generator 24 (load of the electric generator) is increased to increase the high pressure side pressure, thereby increasing the volume flow rate of refrigerant flowing into the expander 6.

The $CO_2$ refrigerant expanded by the sub-expander 23 and the expander 6 is introduced into the indoor heat exchanger 8 through the second four-way valve 4, and is evaporated and suctions heat in the indoor heat exchanger 8. A room is cooled by the endotherm. The refrigerant which has been evaporated is drawn into the compressor 1 through the first four-way valve 2.

Next, a heating operation mode in which the outdoor heat exchanger 3 is used as the evaporator and the indoor heat exchanger 8 is used as the gas cooler will be explained. A flow of a refrigerant in this heating operation mode is shown with dashed arrows in the drawing.

Refrigerant at the time of the heating operation mode is compressed at a high temperature and under a high pressure and is discharged by the compressor 1 which is driven by the motor 12, and is introduced into the indoor heat exchanger 8 through the first four-way valve 2. In the indoor heat exchanger 8, since $CO_2$ refrigerant is in a supercritical state, the refrigerant is not brought into two-phase state, and dissipates heat to outside fluid such as air and water. A room is heated utilizing this radiation. Then, the $CO_2$ refrigerant is introduced into the sub-expander 23 and the expander 6 and is expanded by the sub-expander 23 and the expander 6. Power recover by the expander 6 at the time of expanding operation is used for driving the auxiliary compressor 10. At that time, an optimal amount of refrigerant flowing into the expander 6 is calculated from a high pressure refrigerant temperature and a high pressure refrigerant pressure detected on the side of an outlet of the indoor heat exchanger 8. If the volume flow rate is greater than the calculated optimal refrigerant amount, the opening of the bypass valve 7 is increased to increase the amount of refrigerant which is allowed to flow into the bypass circuit, thereby reducing the volume flow rate of refrigerant flowing into the expander 6. If the volume flow rate is smaller than the calculated optimal refrigerant amount, torque of the electric generator 24 (load of the electric generator) is increased to increase the high pressure side pressure, thereby increasing the volume flow rate of refrigerant flowing into the expander 6.

The $CO_2$ refrigerant expanded by the sub-expander 23 and the expander 6 is introduced into the outdoor heat exchanger 3 through the second four-way valve 4, and is evaporated and suctions heat in the outdoor heat exchanger 3. The refrigerant which has been evaporated is drawn into the compressor 1 through the first four-way valve 2.

As described above, according to this embodiment, the opening of the bypass valve 7 is changed to adjust the amount of refrigerant flowing through the bypass circuit, thereby controlling the amount of refrigerant flowing into the expander 6, and torque of the electric generator 24 connected to the sub-expander 23 (i.e., load of the electric generator) is changed to adjust the high pressure side pressure, thereby controlling the amount of refrigerant flowing into the expander 6. Therefore, it is possible to efficiently recover power in the expander 6. Power recover from the sub-expander 23 is utilized for generating electricity of the electric generator 24, and it is possible to recover more power from the refrigeration cycle.

A refrigeration cycle apparatus of another embodiment of the present invention will be explained with reference to the drawing.

Figure 32:
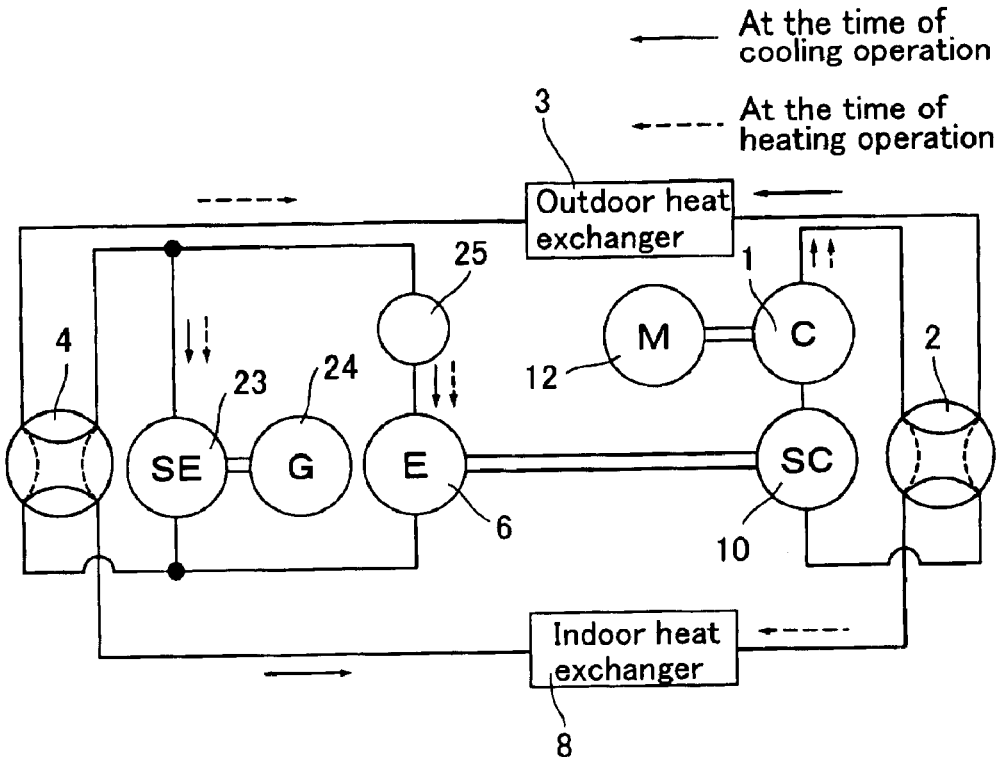
FIG. 32 shows a structure of a heat pump type cooling and heating air conditioner according to another embodiment of the invention.

FIG. 32 shows a structure of the heat pump type air conditioner of this embodiment.

As shown in FIG. 32, the heat pump type air conditioner of this embodiment uses a $CO_2$ refrigerant as a refrigerant, and comprises a refrigerant circuit in which a compressor 1 having a motor 12, an outdoor heat exchanger 3, an expander 6, an indoor heat exchanger 8 and an auxiliary compressor 10 are connected to one another through pipes.

The expander 6 is provided at its inflow side with a pre-expansion valve 5.

A bypass circuit for bypassing the pre-expansion valve 5 and the expander 6 is provided in parallel to the pre-expansion valve 5 and the expander 6. The bypass circuit is provided with a sub-expander 21. The bypass circuit is connected to the second four-way valve 4 like the sub-expander 23 and the expander 6.

A drive shaft of the expander 6 and a drive shaft of the auxiliary compressor 10 are connected to each other, and the auxiliary compressor 10 is driven by power recover by the expander 6.

The refrigerant circuit includes a first four-way valve 2 to which a discharge side pipe of the compressor 1 and a suction side pipe of the auxiliary compressor 10 are connected, and a second four-way valve 4 to which a suction side pipe of the pre-expansion valve 5, a discharge side pipe of the expander 6 and the bypass circuit are connected.

The operation of the heat pump type cooling and heating air conditioner of this embodiment will be explained.

First, a cooling operation mode in which the outdoor heat exchanger 3 is used as a gas cooler and the indoor heat exchanger 8 is used as an evaporator will be explained. A flow of the refrigerant in the cooling operation mode is shown with solid arrows in the drawing.

Refrigerant at the time of the cooling operation mode is compressed at a high temperature and under a high pressure and is discharged by the compressor 1 which is driven by the motor 12, and is introduced into the outdoor heat exchanger 3 through the first four-way valve 2. In the outdoor heat exchanger 3, since $CO_2$ refrigerant is in a supercritical state, the refrigerant is not brought into two-phase state, and dissipates heat to outside fluid such as air and water. Then, the $CO_2$ refrigerant is introduced into the pre-expansion valve 5, the expander 6 and the sub-expander 21 and is expanded by the pre-expansion valve 5, the expander 6 and the sub-expander 21. Power recover by the expander 6 at the time of expanding operation is used for driving the auxiliary compressor 10. At that time, an optimal amount of refrigerant flowing into the expander 6 is calculated from a high pressure refrigerant temperature and a high pressure refrigerant pressure detected on the side of an outlet of the outdoor heat exchanger 3. If the volume flow rate is greater than the calculated optimal refrigerant amount, torque of the electric generator 22 (load of the electric generator) is reduced to increase the amount of refrigerant which is allowed to flow into the bypass circuit, thereby reducing the volume flow rate of refrigerant flowing into the expander 6. If the volume flow rate is smaller than the calculated optimal refrigerant amount, the opening of the pre-expansion valve 5 is reduced to increase the high pressure side pressure, thereby increasing the volume flow rate of refrigerant flowing into the expander 6.

The $CO_2$ refrigerant expanded by the pre-expansion valve 5 and the expander 6 or the $CO_2$ refrigerant expanded by the sub-expander 21 is introduced into the indoor heat exchanger 8 through the second four-way valve 4, and is evaporated and suctions heat in the indoor heat exchanger 8. A room is cooled by the endotherm. The refrigerant which has been evaporated is introduced into the auxiliary compressor 10 through the first four-way valve 2 and supercharged by the auxiliary compressor 10 and drawn into the compressor 1.

Next, a heating operation mode in which the outdoor heat exchanger 3 is used as the evaporator and the indoor heat exchanger 8 is used as the gas cooler will be explained. A flow of a refrigerant in this heating operation mode is shown with dashed arrows in the drawing.

Refrigerant at the time of the heating operation mode is compressed at a high temperature and under a high pressure and is discharged by the compressor 1 which is driven by the motor 12, and is introduced into the indoor heat exchanger 8 through the first four-way valve 2. In the indoor heat exchanger 8, since $CO_2$ refrigerant is in a supercritical state, the refrigerant is not brought into two-phase state, and dissipates heat to outside fluid such as air and water. A room is heated utilizing this radiation. Then, the $CO_2$ refrigerant is introduced into the pre-expansion valve 5, the expander 6 and the sub-expander 21 and is expanded by the pre-expansion valve 5, the expander 6 and the sub-expander 21. Power recover by the expander 6 at the time of expanding operation is used for driving the auxiliary compressor 10. At that time, an optimal amount of refrigerant flowing into the expander 6 is calculated from a high pressure refrigerant temperature and a high pressure refrigerant pressure detected on the side of an outlet of the indoor heat exchanger 8. If the volume flow rate is greater than the calculated optimal refrigerant amount, torque of the electric generator 22 (load of the electric generator) is reduced to increase the amount of refrigerant which is allowed to flow into the bypass circuit, thereby reducing the volume flow rate of refrigerant flowing into the expander 6. If the volume flow rate is smaller than the calculated optimal refrigerant amount, the opening of the pre-expansion valve 5 is reduced to increase the high pressure side pressure, thereby increasing the volume flow rate of refrigerant flowing into the expander 6.

The $CO_2$ refrigerant expanded by the pre-expansion valve 5 and the expander 6 or the $CO_2$ refrigerant expanded by the sub-expander 21 is introduced into the outdoor heat exchanger 3 through the second four-way valve 4, and is evaporated and suctions heat in the outdoor heat exchanger 3. The refrigerant which has been evaporated is introduced into the auxiliary compressor 10 through the first four-way valve 2 and supercharged by the auxiliary compressor 10 and drawn into the compressor 1.

As described above, according to this embodiment, the torque of the electric generator 22 (i.e., load of the electric generator) is changed to adjust the amount of refrigerant flowing through the bypass circuit, thereby controlling the amount of refrigerant flowing through the expander 6, and the opening of the pre-expansion valve 5 is changed to adjust the high pressure side pressure, thereby controlling the amount of refrigerant flowing into the expander 6. Therefore, it is possible to efficiently recover power in the expander 6. Power recover from the sub-expander 21 and the sub-expander 23 is utilized for generating electricity of the electric generator 22, and it is possible to recover more power from the refrigeration cycle.

A refrigeration cycle apparatus of another embodiment of the present invention will be explained with reference to the drawing.

Figure 33:
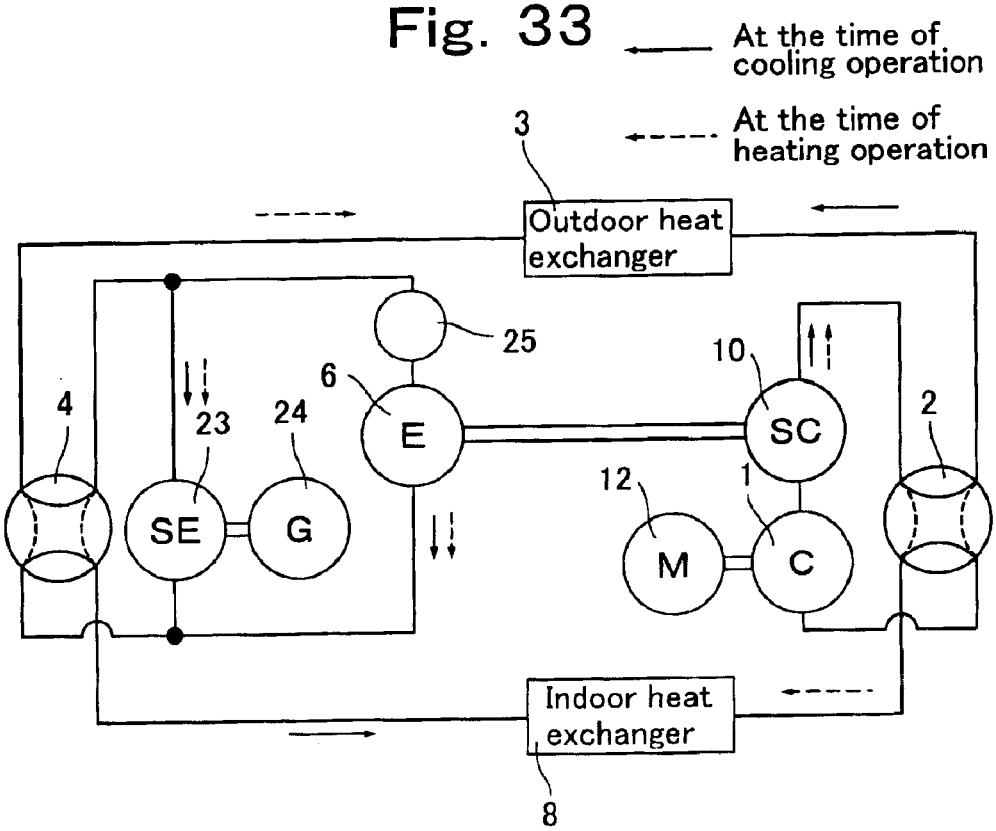
FIG. 33 shows a structure of a heat pump type cooling and heating air conditioner according to another embodiment of the invention.

FIG. 33 shows a structure of the heat pump type air conditioner of this embodiment.

As shown in FIG. 33, the heat pump type air conditioner of this embodiment uses a $CO_2$ refrigerant as a refrigerant, and comprises a refrigerant circuit in which a compressor 1 having a motor 12, an auxiliary compressor 10, an outdoor heat exchanger 3, an expander 6 and an indoor heat exchanger 8 are connected to one another through pipes.

The expander 6 is provided at its inflow side with a pre-expansion valve 5.

A bypass circuit for bypassing the pre-expansion valve 5 and the expander 6 is provided in parallel to the pre-expansion valve 5 and the expander 6. The bypass circuit is provided with a sub-expander 21. The bypass circuit is connected to the second four-way valve 4 like the sub-expander 23 and the expander 6.

A drive shaft of the expander 6 and a drive shaft of the auxiliary compressor 10 are connected to each other, and the auxiliary compressor 10 is driven by power recover by the expander 6.

The refrigerant circuit includes a first four-way valve 2 to which a suction side pipe of the compressor 1 and a discharge side pipe of the auxiliary compressor 10 are connected, and a second four-way valve 4 to which a suction side pipe of the sub-expander 23, a discharge side pipe of the expander 6 and the bypass circuit are connected.

The operation of the heat pump type cooling and heating air conditioner of this embodiment will be explained.

First, a cooling operation mode in which the outdoor heat exchanger 3 is used as a gas cooler and the indoor heat exchanger 8 is used as an evaporator will be explained. A flow of the refrigerant in the cooling operation mode is shown with solid arrows in the drawing.

Refrigerant at the time of the cooling operation mode is compressed at a high temperature and under a high pressure and is discharged by the compressor 1 which is driven by the motor 12, and is introduced into the outdoor heat exchanger 3 through the first four-way valve 2. In the outdoor heat exchanger 3, since $CO_2$ refrigerant is in a supercritical state, the refrigerant is not brought into two-phase state, and dissipates heat to outside fluid such as air and water. Then, the $CO_2$ refrigerant is introduced into the pre-expansion valve 5, the expander 6 and the sub-expander 21 and is expanded by the pre-expansion valve 5, the expander 6 and the sub-expander 21. Power recover by the expander 6 at the time of expanding operation is used for driving the auxiliary compressor 10. At that time, an optimal amount of refrigerant flowing into the expander 6 is calculated from a high pressure refrigerant temperature and a high pressure refrigerant pressure detected on the side of an outlet of the outdoor heat exchanger 3. If the volume flow rate is greater than the calculated optimal refrigerant amount, torque of the electric generator 22 (load of the electric generator) is reduced to increase the amount of refrigerant which is allowed to flow into the bypass circuit, thereby reducing the volume flow rate of refrigerant flowing into the expander 6. If the volume flow rate is smaller than the calculated optimal refrigerant amount, the opening of the pre-expansion valve 5 is reduced to increase the high pressure side pressure, thereby increasing the volume flow rate of refrigerant flowing into the expander 6.

The $CO_2$ refrigerant expanded by the pre-expansion valve 5 and the expander 6 or the $CO_2$ refrigerant expanded by the sub-expander 21 is introduced into the indoor heat exchanger 8 through the second four-way valve 4, and is evaporated and suctions heat in the indoor heat exchanger 8. A room is cooled by this endotherm. The refrigerant which has been evaporated is drawn into the compressor 1 through the first four-way valve 2.

Next, a heating operation mode in which the outdoor heat exchanger 3 is used as the evaporator and the indoor heat exchanger 8 is used as the gas cooler will be explained. A flow of a refrigerant in this heating operation mode is shown with dashed arrows in the drawing.

Refrigerant at the time of the heating operation mode is compressed at a high temperature and under a high pressure and is discharged by the compressor 1 which is driven by the motor 12, and is introduced into the indoor heat exchanger 8 through the first four-way valve 2. In the indoor heat exchanger 8, since $CO_2$ refrigerant is in a supercritical state, the refrigerant is not brought into two-phase state, and dissipates heat to outside fluid such as air and water. A room is heated utilizing this radiation. Then, the $CO_2$ refrigerant is introduced into the pre-expansion valve 5, the expander 6 and the sub-expander 21 and is expanded by the pre-expansion valve 5, the expander 6 and the sub-expander 21. Power recover by the expander 6 at the time of expanding operation is used for driving the auxiliary compressor 10. At that time, an optimal amount of refrigerant flowing into the expander 6 is calculated from a high pressure refrigerant temperature and a high pressure refrigerant pressure detected on the side of an outlet of the indoor heat exchanger 8. If the volume flow rate is greater than the calculated optimal refrigerant amount, torque of the electric generator 22 (load of the electric generator) is reduced to increase the amount of refrigerant which is allowed to flow into the bypass circuit, thereby reducing the volume flow rate of refrigerant flowing into the expander 6. If the volume flow rate is smaller than the calculated optimal refrigerant amount, the opening of the pre-expansion valve 5 is reduced to increase the high pressure side pressure, thereby increasing the volume flow rate of refrigerant flowing into the expander 6.

The $CO_2$ refrigerant expanded by the pre-expansion valve 5 and the expander 6 or the $CO_2$ refrigerant expanded by the sub-expander 21 is introduced into the outdoor heat exchanger 3 through the second four-way valve 4, and is evaporated and suctions heat in the outdoor heat exchanger 3. The refrigerant which has been evaporated is drawn into the compressor 1 through the first four-way valve 2.

As described above, according to this embodiment, the torque of the electric generator 22 (i.e., load of the electric generator) is changed to adjust the amount of refrigerant flowing through the bypass circuit, thereby controlling the amount of refrigerant flowing through the expander 6, and the opening of the pre-expansion valve 5 is changed to adjust the high pressure side pressure, thereby controlling the amount of refrigerant flowing into the expander 6. Therefore, it is possible to efficiently recover power in the expander 6. Power recover from the sub-expander 21 and the sub-expander 23 is utilized for generating electricity of the electric generator 22, and it is possible to recover more power from the refrigeration cycle.

A refrigeration cycle apparatus of another embodiment of the present invention will be explained with reference to the drawing.

Figure 34:
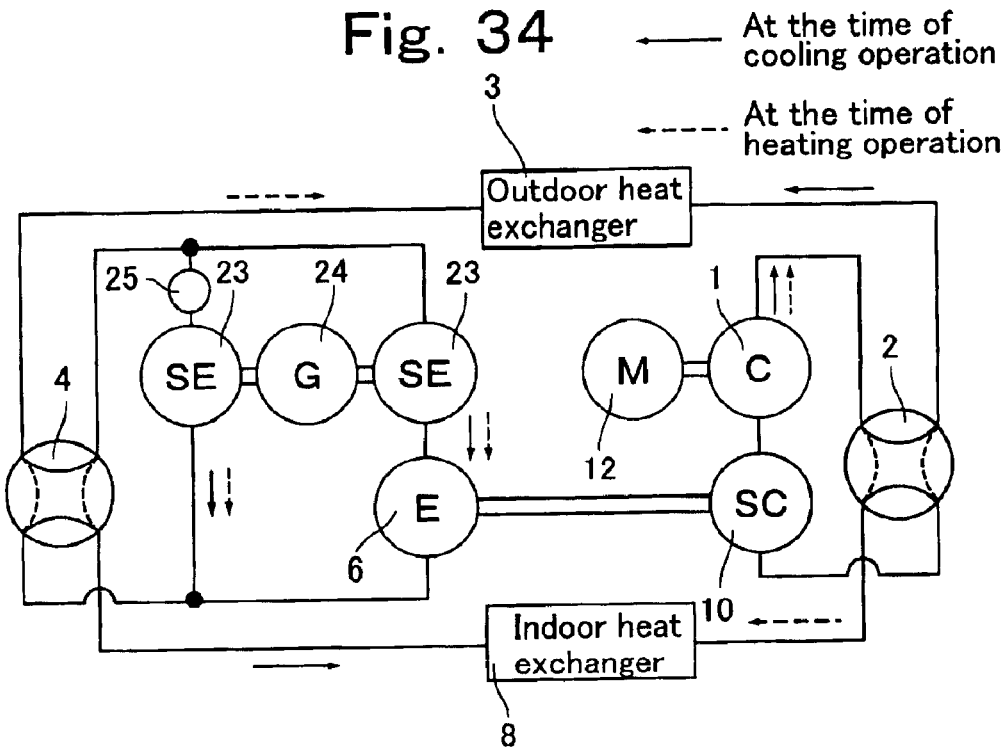
FIG. 34 shows a structure of a heat pump type cooling and heating air conditioner according to another embodiment of the invention.

FIG. 34 shows a structure of the heat pump type air conditioner of this embodiment.

As shown in FIG. 34, the heat pump type air conditioner of this embodiment uses a $CO_2$ refrigerant as a refrigerant, and comprises a refrigerant circuit in which a compressor 1 having a motor 12, an outdoor heat exchanger 3, an expander 6, an indoor heat exchanger 8 and an auxiliary compressor 10 are connected to one another through pipes.

The expander 6 is provided at its inflow side with a sub-expander 23, and an electric generator 22 is connected to a drive shaft of this sub-expander 23.

A bypass circuit for bypassing the sub-expander 23 and the expander 6 is provided in parallel to the sub-expander 23 and the expander 6. The bypass circuit is provided with a sub-expander 21. The bypass circuit is connected to the second four-way valve 4 like the sub-expander 23 and the expander 6.

Here, the electric generator 22 includes a clutch mechanism which is connected to one of the sub-expander 21 and the sub-expander 23. The bypass circuit is provided at its inflow side with a flow path valve 25.

A drive shaft of the expander 6 and a drive shaft of the auxiliary compressor 10 are connected to each other, and the auxiliary compressor 10 is driven by power recover by the expander 6.

The refrigerant circuit includes a first four-way valve 2 to which a discharge side pipe of the compressor 1 and a suction side pipe of the auxiliary compressor 10 are connected, and a second four-way valve 4 to which a suction side pipe of the sub-expander 23, a discharge side pipe of the expander 6 and the bypass circuit are connected.

The operation of the heat pump type cooling and heating air conditioner of this embodiment will be explained.

First, a cooling operation mode in which the outdoor heat exchanger 3 is used as a gas cooler and the indoor heat exchanger 8 is used as an evaporator will be explained. A flow of the refrigerant in the cooling operation mode is shown with solid arrows in the drawing.

Refrigerant at the time of the cooling operation mode is compressed at a high temperature and under a high pressure and is discharged by the compressor 1 which is driven by the motor 12. The refrigerant is introduced into the outdoor heat exchanger 3. In the outdoor heat exchanger 3, since $CO_2$ refrigerant is in a supercritical state, the refrigerant is not brought into two-phase state, and dissipates heat to outside fluid such as air and water. Then, the $CO_2$ refrigerant is introduced into the sub-expander 23 and the expander 6 is expanded by the sub-expander 23 and the expander 6. Power recover by the expander 6 at the time of expanding operation is used for driving the auxiliary compressor 10. At that time, an optimal amount of refrigerant flowing into the expander 6 is calculated from a high pressure refrigerant temperature and a high pressure refrigerant pressure detected on the side of an outlet of the outdoor heat exchanger 3. If the volume flow rate is greater than the calculated optimal refrigerant amount, the flow path valve 25 is opened, the electric generator 22 is connected to the sub-expander 21 to allow refrigerant to flow into the bypass circuit, thereby reducing the volume flow rate of refrigerant flowing into the expander 6. In this case, the sub-expander 23 is not allowed to operate. It is preferable that torque of the electric generator 22 is adjusted to change the bypass amount. If the volume flow rate is smaller than the calculated optimal refrigerant amount, the flow path valve 25 is closed, the electric generator 22 is connected to the sub-expander 23, the high pressure side pressure is increased, and the volume flow rate of refrigerant flowing into the expander 6 is increased. In this case, the sub-expander 21 is not allowed to operate. It is preferable that torque of the electric generator 22 is adjusted to change the high pressure side pressure.

The $CO_2$ refrigerant expanded by the sub-expander 23 and the expander 6 or the $CO_2$ refrigerant expanded by the sub-expander 21 and the expander 6 is introduced into the indoor heat exchanger 8 through the second four-way valve 4 and is evaporated and suctions heat in the indoor heat exchanger 8. A room is cooled by this endotherm. The refrigerant which has been evaporated is introduced into the auxiliary compressor 10 through the first four-way valve 2 and is drawn into the compressor 1.

Next, a heating operation mode in which the outdoor heat exchanger 3 is used as the evaporator and the indoor heat exchanger 8 is used as the gas cooler will be explained. A flow of a refrigerant in this heating operation mode is shown with dashed arrows in the drawing.

Refrigerant at the time of the heating operation mode is compressed at a high temperature and under a high pressure and is discharged by the compressor 1 which is driven by the motor 12. The refrigerant is introduced into the indoor heat exchanger 8 through the first four-way valve 2. In the indoor heat exchanger 8, since $CO_2$ refrigerant is in a supercritical state, the refrigerant is not brought into two-phase state, and dissipates heat to outside fluid such as air and water. A room is heated utilizing this radiation. Then, the $CO_2$ refrigerant is introduced into the sub-expander 23 and the expander 6, and is expanded by the sub-expander 23 and the expander 6. Power recover by the expander 6 at the time of expanding operation is used for driving the auxiliary compressor 10. At that time, an optimal amount of refrigerant flowing into the expander 6 is calculated from a high pressure refrigerant temperature and a high pressure refrigerant pressure detected on the side of an outlet of the indoor heat exchanger 8. If the volume flow rate is greater than the calculated optimal refrigerant amount, the flow path valve 25 is opened, the electric generator 22 is connected to the sub-expander 21 to allow refrigerant to flow into the bypass circuit, thereby reducing the volume flow rate of refrigerant flowing into the expander 6. In this case, the sub-expander 23 is not allowed to operate. It is preferable that torque of the electric generator 22 is adjusted to change the bypass amount. If the volume flow rate is smaller than the calculated optimal refrigerant amount, the flow path valve 25 is closed, the electric generator 22 is connected to the sub-expander 23, the high pressure side pressure is increased, and the volume flow rate of refrigerant flowing into the expander 6 is increased. In this case, the sub-expander 21 is not allowed to operate. It is preferable that torque of the electric generator 22 is adjusted to change the high pressure side pressure.

The $CO_2$ refrigerant expanded by the sub-expander 23 and the expander 6 or the $CO_2$ refrigerant expanded by the sub-expander 21 and the expander 6 is introduced into the outdoor heat exchanger 3 through the second four-way valve 4 and is evaporated and suctions heat in the outdoor heat exchanger 3. The refrigerant which has been evaporated is introduced into the auxiliary compressor 10 through the first four-way valve 2, supercharged by the auxiliary compressor 10 and drawn into the compressor 1.

As described above, according to this embodiment, the open/close valve 25 is opened, the sub-expander 21 is connected to the electric generator 22, thereby adjusting the amount of refrigerant flowing through the bypass circuit, and it is possible to control the amount of refrigerant flowing into the expander 6. The open/close valve 25 is closed, torque of the electric generator 24 connected to the sub-expander 23 (load of the electric generator) is changed to adjust the high pressure side pressure, and it is possible to control the amount of refrigerant flowing into the expander 6. Therefore, it is possible to efficiently recover power in the expander 6. Power recover from the sub-expander 21 or the sub-expander 23 is utilized for generating electricity of the electric generators 22 and 24, and it is possible to recover more power from the refrigeration cycle.

A refrigeration cycle apparatus of another embodiment of the present invention will be explained with reference to the drawing.

Figure 35:
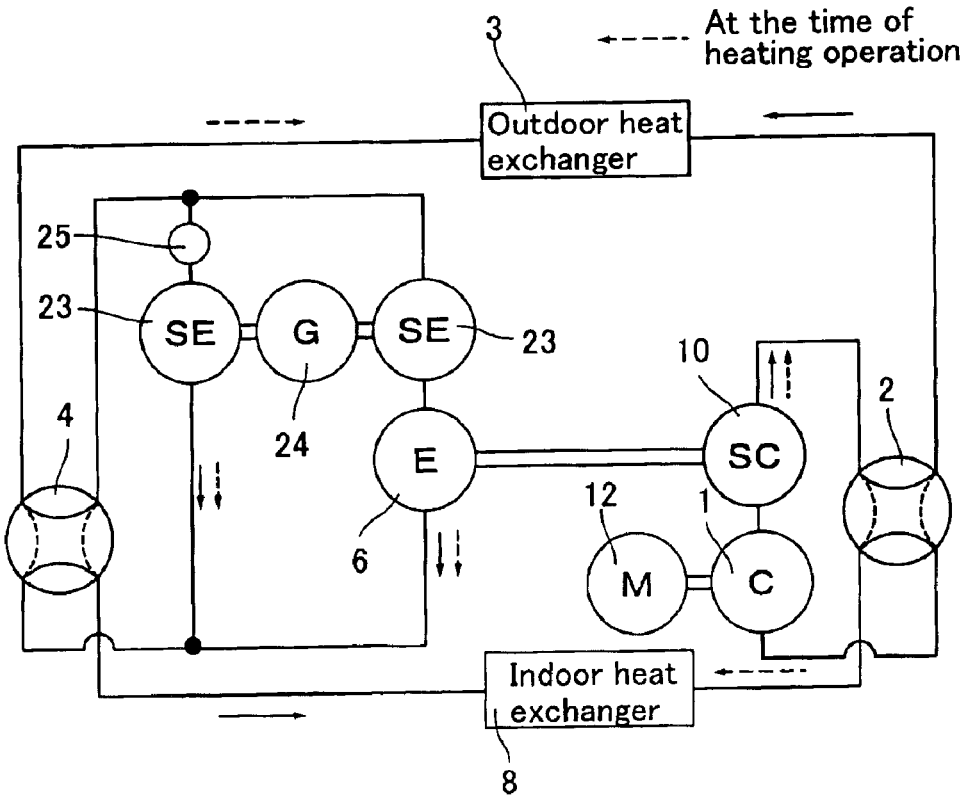
FIG. 35 shows a structure of a heat pump type cooling and heating air conditioner according to another embodiment of the invention.

FIG. 35 shows a structure of the heat pump type air conditioner of this embodiment.

As shown in FIG. 35, the heat pump type air conditioner of this embodiment uses a $CO_2$ refrigerant as a refrigerant, and comprises a refrigerant circuit in which a compressor 1 having a motor 12, an auxiliary compressor 10, an outdoor heat exchanger 3, an expander 6 and an indoor heat exchanger 8 are connected to one another through pipes.

The expander 6 is provided at its inflow side with a sub-expander 23, and an electric generator 22 is connected to a drive shaft of this sub-expander 23.

A bypass circuit for bypassing the sub-expander 23 and the expander 6 is provided in parallel to the sub-expander 23 and the expander 6. The bypass circuit is provided with a sub-expander 21. The bypass circuit is connected to the second four-way valve 4 like the sub-expander 23 and the expander 6.

Here, the electric generator 22 includes a clutch mechanism which is connected to one of the sub-expander 21 and the sub-expander 23. The bypass circuit is provided at its inflow side with a flow path valve 25.

A drive shaft of the expander 6 and a drive shaft of the auxiliary compressor 10 are connected to each other, and the auxiliary compressor 10 is driven by power recover by the expander 6.

The refrigerant circuit includes a first four-way valve 2 to which a suction side pipe of the compressor 1 and a discharge side pipe of the auxiliary compressor 10 are connected, and a second four-way valve 4 to which a suction side pipe of the sub-expander 23, a discharge side pipe of the expander 6 and the bypass circuit are connected.

The operation of the heat pump type cooling and heating air conditioner of this embodiment will be explained.

First, a cooling operation mode in which the outdoor heat exchanger 3 is used as a gas cooler and the indoor heat exchanger 8 is used as an evaporator will be explained. A flow of the refrigerant in the cooling operation mode is shown with solid arrows in the drawing.

Refrigerant at the time of the cooling operation mode is compressed at a high temperature and under a high pressure and is discharged by the compressor 1 which is driven by the motor 12, and is introduced into the outdoor heat exchanger 3 through the first four-way valve 2. In the outdoor heat exchanger 3, since $CO_2$ refrigerant is in a supercritical state, the refrigerant is not brought into two-phase state, and dissipates heat to outside fluid such as air and water. Then, the $CO_2$ refrigerant is introduced into the sub-expander 23 and the expander 6 and is expanded by the sub-expander 23 and the expander 6. Power recover by the expander 6 at the time of expanding operation is used for driving the auxiliary compressor 10. At that time, an optimal amount of refrigerant flowing into the expander 6 is calculated from a high pressure refrigerant temperature and a high pressure refrigerant pressure detected on the side of an outlet of the outdoor heat exchanger 3. If the volume flow rate is greater than the calculated optimal refrigerant amount, the flow path valve 25 is opened, the electric generator 22 is connected to the sub-expander 21 to allow refrigerant to flow into the bypass circuit, thereby reducing the volume flow rate of refrigerant flowing into the expander 6. In this case, the sub-expander 23 is not allowed to operate. It is preferable that torque of the electric generator 22 is adjusted to change the bypass amount. If the volume flow rate is smaller than the calculated optimal refrigerant amount, the flow path valve 25 is closed, the electric generator 22 is connected to the sub-expander 23, the high pressure side pressure is increased, and the volume flow rate of refrigerant flowing into the expander 6 is increased. In this case, the sub-expander 21 is not allowed to operate. It is preferable that torque of the electric generator 22 is adjusted to change the high pressure side pressure.

The $CO_2$ refrigerant expanded by the sub-expander 23 and the expander 6 or the $CO_2$ refrigerant expanded by the sub-expander 21 and the expander 6 is introduced into the indoor heat exchanger 8 through the second four-way valve 4 and is evaporated and suctions heat in the indoor heat exchanger 8. A room is cooled by this endotherm. The refrigerant which has been evaporated is drawn into the compressor 1 through the first four-way valve 2.

Next, a heating operation mode in which the outdoor heat exchanger 3 is used as the evaporator and the indoor heat exchanger 8 is used as the gas cooler will be explained. A flow of a refrigerant in this heating operation mode is shown with dashed arrows in the drawing.

Refrigerant at the time of the heating operation mode is compressed at a high temperature and under a high pressure and is discharged by the compressor 1 which is driven by the motor 12, and is introduced into the indoor heat exchanger 8 through the first four-way valve 2. In the indoor heat exchanger 8, since $CO_2$ refrigerant is in a supercritical state, the refrigerant is not brought into two-phase state, and dissipates heat to outside fluid such as air and water. A room is heated utilizing this radiation. Then, the $CO_2$ refrigerant is introduced into the sub-expander 23 and the expander 6, and is expanded by the sub-expander 23 and the expander 6. Power recover by the expander 6 at the time of expanding operation is used for driving the auxiliary compressor 10. At that time, an optimal amount of refrigerant flowing into the expander 6 is calculated from a high pressure refrigerant temperature and a high pressure refrigerant pressure detected on the side of an outlet of the indoor heat exchanger 8. If the volume flow rate is greater than the calculated optimal refrigerant amount, the flow path valve 25 is opened, the electric generator 22 is connected to the sub-expander 21 to allow refrigerant to flow into the bypass circuit, thereby reducing the volume flow rate of refrigerant flowing into the expander 6. In this case, the sub-expander 23 is not allowed to operate. It is preferable that torque of the electric generator 22 is adjusted to change the bypass amount. If the volume flow rate is smaller than the calculated optimal refrigerant amount, the flow path valve 25 is closed, the electric generator 22 is connected to the sub-expander 23, the high pressure side pressure is increased, and the volume flow rate of refrigerant flowing into the expander 6 is increased. In this case, the sub-expander 21 is not allowed to operate. It is preferable that torque of the electric generator 22 is adjusted to change the high pressure side pressure.

The $CO_2$ refrigerant expanded by the sub-expander 23 and the expander 6 or the $CO_2$ refrigerant expanded by the sub-expander 21 and the expander 6 is introduced into the outdoor heat exchanger 3 through the second four-way valve 4 and is evaporated and suctions heat in the outdoor heat exchanger 3. The refrigerant which has been evaporated is drawn into the compressor 1 through the first four-way valve 2.

As described above, according to this embodiment, the open/close valve 25 is opened, the sub-expander 21 is connected to the electric generator 22, thereby adjusting the amount of refrigerant flowing through the bypass circuit, and it is possible to control the amount of refrigerant flowing into the expander 6. The open/close valve 25 is closed, torque of the electric generator 24 connected to the sub-expander 23 (load of the electric generator) is changed to adjust the high pressure side pressure, and it is possible to control the amount of refrigerant flowing into the expander 6. Therefore, it is possible to efficiently recover power in the expander 6. Power recover from the sub-expander 21 or the sub-expander 23 is utilized for generating electricity of the electric generators 22 and 24, and it is possible to recover more power from the refrigeration cycle.

A refrigeration cycle apparatus of another embodiment of the present invention will be explained with reference to the drawing.

Figure 36:
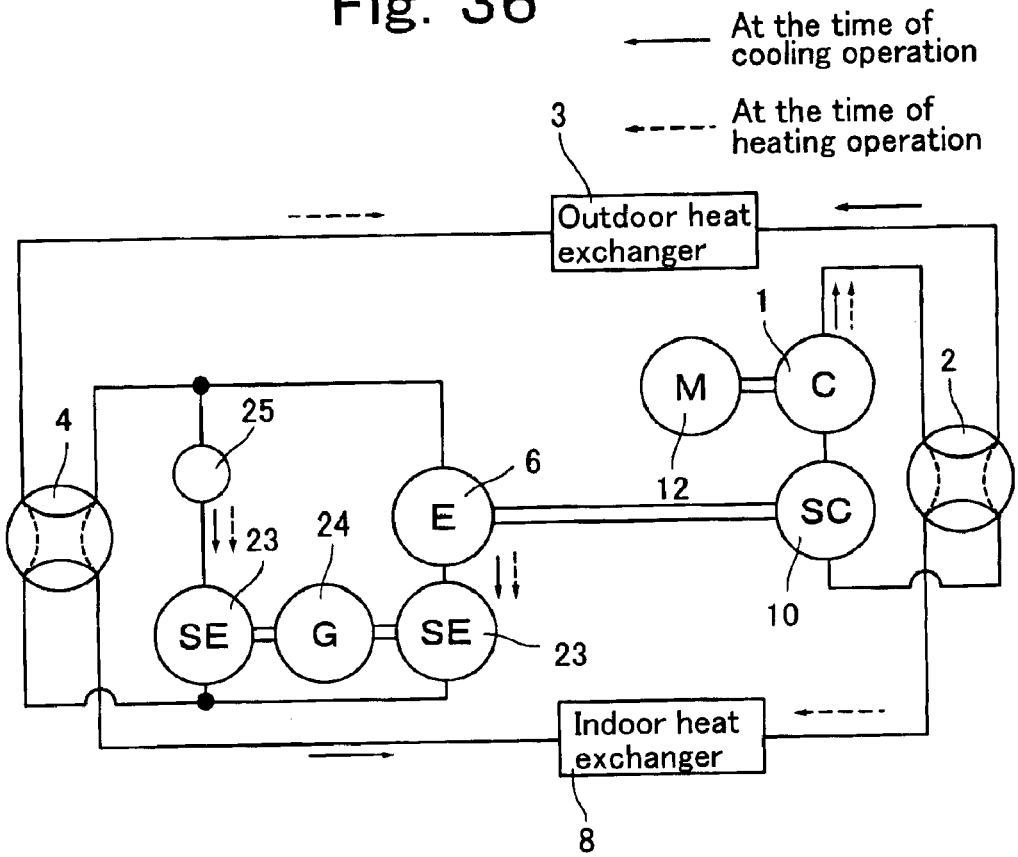
FIG. 36 shows a structure of a heat pump type cooling and heating air conditioner according to another embodiment of the invention.

FIG. 36 shows a structure of the heat pump type air conditioner of this embodiment.

As shown in FIG. 36, the heat pump type air conditioner of this embodiment uses a $CO_2$ refrigerant as a refrigerant, and comprises a refrigerant circuit in which a compressor 1 having a motor 12, an outdoor heat exchanger 3, an expander 6, an indoor heat exchanger 8 and an auxiliary compressor 10 are connected to one another through pipes.

The expander 6 is provided at its discharge side with a sub-expander 23, and an electric generator 22 is connected to a drive shaft of this sub-expander 23.

A bypass circuit for bypassing the sub-expander 23 and the expander 6 is provided in parallel to the sub-expander 23 and the expander 6. The bypass circuit is provided with a sub-expander 21. The bypass circuit is connected to the second four-way valve 4 like the sub-expander 23 and the expander 6.

Here, the electric generator 22 includes a clutch mechanism which is connected to one of the sub-expander 21 and the sub-expander 23. The bypass circuit is provided at its inflow side with a flow path valve 25.

A drive shaft of the expander 6 and a drive shaft of the auxiliary compressor 10 are connected to each other, and the auxiliary compressor 10 is driven by power recover by the expander 6.

The refrigerant circuit includes a first four-way valve 2 to which a discharge side pipe of the compressor 1 and a suction side pipe of the auxiliary compressor 10 are connected, and a second four-way valve 4 to which a discharge side pipe of the sub-expander 23, a inflow side pipe of the expander 6 and the bypass circuit are connected.

The operation of the heat pump type cooling and heating air conditioner of this embodiment will be explained.

First, a cooling operation mode in which the outdoor heat exchanger 3 is used as a gas cooler and the indoor heat exchanger 8 is used as an evaporator will be explained. A flow of the refrigerant in the cooling operation mode is shown with solid arrows in the drawing.

Refrigerant at the time of the cooling operation mode is compressed at a high temperature and under a high pressure and is discharged by the compressor 1 which is driven by the motor 12. The refrigerant is introduced into the outdoor heat exchanger 3. In the outdoor heat exchanger 3, since $CO_2$ refrigerant is in a supercritical state, the refrigerant is not brought into two-phase state, and dissipates heat to outside fluid such as air and water. Then, the $CO_2$ refrigerant is introduced into the expander 6 and the sub-expander 23 is expanded by the expander 6 and the sub-expander 23. Power recover by the expander 6 at the time of expanding operation is used for driving the auxiliary compressor 10. At that time, an optimal amount of refrigerant flowing into the expander 6 is calculated from a high pressure refrigerant temperature and a high pressure refrigerant pressure detected on the side of an outlet of the outdoor heat exchanger 3. If the volume flow rate is greater than the calculated optimal refrigerant amount, the flow path valve 25 is opened, the electric generator 22 is connected to the sub-expander 21 to allow refrigerant to flow into the bypass circuit, thereby reducing the volume flow rate of refrigerant flowing into the expander 6. In this case, the sub-expander 23 is not allowed to operate. It is preferable that torque of the electric generator 22 is adjusted to change the bypass amount. If the volume flow rate is smaller than the calculated optimal refrigerant amount, the flow path valve 25 is closed, the electric generator 22 is connected to the sub-expander 23, the low pressure side pressure is reduced, and the volume flow rate of refrigerant flowing into the expander 6 is increased. In this case, the sub-expander 21 is not allowed to operate. It is preferable that torque of the electric generator 22 is adjusted to change the low pressure side pressure.

The $CO_2$ refrigerant expanded by the sub-expander 23 and the expander 6 or the $CO_2$ refrigerant expanded by the sub-expander 21 and the expander 6 is introduced into the indoor heat exchanger 8 through the second four-way valve 4 and is evaporated and suctions heat in the indoor heat exchanger 8. A room is cooled by this endotherm. The refrigerant which has been evaporated is introduced into the auxiliary compressor 10 through the first four-way valve 2 and is drawn into the compressor 1.

Next, a heating operation mode in which the outdoor heat exchanger 3 is used as the evaporator and the indoor heat exchanger 8 is used as the gas cooler will be explained. A flow of a refrigerant in this heating operation mode is shown with dashed arrows in the drawing.

Refrigerant at the time of the heating operation mode is compressed at a high temperature and under a high pressure and is discharged by the compressor 1 which is driven by the motor 12. The refrigerant is introduced into the indoor heat exchanger 8 through the first four-way valve 2. In the indoor heat exchanger 8, since $CO_2$ refrigerant is in a supercritical state, the refrigerant is not brought into two-phase state, and dissipates heat to outside fluid such as air and water. A room is heated utilizing this radiation. Then, the $CO_2$ refrigerant is introduced into the expander 6 and the sub-expander 23, and is expanded by the expander 6 and the sub-expander 23. Power recover by the expander 6 at the time of expanding operation is used for driving the auxiliary compressor 10. At that time, an optimal amount of refrigerant flowing into the expander 6 is calculated from a high pressure refrigerant temperature and a high pressure refrigerant pressure detected on the side of an outlet of the indoor heat exchanger 8. If the volume flow rate is greater than the calculated optimal refrigerant amount, the flow path valve 25 is opened, the electric generator 22 is connected to the sub-expander 21 to allow refrigerant to flow into the bypass circuit, thereby reducing the volume flow rate of refrigerant flowing into the expander 6. In this case, the sub-expander 23 is not allowed to operate. It is preferable that torque of the electric generator 22 is adjusted to change the bypass amount. If the volume flow rate is smaller than the calculated optimal refrigerant amount, the flow path valve 25 is closed, the electric generator 22 is connected to the sub-expander 23, the low pressure side pressure is reduced, and the volume flow rate of refrigerant flowing into the expander 6 is increased. In this case, the sub-expander 21 is not allowed to operate. It is preferable that torque of the electric generator 22 is adjusted to change the low pressure side pressure.

The $CO_2$ refrigerant expanded by the sub-expander 23 and the expander 6 or the $CO_2$ refrigerant expanded by the sub-expander 21 and the expander 6 is introduced into the outdoor heat exchanger 3 through the second four-way valve 4 and is evaporated and suctions heat in the outdoor heat exchanger 3. The refrigerant which has been evaporated is introduced into the auxiliary compressor 10 through the first four-way valve 2, supercharged by the auxiliary compressor 10 and drawn into the compressor 1.

As described above, according to this embodiment, the open/close valve 25 is opened, the sub-expander 21 is connected to the electric generator 22, thereby adjusting the amount of refrigerant flowing through the bypass circuit, and it is possible to control the amount of refrigerant flowing into the expander 6. The open/close valve 25 is closed, torque of the electric generator 22 connected to the sub-expander 23 (load of the electric generator) is changed to adjust the low pressure side pressure, and it is possible to control the amount of refrigerant flowing into the expander 6. Therefore, it is possible to efficiently recover power in the expander 6. Power recover from the sub-expander 21 or the sub-expander 23 is utilized for generating electricity of the electric generator 22, and it is possible to recover more power from the refrigeration cycle.

A refrigeration cycle apparatus of another embodiment of the present invention will be explained with reference to the drawing.

Figure 37:
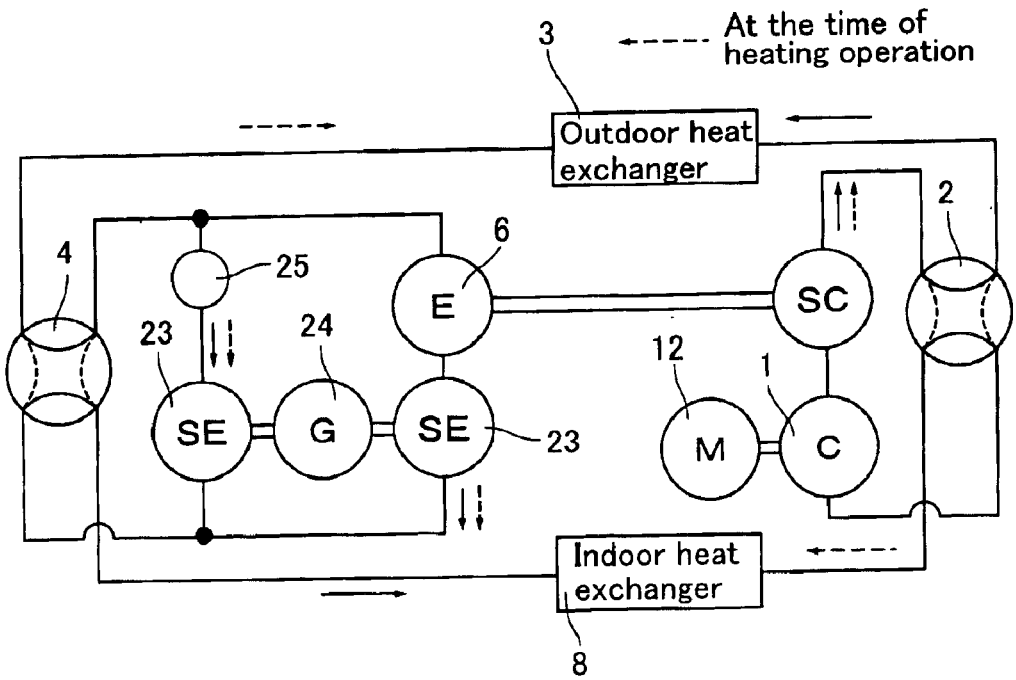
FIG. 37 shows a structure of a heat pump type cooling and heating air conditioner according to another embodiment of the invention.

FIG. 37 shows a structure of the heat pump type air conditioner of this embodiment.

As shown in FIG. 37, the heat pump type air conditioner of this embodiment uses a $CO_2$ refrigerant as a refrigerant, and comprises a refrigerant circuit in which a compressor 1 having a motor 12, an auxiliary compressor 10, an outdoor heat exchanger 3, an expander 6, and an indoor heat exchanger 8 are connected to one another through pipes.

The expander 6 is provided at its discharge side with a sub-expander 23, and an electric generator 22 is connected to a drive shaft of this sub-expander 23.

A bypass circuit for bypassing the sub-expander 23 and the expander 6 is provided in parallel to the sub-expander 23 and the expander 6. The bypass circuit is provided with a sub-expander 21. The bypass circuit is connected to the second four-way valve 4 like the sub-expander 23 and the expander 6.

Here, the electric generator 22 includes a clutch mechanism which is connected to one of the sub-expander 21 and the sub-expander 23. The bypass circuit is provided at its inflow side with a flow path valve 25.

A drive shaft of the expander 6 and a drive shaft of the auxiliary compressor 10 are connected to each other, and the auxiliary compressor 10 is driven by power recover by the expander 6.

The refrigerant circuit includes a first four-way valve 2 to which a suction side pipe of the compressor 1 and a discharge side pipe of the auxiliary compressor 10 are connected, and a second four-way valve 4 to which a discharge side pipe of the sub-expander 23, a inflow side pipe of the expander 6 and the bypass circuit are connected.

The operation of the heat pump type cooling and heating air conditioner of this embodiment will be explained.

First, a cooling operation mode in which the outdoor heat exchanger 3 is used as a gas cooler and the indoor heat exchanger 8 is used as an evaporator will be explained. A flow of the refrigerant in the cooling operation mode is shown with solid arrows in the drawing.

Refrigerant at the time of the cooling operation mode is compressed at a high temperature and under a high pressure and is discharged by the compressor 1 which is driven by the motor 12, and is introduced into the outdoor heat exchanger 3 through the first four-way valve 2. In the outdoor heat exchanger 3, since $CO_2$ refrigerant is in a supercritical state, the refrigerant is not brought into two-phase state, and dissipates heat to outside fluid such as air and water. Then, the $CO_2$ refrigerant is introduced into the expander 6 and the sub-expander 23 and is expanded by the expander 6 and the sub-expander 23. Power recover by the expander 6 at the time of expanding operation is used for driving the auxiliary compressor 10. At that time, an optimal amount of refrigerant flowing into the expander 6 is calculated from a high pressure refrigerant temperature and a high pressure refrigerant pressure detected on the side of an outlet of the outdoor heat exchanger 3. If the volume flow rate is greater than the calculated optimal refrigerant amount, the flow path valve 25 is opened, the electric generator 22 is connected to the sub-expander 21 to allow refrigerant to flow into the bypass circuit, thereby reducing the volume flow rate of refrigerant flowing into the expander 6. In this case, the sub-expander 23 is not allowed to operate. It is preferable that torque of the electric generator 22 is adjusted to change the bypass amount. If the volume flow rate is smaller than the calculated optimal refrigerant amount, the flow path valve 25 is closed, the electric generator 22 is connected to the sub-expander 23, the low pressure side pressure is reduced, and the volume flow rate of refrigerant flowing into the expander 6 is increased. In this case, the sub-expander 21 is not allowed to operate. It is preferable that torque of the electric generator 22 is adjusted to change the low pressure side pressure.

The $CO_2$ refrigerant expanded by the sub-expander 23 and the expander 6 or the $CO_2$ refrigerant expanded by the sub-expander 21 and the expander 6 is introduced into the indoor heat exchanger 8 through the second four-way valve 4 and is evaporated and suctions heat in the indoor heat exchanger 8. A room is cooled by this endotherm. The refrigerant which has been evaporated is drawn into the compressor 1 through the first four-way valve 2.

Next, a heating operation mode in which the outdoor heat exchanger 3 is used as the evaporator and the indoor heat exchanger 8 is used as the gas cooler will be explained. A flow of a refrigerant in this heating operation mode is shown with dashed arrows in the drawing.

Refrigerant at the time of the heating operation mode is compressed at a high temperature and under a high pressure and is discharged by the compressor 1 which is driven by the motor 12, and is introduced into the indoor heat exchanger 8 through the first four-way valve 2. In the indoor heat exchanger 8, since $CO_2$ refrigerant is in a supercritical state, the refrigerant is not brought into two-phase state, and dissipates heat to outside fluid such as air and water. A room is heated utilizing this radiation. Then, the $CO_2$ refrigerant is introduced into the expander 6 and the sub-expander 23, and is expanded by the expander 6 and the sub-expander 23. Power recover by the expander 6 at the time of expanding operation is used for driving the auxiliary compressor 10. At that time, an optimal amount of refrigerant flowing into the expander 6 is calculated from a high pressure refrigerant temperature and a high pressure refrigerant pressure detected on the side of an outlet of the indoor heat exchanger 8. If the volume flow rate is greater than the calculated optimal refrigerant amount, the flow path valve 25 is opened, the electric generator 22 is connected to the sub-expander 21 to allow refrigerant to flow into the bypass circuit, thereby reducing the volume flow rate of refrigerant flowing into the expander 6. In this case, the sub-expander 23 is not allowed to operate. It is preferable that torque of the electric generator 22 is adjusted to change the bypass amount. If the volume flow rate is smaller than the calculated optimal refrigerant amount, the flow path valve 25 is closed, the electric generator 22 is connected to the sub-expander 23, the low pressure side pressure is reduced, and the volume flow rate of refrigerant flowing into the expander 6 is increased. In this case, the sub-expander 21 is not allowed to operate. It is preferable that torque of the electric generator 22 is adjusted to change the low pressure side pressure.

The $CO_2$ refrigerant expanded by the sub-expander 23 and the expander 6 or the $CO_2$ refrigerant expanded by the sub-expander 21 and the expander 6 is introduced into the outdoor heat exchanger 3 through the second four-way valve 4 and is evaporated and suctions heat in the outdoor heat exchanger 3. The refrigerant which has been evaporated is drawn into the compressor 1 through the first four-way valve 2.

As described above, according to this embodiment, the open/close valve 25 is opened, the sub-expander 21 is connected to the electric generator 22, thereby adjusting the amount of refrigerant flowing through the bypass circuit, and it is possible to control the amount of refrigerant flowing into the expander 6. The open/close valve 25 is closed, torque of the electric generator 24 connected to the sub-expander 23 (load of the electric generator) is changed to adjust the low pressure side pressure, and it is possible to control the amount of refrigerant flowing into the expander 6. Therefore, it is possible to efficiently recover power in the expander 6. Power recover from the sub-expander 21 or the sub-expander 23 is utilized for generating electricity of the electric generator 22, and it is possible to recover more power from the refrigeration cycle.

A refrigeration cycle apparatus of another embodiment of the present invention will be explained with reference to the drawing.

Figure 38:
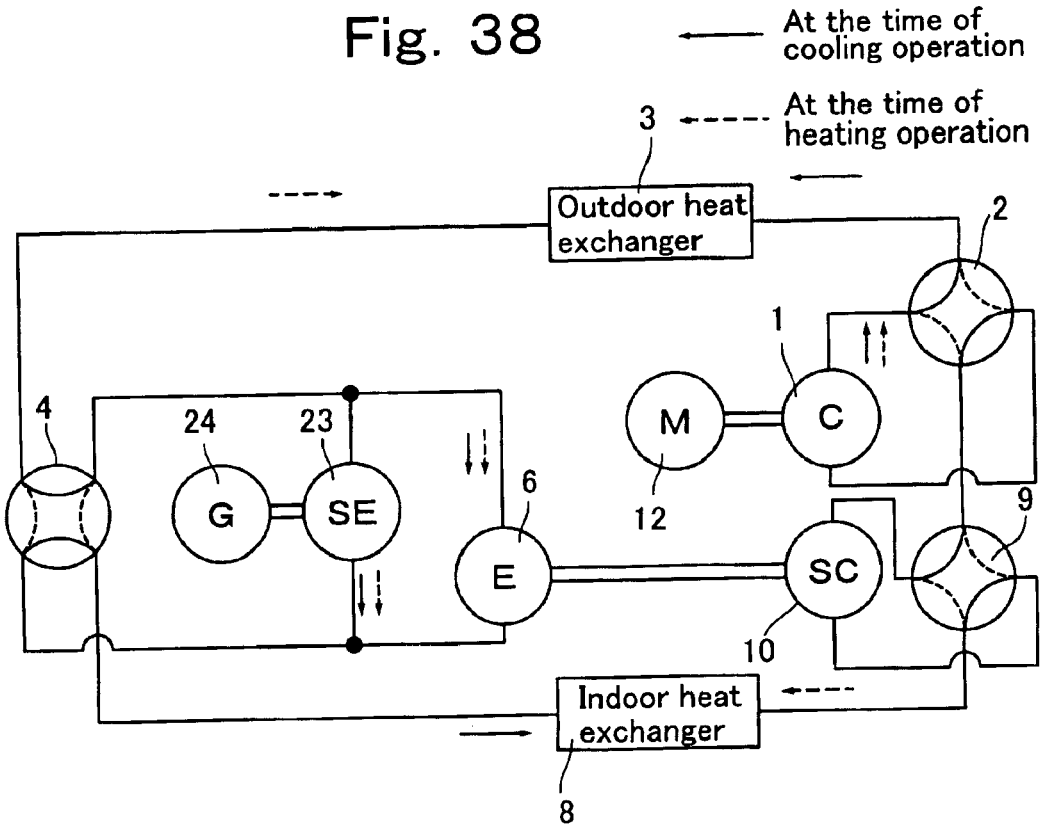
FIG. 38 shows a structure of a heat pump type cooling and heating air conditioner according to another embodiment of the invention.

FIG. 38 shows a structure of the heat pump type air conditioner of this embodiment.

As shown in FIG. 38, the heat pump type air conditioner of this embodiment uses a $CO_2$ refrigerant as a refrigerant, and comprises a refrigerant circuit in which a compressor 1 having a motor 12, an outdoor heat exchanger 3, an expander 6, an indoor heat exchanger 8 and an auxiliary compressor 10 are connected to one another through pipes.

The refrigerant circuit includes a first four-way valve 2 to which a discharge side pipe and a suction side pipe of the compressor 1 are connected, a second four-way valve 4 to which a discharge side pipe and a suction side pipe of the expander 6 are connected, and a third four-way valve 9 to which a discharge side pipe and a suction side pipe of the auxiliary compressor 10 are connected. When refrigerant flows in a condition that the outdoor heat exchanger 3 is used as a gas cooler and the indoor heat exchanger 8 is used as an evaporator, the first four-way valve 2 and the third four-way valve 9 are switched over so that the discharge side of the auxiliary compressor 10 becomes a suction side of the compressor 1. When refrigerant flows in a condition that the outdoor heat exchanger 3 is used as the evaporator and the indoor heat exchanger 8 is used as the gas cooler, the first four-way valve 2 and the third four-way valve 9 are switched over so that the discharge side of the compressor 1 becomes a suction side of the auxiliary compressor 10. By switching of the second four-way valve 4, a direction of the refrigerant flowing through the expander 6 becomes always the same direction.

A bypass circuit for bypassing the expander 6 is provided in parallel to the expander 6. The bypass circuit is provided with a sub-expander 21. An electric generator 22 is connected to a drive shaft of the sub-expander 21. The bypass circuit is connected to the second four-way valve 4 like the expander 6.

A drive shaft of the expander 6 and a drive shaft of the auxiliary compressor 10 are connected to each other, and the auxiliary compressor 10 is driven by power recover by the expander 6.

The operation of the heat pump type cooling and heating air conditioner of this embodiment will be explained.

First, a cooling operation mode in which the outdoor heat exchanger 3 is used as a gas cooler and the indoor heat exchanger 8 is used as an evaporator will be explained. A flow of the refrigerant in the cooling operation mode is shown with solid arrows in the drawing.

Refrigerant at the time of the cooling operation mode is compressed at a high temperature and under a high pressure and is discharged by the compressor 1 which is driven by the motor 12. The refrigerant is introduced into the outdoor heat exchanger 3. In the outdoor heat exchanger 3, since $CO_2$ refrigerant is in a supercritical state, the refrigerant is not brought into two-phase state, and dissipates heat to outside fluid such as air and water. Then, the $CO_2$ refrigerant is introduced into the expander 6 and the sub-expander 21 through the second four-way valve 4 and is expanded by the expander 6 or the sub-expander 21. Power recover by the expander 6 at the time of expanding operation is used for driving the auxiliary compressor 10. At that time, an optimal amount of refrigerant flowing into the expander 6 is calculated from a high pressure refrigerant temperature and a high pressure refrigerant pressure detected on the side of an outlet of the outdoor heat exchanger 3. If the volume flow rate is greater than the calculated optimal refrigerant amount, torque of the electric generator 22 (load of the electric generator) is reduced to increase the amount of refrigerant which is allowed to flow into the bypass circuit, thereby reducing the volume flow rate of refrigerant flowing into the expander 6. If the optimal amount of refrigerant flowing into the expander 6 is smaller than the calculated optimal refrigerant amount, torque of the electric generator 22 (load of the electric generator) is increased to reduce the amount of refrigerant flowing into the bypass circuit, thereby increasing the volume flow rate of refrigerant flowing into the expander 6.

The $CO_2$ refrigerant expanded by the sub-expander 21 and the expander 6 is introduced into the indoor heat exchanger 8 through the second four-way valve 4, and is evaporated and suctions heat in the indoor heat exchanger 8.

A room is cooled by the endotherm. The refrigerant which has been evaporated is introduced into the auxiliary compressor 10 through the second four-way valve 9 and supercharged by the auxiliary compressor 10 and drawn into the compressor 1.

Next, a heating operation mode in which the outdoor heat exchanger 3 is used as the evaporator and the indoor heat exchanger 8 is used as the gas cooler will be explained. A flow of a refrigerant in this heating operation mode is shown with dashed arrows in the drawing.

Refrigerant at the time of the heating operation mode is compressed at a high temperature and under a high pressure and is discharged by the compressor 1 which is driven by the motor 12, and is introduced into the auxiliary compressor 10 through the first four-way valve 2 and the third four-way valve 9 and is further super-pressurized by the auxiliary compressor 10. The refrigerant super-charged by the auxiliary compressor 10 is introduced into the indoor heat exchanger 8 through the third four-way valve 9. In the indoor heat exchanger 8, since $CO_2$ refrigerant is in a supercritical state, the refrigerant is not brought into two-phase state, and dissipates heat to outside fluid such as air and water. A room is heated utilizing this radiation. Then, the $CO_2$ refrigerant is introduced into the expander 6 and the sub-expander 21 through the second four-way valve 4, and is expanded by the expander 6 and the sub-expander 23. Power recover by the expander 6 at the time of expanding operation is used for driving the auxiliary compressor 10. At that time, an optimal amount of refrigerant flowing into the expander 6 is calculated from a high pressure refrigerant temperature and a high pressure refrigerant pressure detected on the side of an outlet of the indoor heat exchanger 8. If the volume flow rate is greater than the calculated optimal refrigerant amount, torque of the electric generator 22 (load of the electric generator) is reduced to increase the amount of refrigerant which is allowed to flow into the bypass circuit, thereby reducing the volume flow rate of refrigerant flowing into the expander 6. If the optimal amount of refrigerant flowing into the expander 6 is smaller than the calculated optimal refrigerant amount, torque of the electric generator 22 (load of the electric generator) is increased to reduce the volume flow rate of refrigerant flowing into the expander 6.

The $CO_2$ refrigerant expanded by the expander 6 and the sub-expander 21 is introduced into the outdoor heat exchanger 3 through the second four-way valve 4, and is evaporated and suctions heat in the outdoor heat exchanger 3. The refrigerant which has been evaporated is drawn into the compressor 1 through the first four-way valve 2.

As described above, according to this embodiment, the torque of the electric generator 22 (i.e., load of the electric generator) connected to the sub-expander 21 is changed to adjust the amount of refrigerant flowing through the bypass circuit, thereby controlling the amount of refrigerant flowing through the expander 6. Therefore, it is possible to efficiently recover power in the expander 6. During the control of the flow rate of the bypass system, power recover from the sub-expander 21 is utilized for generating electricity of the electric generator 22, and it is possible to recover more power from the refrigeration cycle.

Further, according to this embodiment, the compressor 1 which compresses refrigerant and the expander 6 and the auxiliary compressor 10 which recover the power are separated from each other. The refrigeration cycle is switched such that the refrigerant is supercharged by the auxiliary compressor 10 at the time of the cooling operation mode, and the refrigerant is super-pressurized at the time of the heating operation mode. With this structure, it is possible to allow the expander 6 to operate as a supercharging type expander which is suitable for cooling, and as a super-pressurizing type expander which is suitable for heating.

A refrigeration cycle apparatus of another embodiment of the present invention will be explained with reference to the drawing.

Figure 39:
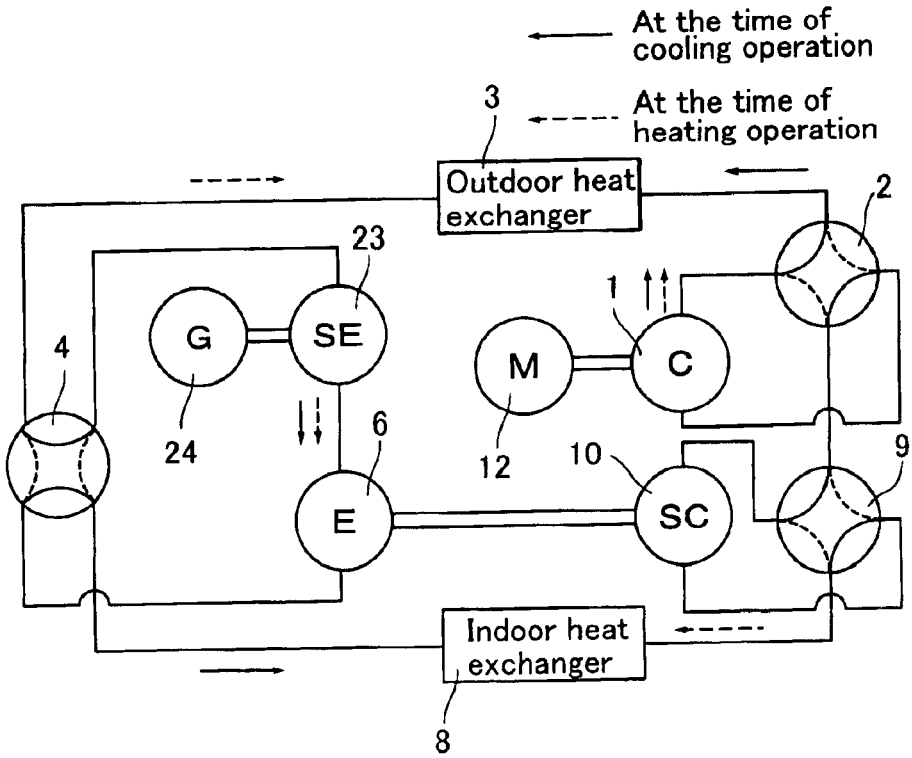
FIG. 39 shows a structure of a heat pump type cooling and heating air conditioner according to another embodiment of the invention.

FIG. 39 shows a structure of the heat pump type air conditioner of this embodiment.

As shown in FIG. 39, the heat pump type air conditioner of this embodiment uses a $CO_2$ refrigerant as a refrigerant, and comprises a refrigerant circuit in which a compressor 1 having a motor 12, an outdoor heat exchanger 3, an expander 6, an indoor heat exchanger 8 and an auxiliary compressor 10 are connected to one another through pipes.

The expander 6 is provided at its inflow side with a sub-expander 23 and an electric generator 24 is connected to a drive shaft of the sub-expander 23.

A drive shaft of the expander 6 and a drive shaft of the auxiliary compressor 10 are connected to each other, and the auxiliary compressor 10 is driven by power recover by the expander 6.

The refrigerant circuit includes a first four-way valve 2 to which a discharge side pipe and a suction side pipe of the compressor 1 are connected, a second four-way valve 4 to which a discharge side pipe and a suction side pipe of the expander 6 are connected, and a third four-way valve 9 to which a discharge side pipe and a suction side pipe of the auxiliary compressor 10 are connected. When refrigerant flows in a condition that the outdoor heat exchanger 3 is used as a gas cooler and the indoor heat exchanger 8 is used as an evaporator, the first four-way valve 2 and the third four-way valve 9 are switched over so that the discharge side of the auxiliary compressor 10 becomes a suction side of the compressor 1. When refrigerant flows in a condition that the outdoor heat exchanger 3 is used as the evaporator and the indoor heat exchanger 8 is used as the gas cooler, the first four-way valve 2 and the third four-way valve 9 are switched over so that the discharge side of the compressor 1 becomes a suction side of the auxiliary compressor 10. By switching of the second four-way valve 4, a direction of the refrigerant flowing through the expander 6 becomes always the same direction.

The operation of the heat pump type cooling and heating air conditioner of this embodiment will be explained.

First, a cooling operation mode in which the outdoor heat exchanger 3 is used as a gas cooler and the indoor heat exchanger 8 is used as an evaporator will be explained. A flow of the refrigerant in the cooling operation mode is shown with solid arrows in the drawing.

Refrigerant at the time of the cooling operation mode is compressed at a high temperature and under a high pressure and is discharged by the compressor 1 which is driven by the motor 12. The refrigerant is introduced into the outdoor heat exchanger 3. In the outdoor heat exchanger 3, since $CO_2$ refrigerant is in a supercritical state, the refrigerant is not brought into two-phase state, and dissipates heat to outside fluid such as air and water. Then, the $CO_2$ refrigerant is introduced into the sub-expander 23 and the expander 6 through the second four-way valve 4 and is expanded by the sub-expander 23 and the expander 6. Power recover by the expander 6 at the time of expanding operation is used for driving the auxiliary compressor 10. At that time, an optimal amount of refrigerant flowing into the expander 6 is calculated from a high pressure refrigerant temperature and a high pressure refrigerant pressure detected on the side of an outlet of the outdoor heat exchanger 3. If the volume flow rate is smaller than the calculated optimal refrigerant amount, torque of the electric generator 24 (load of the electric generator) is increased to increase the high pressure side pressure, thereby increasing the volume flow rate of refrigerant flowing into the expander 6. If the optimal amount of refrigerant flowing into the expander 6 is greater than the calculated optimal refrigerant amount, torque of the electric generator 24 (load of the electric generator) is reduced to reduce the high pressure side pressure, thereby reducing the volume flow rate of refrigerant flowing into the expander 6.

The $CO_2$ refrigerant expanded by the sub-expander 23 and the expander 6 is introduced into the indoor heat exchanger 8 through the second four-way valve 4, and is evaporated and suctions heat in the indoor heat exchanger 8. A room is cooled by the endotherm. The refrigerant which has been evaporated is introduced into the auxiliary compressor 10 through the second four-way valve 9 and supercharged by the auxiliary compressor 10 and drawn into the compressor 1.

Next, a heating operation mode in which the outdoor heat exchanger 3 is used as the evaporator and the indoor heat exchanger 8 is used as the gas cooler will be explained. A flow of a refrigerant in this heating operation mode is shown with dashed arrows in the drawing.

Refrigerant at the time of the heating operation mode is compressed at a high temperature and under a high pressure and is discharged by the compressor 1 which is driven by the motor 12, and is introduced into the auxiliary compressor 10 through the first four-way valve 2 and the third four-way valve 9 and is further super-pressurized by the auxiliary compressor 10. The refrigerant super-charged by the auxiliary compressor 10 is introduced into the indoor heat exchanger 8 through the third four-way valve 9. In the indoor heat exchanger 8, since $CO_2$ refrigerant is in a supercritical state, the refrigerant is not brought into two-phase state, and dissipates heat to outside fluid such as air and water. A room is heated utilizing this radiation. Then, the $CO_2$ refrigerant is introduced into the sub-expander 23 and the expander 6 through the second four-way valve 4, and is expanded by the sub-expander 23 and the expander 6. Power recover by the expander 6 at the time of expanding operation is used for driving the auxiliary compressor 10. At that time, an optimal amount of refrigerant flowing into the expander 6 is calculated from a high pressure refrigerant temperature and a high pressure refrigerant pressure detected on the side of an outlet of the indoor heat exchanger 8. If the volume flow rate is smaller than the calculated optimal refrigerant amount, torque of the electric generator 24 (load of the electric generator) is increased to increase the high pressure side pressure, thereby increasing the volume flow rate of refrigerant flowing into the expander 6. If the optimal amount of refrigerant flowing into the expander 6 is greater than the calculated optimal refrigerant amount, torque of the electric generator 24 (load of the electric generator) is reduced to reduce the high pressure side pressure, thereby reducing the volume flow rate of refrigerant flowing into the expander 6.

The $CO_2$ refrigerant expanded by the sub-expander 23 and the expander 6 is evaporated and suctions heat in the outdoor heat exchanger 3. The refrigerant which has been evaporated is drawn into the compressor 1 through the first four-way valve 2.

As described above, according to this embodiment, the torque of the electric generator 24 (i.e., load of the electric generator) connected to the sub-expander 23 is changed to adjust the high pressure side pressure, thereby controlling the amount of refrigerant flowing through the expander 6. Therefore, it is possible to efficiently recover power in the expander 6. Power recover from the sub-expander 23 is utilized for generating electricity of the electric generator 24, and it is possible to recover more power from the refrigeration cycle.

Further, according to this embodiment, the compressor 1 which compresses refrigerant and the expander 6 and the auxiliary compressor 10 which recover the power are separated from each other. The refrigeration cycle is switched such that the refrigerant is supercharged by the auxiliary compressor 10 at the time of the cooling operation mode, and the refrigerant is super-pressurized at the time of the heating operation mode. With this structure, it is possible to allow the expander 6 to operate as a supercharging type expander which is suitable for cooling, and as a super-pressurizing type expander which is suitable for heating.

A refrigeration cycle apparatus of another embodiment of the present invention will be explained with reference to the drawing.

Figure 40:
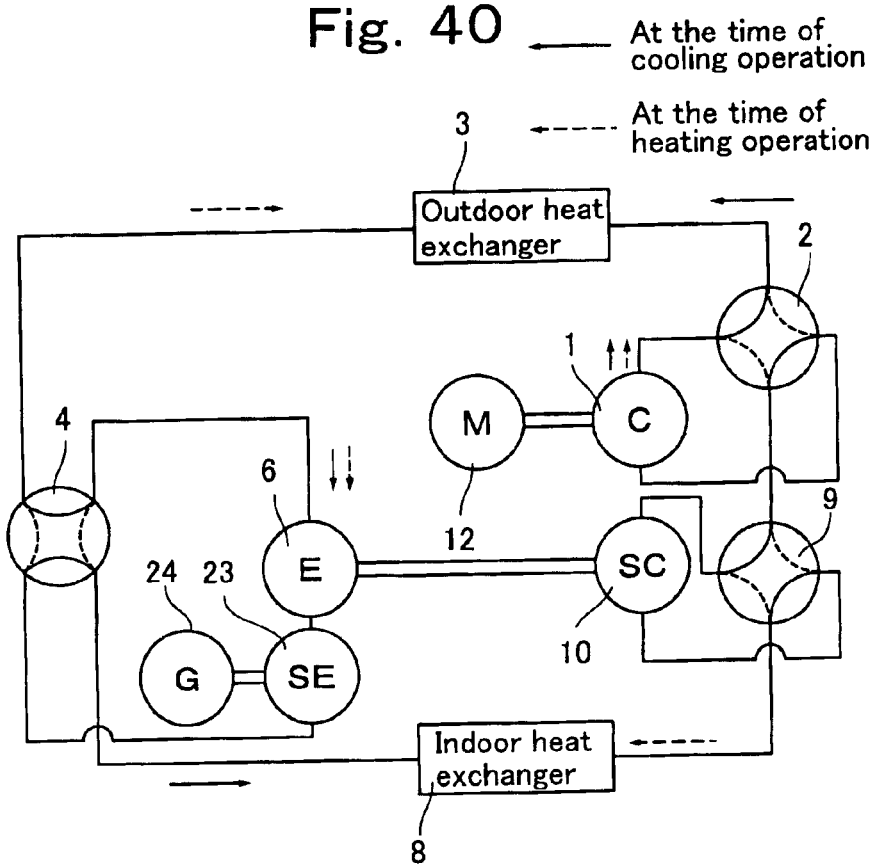
FIG. 40 shows a structure of a heat pump type cooling and heating air conditioner according to another embodiment of the invention.

FIG. 40 shows a structure of the heat pump type air conditioner of this embodiment.

As shown in FIG. 40, the heat pump type air conditioner of this embodiment uses a $CO_2$ refrigerant as a refrigerant, and comprises a refrigerant circuit in which a compressor 1 having a motor 12, an outdoor heat exchanger 3, an expander 6, an indoor heat exchanger 8 and an auxiliary compressor 10 are connected to one another through pipes.

The expander 6 is provided at its discharge side with a sub-expander 23 and an electric generator 24 is connected to a drive shaft of the sub-expander 23.

A drive shaft of the expander 6 and a drive shaft of the auxiliary compressor 10 are connected to each other, and the auxiliary compressor 10 is driven by power recover by the expander 6.

The refrigerant circuit includes a first four-way valve 2 to which a discharge side pipe and a suction side pipe of the compressor 1 are connected, a second four-way valve 4 to which a discharge side pipe and a suction side pipe of the expander 6 are connected, and a third four-way valve 9 to which a discharge side pipe and a suction side pipe of the auxiliary compressor 10 are connected. When refrigerant flows in a condition that the outdoor heat exchanger 3 is used as a gas cooler and the indoor heat exchanger 8 is used as an evaporator, the first four-way valve 2 and the third four-way valve 9 are switched over so that the discharge side of the auxiliary compressor 10 becomes a suction side of the compressor 1. When refrigerant flows in a condition that the outdoor heat exchanger 3 is used as the evaporator and the indoor heat exchanger 8 is used as the gas cooler, the first four-way valve 2 and the third four-way valve 9 are switched over so that the discharge side of the compressor 1 becomes a suction side of the auxiliary compressor 10. By switching of the second four-way valve 4, a direction of the refrigerant flowing through the expander 6 becomes always the same direction.

The operation of the heat pump type cooling and heating air conditioner of this embodiment will be explained.

First, a cooling operation mode in which the outdoor heat exchanger 3 is used as a gas cooler and the indoor heat exchanger 8 is used as an evaporator will be explained. A flow of the refrigerant in the cooling operation mode is shown with solid arrows in the drawing.

Refrigerant at the time of the cooling operation mode is compressed at a high temperature and under a high pressure and is discharged by the compressor 1 which is driven by the motor 12. The refrigerant is introduced into the outdoor heat exchanger 3. In the outdoor heat exchanger 3, since $CO_2$ refrigerant is in a supercritical state, the refrigerant is not brought into two-phase state, and dissipates heat to outside fluid such as air and water. Then, the $CO_2$ refrigerant is introduced into the expander 6 and the sub-expander 23 through the second four-way valve 4 and is expanded by the expander 6 and the sub-expander 23. Power recover by the expander 6 at the time of expanding operation is used for driving the auxiliary compressor 10. At that time, an optimal amount of refrigerant flowing into the expander 6 is calculated from a high pressure refrigerant temperature and a high pressure refrigerant pressure detected on the side of an outlet of the outdoor heat exchanger 3. If the volume flow rate is smaller than the calculated optimal refrigerant amount, torque of the electric generator 22 (load of the electric generator) is increased to reduce the low pressure side pressure, thereby increasing the volume flow rate of refrigerant flowing into the expander 6. If the optimal amount of refrigerant flowing into the expander 6 is greater than the calculated optimal refrigerant amount, torque of the electric generator 22 (load of the electric generator) is reduced to increase the low pressure side pressure, thereby reducing the volume flow rate of refrigerant flowing into the expander 6.

The $CO_2$ refrigerant expanded by the expander 6 and the sub-expander 23 is introduced into the indoor heat exchanger 8 through the second four-way valve 4, and is evaporated and suctions heat in the indoor heat exchanger 8. A room is cooled by the endotherm. The refrigerant which has been evaporated is introduced into the auxiliary compressor 10 through the second four-way valve 9 and supercharged by the auxiliary compressor 10 and drawn into the compressor 1.

Next, a heating operation mode in which the outdoor heat exchanger 3 is used as the evaporator and the indoor heat exchanger 8 is used as the gas cooler will be explained. A flow of a refrigerant in this heating operation mode is shown with dashed arrows in the drawing.

Refrigerant at the time of the heating operation mode is compressed at a high temperature and under a high pressure and is discharged by the compressor 1 which is driven by the motor 12, and is introduced into the auxiliary compressor 10 through the first four-way valve 2 and the third four-way valve 9 and is further super-pressurized by the auxiliary compressor 10. The refrigerant super-charged by the auxiliary compressor 10 is introduced into the indoor heat exchanger 8 through the third four-way valve 9. In the indoor heat exchanger 8, since $CO_2$ refrigerant is in a supercritical state, the refrigerant is not brought into two-phase state, and dissipates heat to outside fluid such as air and water. A room is heated utilizing this radiation. Then, the $CO_2$ refrigerant is introduced into the expander 6 and the sub-expander 23 through the second four-way valve 4, and is expanded by the expander 6 and the sub-expander 23. Power recover by the expander 6 at the time of expanding operation is used for driving the auxiliary compressor 10. At that time, an optimal amount of refrigerant flowing into the expander 6 is calculated from a high pressure refrigerant temperature and a high pressure refrigerant pressure detected on the side of an outlet of the indoor heat exchanger 8. If the volume flow rate is smaller than the calculated optimal refrigerant amount, torque of the electric generator 22 (load of the electric generator) is increased to reduce the low pressure side pressure, thereby increasing the volume flow rate of refrigerant flowing into the expander 6. If the optimal amount of refrigerant flowing into the expander 6 is greater than the calculated optimal refrigerant amount, torque of the electric generator 22 (load of the electric generator) is reduced to increase the low pressure side pressure, thereby reducing the volume flow rate of refrigerant flowing into the expander 6.

The $CO_2$ refrigerant expanded by the expander 6 and the sub-expander 23 is evaporated and suctions heat in the outdoor heat exchanger 3. The refrigerant which has been evaporated is drawn into the compressor 1 through the first four-way valve 2.

As described above, according to this embodiment, the torque of the electric generator 22 (i.e., load of the electric generator) connected to the sub-expander 23 is changed to adjust the low pressure side pressure, thereby controlling the amount of refrigerant flowing through the expander 6. Therefore, it is possible to efficiently recover power in the expander 6. Power recover from the sub-expander 23 is utilized for generating electricity of the electric generator 24, and it is possible to recover more power from the refrigeration cycle.

Further, according to this embodiment, the compressor 1 which compresses refrigerant and the expander 6 and the auxiliary compressor 10 which recover the power are separated from each other. The refrigeration cycle is switched such that the refrigerant is supercharged by the auxiliary compressor 10 at the time of the cooling operation mode, and the refrigerant is super-pressurized at the time of the heating operation mode. With this structure, it is possible to allow the expander 6 to operate as a supercharging type expander which is suitable for cooling, and as a super-pressurizing type expander which is suitable for heating.

A refrigeration cycle apparatus of another embodiment of the present invention will be explained with reference to the drawing.

Figure 41:
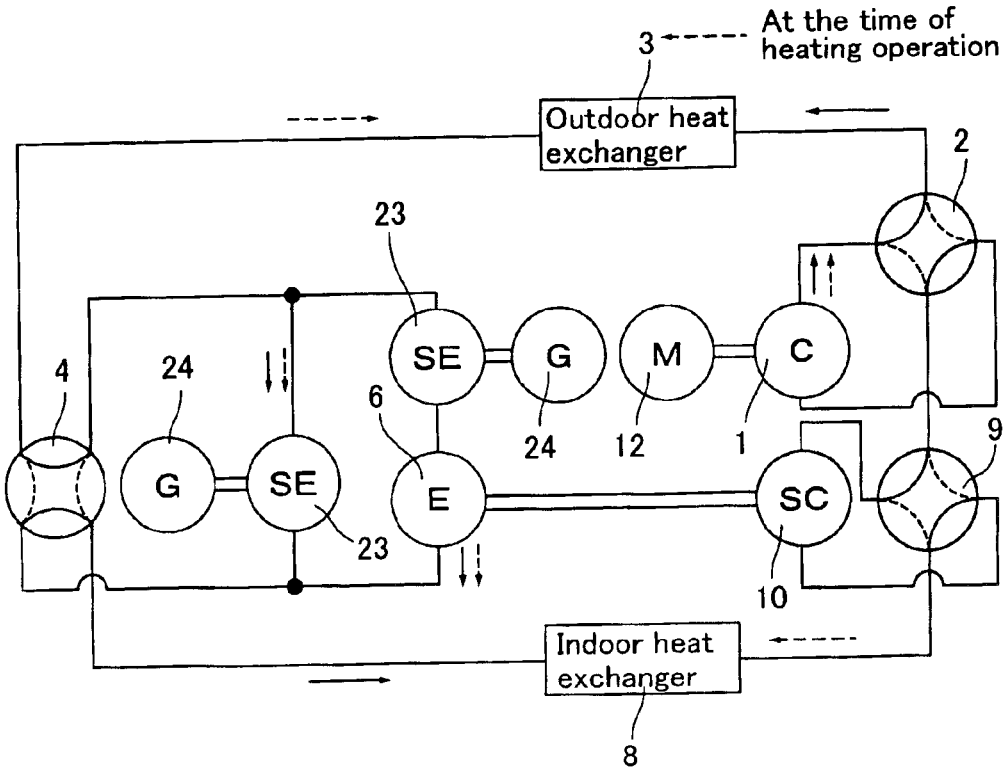
FIG. 41 shows a structure of a heat pump type cooling and heating air conditioner according to another embodiment of the invention.

FIG. 41 shows a structure of the heat pump type air conditioner of this embodiment.

As shown in FIG. 41, the heat pump type air conditioner of this embodiment uses a $CO_2$ refrigerant as a refrigerant, and comprises a refrigerant circuit in which a compressor 1 having a motor 12, an outdoor heat exchanger 3, an expander 6, an indoor heat exchanger 8 and an auxiliary compressor 10 are connected to one another through pipes.

The expander 6 is provided at its inflow side with a sub-expander 23 and an electric generator 24 is connected to a drive shaft of the sub-expander 23.

A bypass circuit for bypassing the sub-expander 23 and the expander 6 is provided in parallel to the sub-expander 23 and the expander 6. The bypass circuit is provided with a sub-expander 21. An electric generator 22 is connected to a drive shaft of the sub-expander 21. The bypass circuit is connected to the second four-way valve 4 like the sub-expander 23 and the expander 6.

A drive shaft of the expander 6 and a drive shaft of the auxiliary compressor 10 are connected to each other, and the auxiliary compressor 10 is driven by power recover by the expander 6.

The refrigerant circuit includes a first four-way valve 2 to which a discharge side pipe and a suction side pipe of the compressor 1 are connected, a second four-way valve 4 to which a discharge side pipe and a suction side pipe of the expander 6 are connected, and a third four-way valve 9 to which a discharge side pipe and a suction side pipe of the auxiliary compressor 10 are connected. When refrigerant flows in a condition that the outdoor heat exchanger 3 is used as a gas cooler and the indoor heat exchanger 8 is used as an evaporator, the first four-way valve 2 and the third four-way valve 9 are switched over so that the discharge side of the auxiliary compressor 10 becomes a suction side of the compressor 1. When refrigerant flows in a condition that the outdoor heat exchanger 3 is used as the evaporator and the indoor heat exchanger 8 is used as the gas cooler, the first four-way valve 2 and the third four-way valve 9 are switched over so that the discharge side of the compressor 1 becomes a suction side of the auxiliary compressor 10. By switching of the second four-way valve 4, a direction of the refrigerant flowing through the expander 6 becomes always the same direction.

The operation of the heat pump type cooling and heating air conditioner of this embodiment will be explained.

First, a cooling operation mode in which the outdoor heat exchanger 3 is used as a gas cooler and the indoor heat exchanger 8 is used as an evaporator will be explained. A flow of the refrigerant in the cooling operation mode is shown with solid arrows in the drawing.

Refrigerant at the time of the cooling operation mode is compressed at a high temperature and under a high pressure and is discharged by the compressor 1 which is driven by the motor 12. The refrigerant is introduced into the outdoor heat exchanger 3. In the outdoor heat exchanger 3, since $CO_2$ refrigerant is in a supercritical state, the refrigerant is not brought into two-phase state, and dissipates heat to outside fluid such as air and water. Then, the $CO_2$ refrigerant is introduced into the sub-expander 23, the expander 6 and the sub-expander 21 and is expanded by the sub-expander 23, the expander 6 and the sub-expander 21. Power recover by the expander 6 at the time of expanding operation is used for driving the auxiliary compressor 10. At that time, an optimal amount of refrigerant flowing into the expander 6 is calculated from a high pressure refrigerant temperature and a high pressure refrigerant pressure detected on the side of an outlet of the outdoor heat exchanger 3. If the volume flow rate is greater than the calculated optimal refrigerant amount, torque of the electric generator 22 (load of the electric generator) is reduced to increase the amount of refrigerant flowing into the bypass circuit, thereby reducing the volume flow rate of refrigerant flowing into the expander 6. If the optimal amount of refrigerant flowing into the expander 6 is smaller than the calculated optimal refrigerant amount, torque of the electric generator 24 (load of the electric generator) is increased to increase the high pressure side pressure, thereby increasing the volume flow rate of refrigerant flowing into the expander 6.

The $CO_2$ refrigerant expanded by the sub-expander 23 and the expander 6 or the $CO_2$ refrigerant expanded by the sub-expander 21 is introduced into the indoor heat exchanger 8 through the second four-way valve 4, and is evaporated and suctions heat in the indoor heat exchanger 8. A room is cooled by the endotherm. The refrigerant which has been evaporated is introduced into the auxiliary compressor 10 through the second four-way valve 9 and supercharged by the auxiliary compressor 10 and drawn into the compressor 1.

Next, a heating operation mode in which the outdoor heat exchanger 3 is used as the evaporator and the indoor heat exchanger 8 is used as the gas cooler will be explained. A flow of a refrigerant in this heating operation mode is shown with dashed arrows in the drawing.

Refrigerant at the time of the heating operation mode is compressed at a high temperature and under a high pressure and is discharged by the compressor 1 which is driven by the motor 12, and is introduced into the auxiliary compressor 10 through the first four-way valve 2 and the third four-way valve 9 and is further super-pressurized by the auxiliary compressor 10. The refrigerant super-charged by the auxiliary compressor 10 is introduced into the indoor heat exchanger 8 through the third four-way valve 9. In the indoor heat exchanger 8, since $CO_2$ refrigerant is in a supercritical state, the refrigerant is not brought into two-phase state, and dissipates heat to outside fluid such as air and water. A room is heated utilizing this radiation. Then, the $CO_2$ refrigerant is introduced into the sub-expander 23, the expander 6 and the sub-expander 21 and is expanded by the sub-expander 23, the expander 6 and the sub-expander 21. Power recover by the expander 6 at the time of expanding operation is used for driving the auxiliary compressor 10. At that time, an optimal amount of refrigerant flowing into the expander 6 is calculated from a high pressure refrigerant temperature and a high pressure refrigerant pressure detected on the side of an outlet of the indoor heat exchanger 8. If the volume flow rate is greater than the calculated optimal refrigerant amount, torque of the electric generator 22 (load of the electric generator) is reduced to increase the amount of refrigerant flowing into the bypass circuit, thereby reducing the volume flow rate of refrigerant flowing into the expander 6. If the optimal amount of refrigerant flowing into the expander 6 is smaller than the calculated optimal refrigerant amount, torque of the electric generator 24 (load of the electric generator) is increased to increase the high pressure side pressure, thereby increasing the volume flow rate of refrigerant flowing into the expander 6.

The $CO_2$ refrigerant expanded by the sub-expander 23 and the expander 6 or the $CO_2$ refrigerant expanded by the sub-expander 21 is introduced into the outdoor heat exchanger 3 through the second four-way valve 4, and is evaporated and suctions heat in the outdoor heat exchanger 3. The refrigerant which has been evaporated is drawn into the compressor 1 through the first four-way valve 2.

As described above, according to this embodiment, the torque of the electric generator 22 (i.e., load of the electric generator) connected to the sub-expander 21 is changed to adjust the amount of refrigerant flowing through the bypass circuit, thereby controlling the amount of refrigerant flowing through the expander 6, and torque of the electric generator 24 (i.e., load of the electric generator) connected to the sub-expander 23 is changed to adjust the high pressure side pressure, thereby controlling the amount of refrigerant flowing through the expander 6. Therefore, it is possible to efficiently recover power in the expander 6. Power recover from the sub-expander 21 and the sub-expander 23 is utilized for generating electricity of the electric generators 22 and 24, and it is possible to recover more power from the refrigeration cycle.

Further, according to this embodiment, the compressor 1 which compresses refrigerant and the expander 6 and the auxiliary compressor 10 which recover the power are separated from each other. The refrigeration cycle is switched such that the refrigerant is supercharged by the auxiliary compressor 10 at the time of the cooling operation mode, and the refrigerant is super-pressurized at the time of the heating operation mode. With this structure, it is possible to allow the expander 6 to operate as a supercharging type expander which is suitable for cooling, and as a super-pressurizing type expander which is suitable for heating.

A refrigeration cycle apparatus of another embodiment of the present invention will be explained with reference to the drawing.

Figure 42:
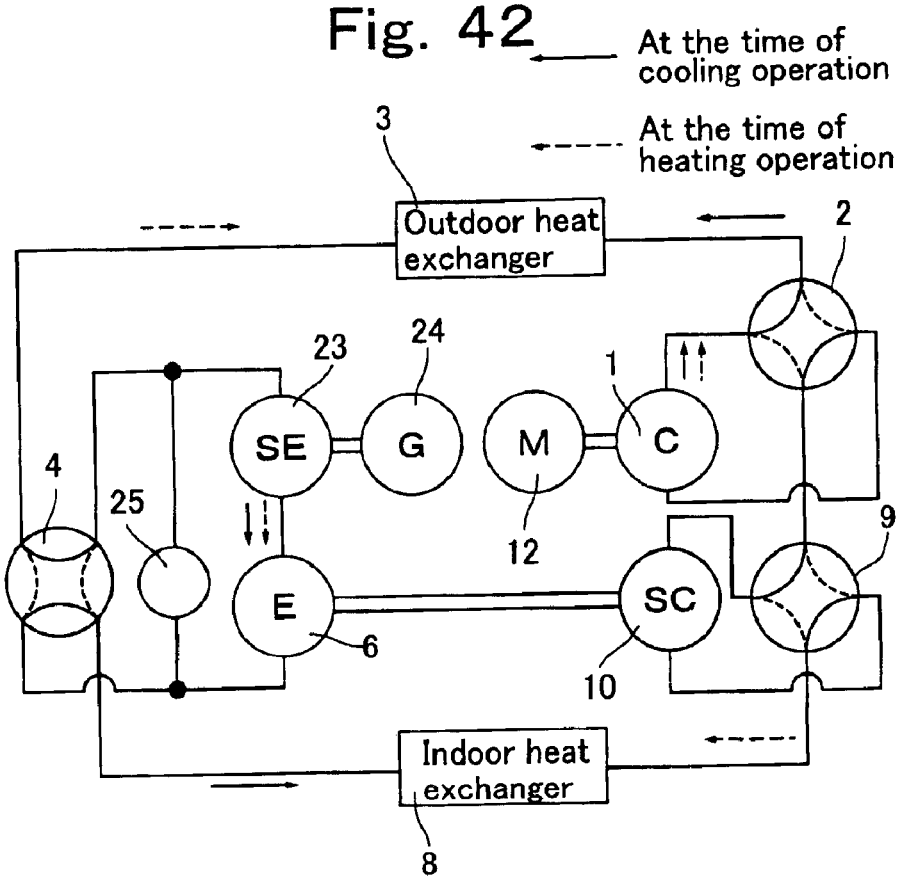
FIG. 42 shows a structure of a heat pump type cooling and heating air conditioner according to another embodiment of the invention.

FIG. 42 shows a structure of the heat pump type air conditioner of this embodiment.

As shown in FIG. 42, the heat pump type air conditioner of this embodiment uses a $CO_2$ refrigerant as a refrigerant, and comprises a refrigerant circuit in which a compressor 1 having a motor 12, an outdoor heat exchanger 3, an expander 6, an indoor heat exchanger 8 and an auxiliary compressor 10 are connected to one another through pipes.

The expander 6 is provided at its inflow side with a sub-expander 23 and an electric generator 24 is connected to a drive shaft of the sub-expander 23.

A bypass circuit for bypassing the sub-expander 23 and the expander 6 is provided in parallel to the sub-expander 23 and the expander 6. The bypass circuit is provided with a bypass circuit 7. The bypass circuit is connected to the second four-way valve 4 like the sub-expander 23 and the expander 6.

A drive shaft of the expander 6 and a drive shaft of the auxiliary compressor 10 are connected to each other, and the auxiliary compressor 10 is driven by power recover by the expander 6.

The refrigerant circuit includes a first four-way valve 2 to which a discharge side pipe and a suction side pipe of the compressor 1 are connected, a second four-way valve 4 to which a discharge side pipe and a suction side pipe of the expander 6 are connected, and a third four-way valve 9 to which a discharge side pipe and a suction side pipe of the auxiliary compressor 10 are connected. When refrigerant flows in a condition that the outdoor heat exchanger 3 is used as a gas cooler and the indoor heat exchanger 8 is used as an evaporator, the first four-way valve 2 and the third four-way valve 9 are switched over so that the discharge side of the auxiliary compressor 10 becomes a suction side of the compressor 1. When refrigerant flows in a condition that the outdoor heat exchanger 3 is used as the evaporator and the indoor heat exchanger 8 is used as the gas cooler, the first four-way valve 2 and the third four-way valve 9 are switched over so that the discharge side of the compressor 1 becomes a suction side of the auxiliary compressor 10. By switching of the second four-way valve 4, a direction of the refrigerant flowing through the expander 6 becomes always the same direction.

The operation of the heat pump type cooling and heating air conditioner of this embodiment will be explained.

First, a cooling operation mode in which the outdoor heat exchanger 3 is used as a gas cooler and the indoor heat exchanger 8 is used as an evaporator will be explained. A flow of the refrigerant in the cooling operation mode is shown with solid arrows in the drawing.

Refrigerant at the time of the cooling operation mode is compressed at a high temperature and under a high pressure and is discharged by the compressor 1 which is driven by the motor 12. The refrigerant is introduced into the outdoor heat exchanger 3. In the outdoor heat exchanger 3, since $CO_2$ refrigerant is in a supercritical state, the refrigerant is not brought into two-phase state, and dissipates heat to outside fluid such as air and water. Then, the $CO_2$ refrigerant is introduced into the sub-expander 23 and the expander 6 and is expanded by the sub-expander 23 and the expander 6. Power recover by the expander 6 at the time of expanding operation is used for driving the auxiliary compressor 10. At that time, an optimal amount of refrigerant flowing into the expander 6 is calculated from a high pressure refrigerant temperature and a high pressure refrigerant pressure detected on the side of an outlet of the outdoor heat exchanger 3. If the volume flow rate is greater than the calculated optimal refrigerant amount, the opening of the bypass valve 7 is increased to increase the amount of refrigerant flowing into the bypass circuit, thereby reducing the volume flow rate of refrigerant flowing into the expander 6. If the optimal amount of refrigerant flowing into the expander 6 is smaller than the calculated optimal refrigerant amount, torque of the electric generator 24 (load of the electric generator) is increased to increase the high pressure side pressure, thereby increasing the volume flow rate of refrigerant flowing into the expander 6.

The $CO_2$ refrigerant expanded by the sub-expander 23 and the expander 6 is introduced into the indoor heat exchanger 8 through the second four-way valve 4, and is evaporated and suctions heat in the indoor heat exchanger 8. A room is cooled by the endotherm. The refrigerant which has been evaporated is introduced into the auxiliary compressor 10 through the second four-way valve 9 and super-charged by the auxiliary compressor 10 and drawn into the compressor 1.

Next, a heating operation mode in which the outdoor heat exchanger 3 is used as the evaporator and the indoor heat exchanger 8 is used as the gas cooler will be explained. A flow of a refrigerant in this heating operation mode is shown with dashed arrows in the drawing.

Refrigerant at the time of the heating operation mode is compressed at a high temperature and under a high pressure and is discharged by the compressor 1 which is driven by the motor 12, and is introduced into the auxiliary compressor 10 through the first four-way valve 2 and the third four-way valve 9 and is further super-pressurized by the auxiliary compressor 10. The refrigerant super-charged by the auxiliary compressor 10 is introduced into the indoor heat exchanger 8 through the third four-way valve 9. In the indoor heat exchanger 8, since $CO_2$ refrigerant is in a supercritical state, the refrigerant is not brought into two-phase state, and dissipates heat to outside fluid such as air and water. A room is heated utilizing this radiation. Then, the $CO_2$ refrigerant is introduced into the sub-expander 23 and the expander 6 and is expanded by the sub-expander 23 and the expander 6. Power recover by the expander 6 at the time of expanding operation is used for driving the auxiliary compressor 10. At that time, an optimal amount of refrigerant flowing into the expander 6 is calculated from a high pressure refrigerant temperature and a high pressure refrigerant pressure detected on the side of an outlet of the indoor heat exchanger 8. If the volume flow rate is greater than the calculated optimal refrigerant amount, the opening of the bypass valve 7 is increased to increase the amount of refrigerant flowing into the bypass circuit, thereby reducing the volume flow rate of refrigerant flowing into the expander 6. If the optimal amount of refrigerant flowing into the expander 6 is smaller than the calculated optimal refrigerant amount, torque of the electric generator 24 (load of the electric generator) is increased to increase the high pressure side pressure, thereby increasing the volume flow rate of refrigerant flowing into the expander 6.

The $CO_2$ refrigerant expanded by the sub-expander 23 and the expander 6 is introduced into the outdoor heat exchanger 3 through the second four-way valve 4, and is evaporated and suctions heat in the outdoor heat exchanger 3. The refrigerant which has been evaporated is drawn into the compressor 1 through the first four-way valve 2.

As described above, according to this embodiment, the opening of the bypass valve 7 is changed to adjust the amount of refrigerant flowing through the bypass circuit, thereby controlling the amount of refrigerant flowing through the expander 6, and torque of the electric generator 24 (i.e., load of the electric generator) connected to the sub-expander 23 is changed to adjust the high pressure side pressure, thereby controlling the amount of refrigerant flowing through the expander 6. Therefore, it is possible to efficiently recover power in the expander 6. Power recover from the sub-expander 23 is utilized for generating electricity of the electric generator 24, and it is possible to recover more power from the refrigeration cycle.

Further, according to this embodiment, the compressor 1 which compresses refrigerant and the expander 6 and the auxiliary compressor 10 which recover the power are separated from each other. The refrigeration cycle is switched such that the refrigerant is supercharged by the auxiliary compressor 10 at the time of the cooling operation mode, and the refrigerant is super-pressurized at the time of the heating operation mode. With this structure, it is possible to allow the expander 6 to operate as a supercharging type expander which is suitable for cooling, and as a super-pressurizing type expander which is suitable for heating.

A refrigeration cycle apparatus of another embodiment of the present invention will be explained with reference to the drawing.

Figure 43:
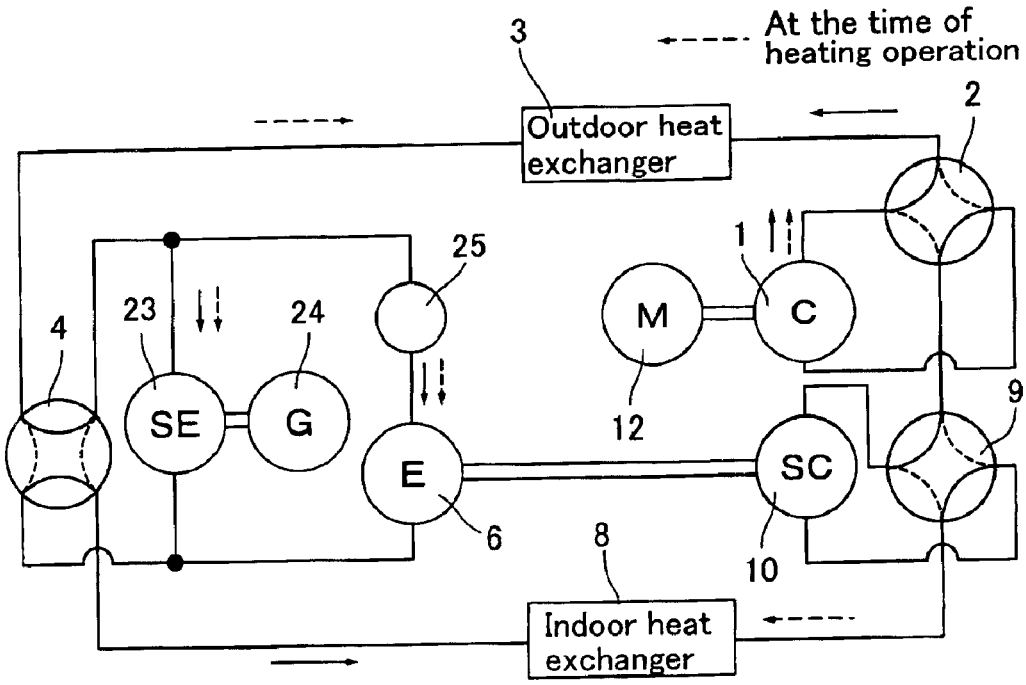
FIG. 43 shows a structure of a heat pump type cooling and heating air conditioner according to another embodiment of the invention.

FIG. 43 shows a structure of the heat pump type air conditioner of this embodiment.

As shown in FIG. 43, the heat pump type air conditioner of this embodiment uses a $CO_2$ refrigerant as a refrigerant, and comprises a refrigerant circuit in which a compressor 1 having a motor 12, an outdoor heat exchanger 3, an expander 6, an indoor heat exchanger 8 and an auxiliary compressor 10 are connected to one another through pipes.

The expander 6 is provided at its inflow side with a pre-expansion valve 5.

A bypass circuit for bypassing the pre-expansion valve 5 and the expander 6 is provided in parallel to the pre-expansion valve 5 and the expander 6. The bypass circuit is provided with a sub-expander 21. The bypass circuit is connected to the second four-way valve 4 like the sub-expander 23 and the expander 6.

A drive shaft of the expander 6 and a drive shaft of the auxiliary compressor 10 are connected to each other, and the auxiliary compressor 10 is driven by power recover by the expander 6.

The refrigerant circuit includes a first four-way valve 2 to which a discharge side pipe and a suction side pipe of the compressor 1 are connected, a second four-way valve 4 to which a discharge side pipe and a suction side pipe of the expander 6 are connected, and a third four-way valve 9 to which a discharge side pipe and a suction side pipe of the auxiliary compressor 10 are connected. When refrigerant flows in a condition that the outdoor heat exchanger 3 is used as a gas cooler and the indoor heat exchanger 8 is used as an evaporator, the first four-way valve 2 and the third four-way valve 9 are switched over so that the discharge side of the auxiliary compressor 10 becomes a suction side of the compressor 1. When refrigerant flows in a condition that the outdoor heat exchanger 3 is used as the evaporator and the indoor heat exchanger 8 is used as the gas cooler, the first four-way valve 2 and the third four-way valve 9 are switched over so that the discharge side of the compressor 1 becomes a suction side of the auxiliary compressor 10. By switching of the second four-way valve 4, a direction of the refrigerant flowing through the expander 6 becomes always the same direction.

The operation of the heat pump type cooling and heating air conditioner of this embodiment will be explained.

First, a cooling operation mode in which the outdoor heat exchanger 3 is used as a gas cooler and the indoor heat exchanger 8 is used as an evaporator will be explained. A flow of the refrigerant in the cooling operation mode is shown with solid arrows in the drawing.

Refrigerant at the time of the cooling operation mode is compressed at a high temperature and under a high pressure and is discharged by the compressor 1 which is driven by the motor 12. The refrigerant is introduced into the outdoor heat exchanger 3. In the outdoor heat exchanger 3, since $CO_2$ refrigerant is in a supercritical state, the refrigerant is not brought into two-phase state, and dissipates heat to outside fluid such as air and water. Then, the $CO_2$ refrigerant is introduced into the pre-expansion valve 5, the expander 6 and the sub-expander 21 and is expanded by the pre-expansion valve 5, the expander 6 and the sub-expander 21. Power recover by the expander 6 at the time of expanding operation is used for driving the auxiliary compressor 10. At that time, an optimal amount of refrigerant flowing into the expander 6 is calculated from a high pressure refrigerant temperature and a high pressure refrigerant pressure detected on the side of an outlet of the outdoor heat exchanger 3. If the volume flow rate is greater than the calculated optimal refrigerant amount, torque of the electric generator 22 (load of electric generator) is reduced to increase the amount of refrigerant flowing into the bypass circuit, thereby reducing the volume flow rate of refrigerant flowing into the expander 6. If the optimal amount of refrigerant flowing into the expander 6 is smaller than the calculated optimal refrigerant amount, the opening of the pre-expansion valve 5 is reduced to increase the high pressure side pressure, thereby increasing the volume flow rate of refrigerant flowing into the expander 6.

The $CO_2$ refrigerant expanded by the pre-expansion valve 5 and the expander 6 or the $CO_2$ refrigerant expanded by the sub-expander 21 is introduced into the indoor heat exchanger 8 through the second four-way valve 4, and is evaporated and suctions heat in the indoor heat exchanger 8. A room is cooled by the endotherm. The refrigerant which has been evaporated is introduced into the auxiliary compressor 10 through the second four-way valve 9 and supercharged by the auxiliary compressor 10 and drawn into the compressor 1.

Next, a heating operation mode in which the outdoor heat exchanger 3 is used as the evaporator and the indoor heat exchanger 8 is used as the gas cooler will be explained. A flow of a refrigerant in this heating operation mode is shown with dashed arrows in the drawing.

Refrigerant at the time of the heating operation mode is compressed at a high temperature and under a high pressure and is discharged by the compressor 1 which is driven by the motor 12, and is introduced into the auxiliary compressor 10 through the first four-way valve 2 and the third four-way valve 9 and is further super-pressurized by the auxiliary compressor 10. The refrigerant super-charged by the auxiliary compressor 10 is introduced into the indoor heat exchanger 8 through the third four-way valve 9. In the indoor heat exchanger 8, since $CO_2$ refrigerant is in a supercritical state, the refrigerant is not brought into two-phase state, and dissipates heat to outside fluid such as air and water. A room is heated utilizing this radiation. Then, the $CO_2$ refrigerant is introduced into the pre-expansion valve 5, the expander 6 and the sub-expander 21 and is expanded by the pre-expansion valve 5, the expander 6 and the sub-expander 21. Power recover by the expander 6 at the time of expanding operation is used for driving the auxiliary compressor 10. At that time, an optimal amount of refrigerant flowing into the expander 6 is calculated from a high pressure refrigerant temperature and a high pressure refrigerant pressure detected on the side of an outlet of the indoor heat exchanger 8. If the volume flow rate is greater than the calculated optimal refrigerant amount, torque of the electric generator 22 (load of electric generator) is reduced to increase the amount of refrigerant flowing into the bypass circuit, thereby reducing the volume flow rate of refrigerant flowing into the expander 6. If the optimal amount of refrigerant flowing into the expander 6 is smaller than the calculated optimal refrigerant amount, the opening of the pre-expansion valve 5 is reduced to increase the high pressure side pressure, thereby increasing the volume flow rate of refrigerant flowing into the expander 6.

The $CO_2$ refrigerant expanded by the pre-expansion valve 5 and the expander 6 or the $CO_2$ refrigerant expanded by the sub-expander 21 is introduced into the outdoor heat exchanger 3 through the second four-way valve 4, and is evaporated and suctions heat in the outdoor heat exchanger 3. The refrigerant which has been evaporated is drawn into the compressor 1 through the first four-way valve 2.

As described above, according to this embodiment, torque (i.e., load of electric generator) of the electric generator 22 connected to the sub-expander 21 is changed to adjust the amount of refrigerant flowing through the bypass circuit, thereby controlling the amount of refrigerant flowing through the expander 6, and opening of the pre-expansion valve 5 is changed to adjust the high pressure side pressure, thereby controlling the amount of refrigerant flowing through the expander 6. Therefore, it is possible to efficiently recover power in the expander 6. Power recover from the sub-expander 21 is utilized for generating electricity of the electric generator 22, and it is possible to recover more power from the refrigeration cycle.

Further, according to this embodiment, the compressor 1 which compresses refrigerant and the expander 6 and the auxiliary compressor 10 which recover the power are separated from each other. The refrigeration cycle is switched such that the refrigerant is supercharged by the auxiliary compressor 10 at the time of the cooling operation mode, and the refrigerant is super-pressurized at the time of the heating operation mode. With this structure, it is possible to allow the expander 6 to operate as a supercharging type expander which is suitable for cooling, and as a super-pressurizing type expander which is suitable for heating.

A refrigeration cycle apparatus of another embodiment of the present invention will be explained with reference to the drawing.

Figure 44:
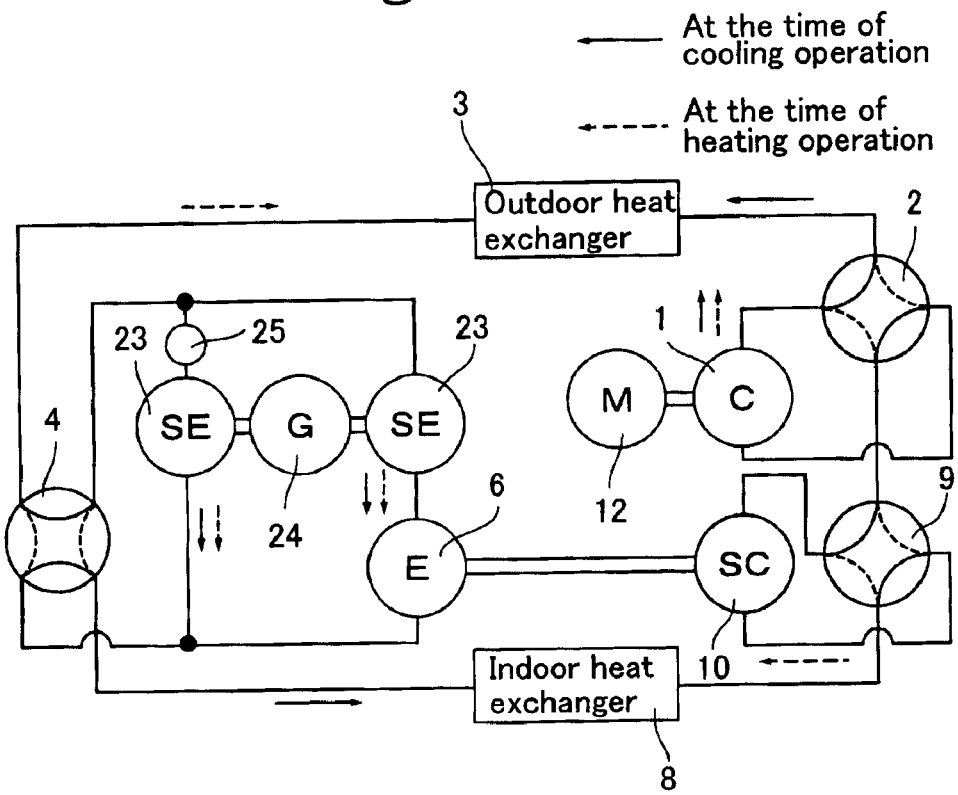
FIG. 44 shows a structure of a heat pump type cooling and heating air conditioner according to another embodiment of the invention.

FIG. 44 shows a structure of the heat pump type air conditioner of this embodiment.

As shown in FIG. 44, the heat pump type air conditioner of this embodiment uses a $CO_2$ refrigerant as a refrigerant, and comprises a refrigerant circuit in which a compressor 1 having a motor 12, an outdoor heat exchanger 3, an expander 6, an indoor heat exchanger 8 and an auxiliary compressor 10 are connected to one another through pipes.

The expander 6 is provided at its inflow side with a sub-expander 23, and an electric generator 22 is connected to a drive shaft of the sub-expander 23.

A bypass circuit for bypassing the sub-expander 23 and the expander 6 is provided in parallel to the sub-expander 23 and the expander 6. The bypass circuit is provided with a sub-expander 21. The bypass circuit is connected to the second four-way valve 4 like the sub-expander 23 and the expander 6.

Here, the electric generator 22 includes a clutch mechanism which is connected to one of the sub-expander 21 and the sub-expander 23. The bypass circuit is provided at its inflow side with a flow path valve 25.

A drive shaft of the expander 6 and a drive shaft of the auxiliary compressor 10 are connected to each other, and the auxiliary compressor 10 is driven by power recover by the expander 6.

The refrigerant circuit includes a first four-way valve 2 to which a discharge side pipe and a suction side pipe of the compressor 1 are connected, a second four-way valve 4 to which a discharge side pipe and a suction side pipe of the expander 6 are connected, and a third four-way valve 9 to which a discharge side pipe and a suction side pipe of the auxiliary compressor 10 are connected. When refrigerant flows in a condition that the outdoor heat exchanger 3 is used as a gas cooler and the indoor heat exchanger 8 is used as an evaporator, the first four-way valve 2 and the third four-way valve 9 are switched over so that the discharge side of the auxiliary compressor 10 becomes a suction side of the compressor 1. When refrigerant flows in a condition that the outdoor heat exchanger 3 is used as the evaporator and the indoor heat exchanger 8 is used as the gas cooler, the first four-way valve 2 and the third four-way valve 9 are switched over so that the discharge side of the compressor 1 becomes a suction side of the auxiliary compressor 10. By switching of the second four-way valve 4, a direction of the refrigerant flowing through the expander 6 becomes always the same direction.

The operation of the heat pump type cooling and heating air conditioner of this embodiment will be explained.

First, a cooling operation mode in which the outdoor heat exchanger 3 is used as a gas cooler and the indoor heat exchanger 8 is used as an evaporator will be explained. A flow of the refrigerant in the cooling operation mode is shown with solid arrows in the drawing.

Refrigerant at the time of the cooling operation mode is compressed at a high temperature and under a high pressure and is discharged by the compressor 1 which is driven by the motor 12. The refrigerant is introduced into the outdoor heat exchanger 3. In the outdoor heat exchanger 3, since $CO_2$ refrigerant is in a supercritical state, the refrigerant is not brought into two-phase state, and dissipates heat to outside fluid such as air and water. Then, the $CO_2$ refrigerant is introduced into the sub-expander 23 and the expander 6 and is expanded by the sub-expander 23 and the expander 6. Power recover by the expander 6 at the time of expanding operation is used for driving the auxiliary compressor 10. At that time, an optimal amount of refrigerant flowing into the expander 6 is calculated from a high pressure refrigerant temperature and a high pressure refrigerant pressure detected on the side of an outlet of the outdoor heat exchanger 3. If the volume flow rate is greater than the calculated optimal refrigerant amount, the flow path valve 25 is opened, the electric generator 22 is connected to the sub-expander 21 to allow refrigerant to flow into the bypass circuit, thereby reducing the volume flow rate of refrigerant flowing into the expander 6. In this case, the sub-expander 23 is not allowed to operate. It is preferable that torque of the electric generator 22 is adjusted to change the bypass amount. If the volume flow rate is smaller than the calculated optimal refrigerant amount, the flow path valve 25 is closed, the electric generator 22 is connected to the sub-expander 23, the high pressure side pressure is increased, and the volume flow rate of refrigerant flowing into the expander 6 is increased. In this case, the sub-expander 21 is not allowed to operate. It is preferable that torque of the electric generator 22 is adjusted to change the high pressure side pressure.

The $CO_2$ refrigerant expanded by the sub-expander 23 and the expander 6 or the $CO_2$ refrigerant expanded by the sub-expander 21 and the expander 6 is introduced into the indoor heat exchanger 8 through the second four-way valve 4 and is evaporated and suctions heat in the indoor heat exchanger 8. A room is cooled by this endotherm. The refrigerant which has been evaporated is introduced into the auxiliary compressor 10 and supercharged by the auxiliary compressor 10 and is drawn into the compressor 1.

Next, a heating operation mode in which the outdoor heat exchanger 3 is used as the evaporator and the indoor heat exchanger 8 is used as the gas cooler will be explained. A flow of a refrigerant in this heating operation mode is shown with dashed arrows in the drawing.

Refrigerant at the time of the heating operation mode is compressed at a high temperature and under a high pressure and is discharged by the compressor 1 which is driven by the motor 12, and is introduced into the auxiliary compressor 10 through the first four-way valve 2 and the third four-way valve 9 and is further super-pressurized by the auxiliary compressor 10. The refrigerant super-charged by the auxiliary compressor 10 is introduced into the indoor heat exchanger 8 through the third four-way valve 9. In the indoor heat exchanger 8, since $CO_2$ refrigerant is in a supercritical state, the refrigerant is not brought into two-phase state, and dissipates heat to outside fluid such as air and water. A room is heated utilizing this radiation. Then, the $CO_2$ refrigerant is introduced into the sub-expander 23 and the expander 6 and is expanded by the sub-expander 23 and the expander 6. Power recover by the expander 6 at the time of expanding operation is used for driving the auxiliary compressor 10. At that time, an optimal amount of refrigerant flowing into the expander 6 is calculated from a high pressure refrigerant temperature and a high pressure refrigerant pressure detected on the side of an outlet of the indoor heat exchanger 8. If the volume flow rate is greater than the calculated optimal refrigerant amount, the flow path valve 25 is opened, the electric generator 22 is connected to the sub-expander 21 to allow refrigerant to flow into the bypass circuit, thereby reducing the volume flow rate of refrigerant flowing into the expander 6. In this case, the sub-expander 23 is not allowed to operate. It is preferable that torque of the electric generator 22 is adjusted to change the bypass amount. If the volume flow rate is smaller than the calculated optimal refrigerant amount, the flow path valve 25 is closed, the electric generator 22 is connected to the sub-expander 23, the high pressure side pressure is increased, and the volume flow rate of refrigerant flowing into the expander 6 is increased. In this case, the sub-expander 21 is not allowed to operate. It is preferable that torque of the electric generator 22 is adjusted to change the high pressure side pressure.

The $CO_2$ refrigerant expanded by the sub-expander 23 and the expander 6 or the $CO_2$ refrigerant expanded by the sub-expander 21 and the expander 6 is introduced into the outdoor heat exchanger 3 through the second four-way valve 4, and is evaporated and suctions heat in the outdoor heat exchanger 3. The refrigerant which has been evaporated is drawn into the compressor 1 through the first four-way valve 2.

As described above, according to this embodiment, the open/close valve 25 is opened and the electric generator 22 is connected to the sub-expander 21 to adjust the amount of refrigerant flowing through the bypass circuit, thereby controlling the amount of refrigerant flowing through the expander 6, and the open/close valve 25 is closed and the torque of the electric generator 24 (i.e., load of electric generator) connected to the sub-expander 23 is changed to adjust the high pressure side pressure, thereby controlling the amount of refrigerant flowing through the expander 6. Therefore, it is possible to efficiently recover power in the expander 6. Power recover from the sub-expander 21 is utilized for generating electricity of the electric generator 22, and it is possible to recover more power from the refrigeration cycle.

Further, according to this embodiment, the compressor 1 which compresses refrigerant and the expander 6 and the auxiliary compressor 10 which recover the power are separated from each other. The refrigeration cycle is switched such that the refrigerant is supercharged by the auxiliary compressor 10 at the time of the cooling operation mode, and the refrigerant is super-pressurized at the time of the heating operation mode. With this structure, it is possible to allow the expander 6 to operate as a supercharging type expander which is suitable for cooling, and as a super-pressurizing type expander which is suitable for heating.

A refrigeration cycle apparatus of another embodiment of the present invention will be explained with reference to the drawing.

Figure 45:
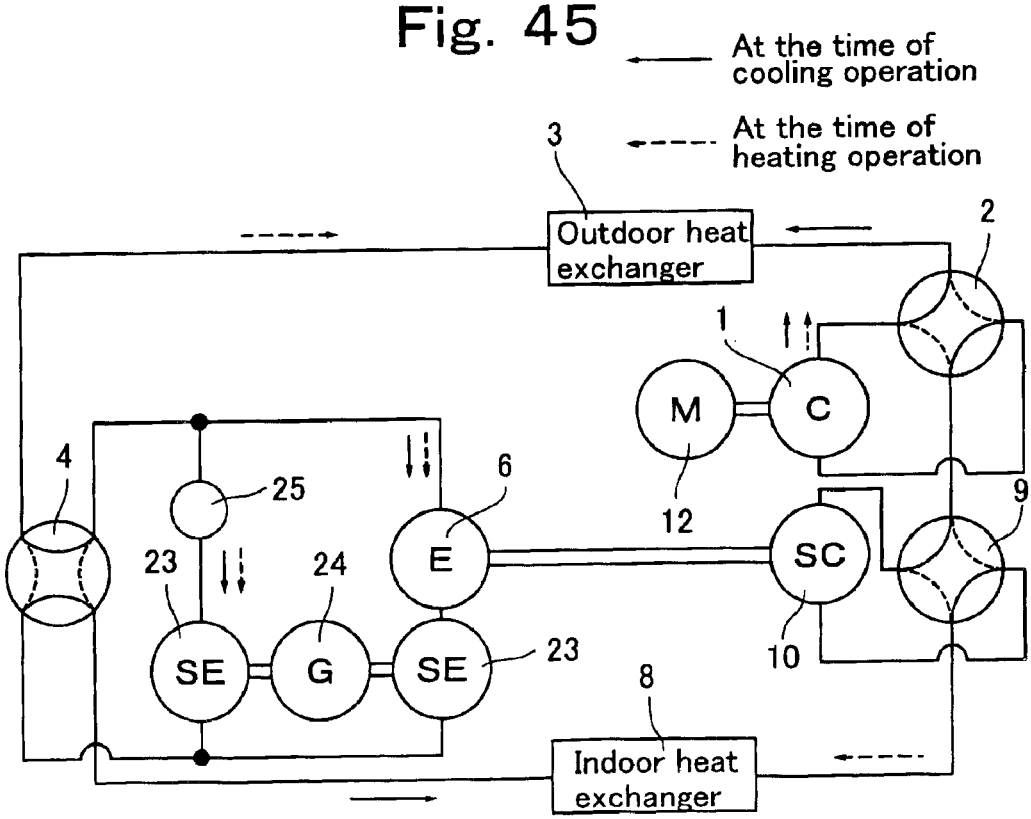
FIG. 45 shows a structure of a heat pump type cooling and heating air conditioner according to another embodiment of the invention.

FIG. 45 shows a structure of the heat pump type air conditioner of this embodiment.

As shown in FIG. 45, the heat pump type air conditioner of this embodiment uses a $CO_2$ refrigerant as a refrigerant, and comprises a refrigerant circuit in which a compressor 1 having a motor 12, an outdoor heat exchanger 3, an expander 6, an indoor heat exchanger 8 and an auxiliary compressor 10 are connected to one another through pipes.

The expander 6 is provided at its discharge side with a sub-expander 23, and an electric generator 22 is connected to a drive shaft of the sub-expander 23.

A bypass circuit for bypassing the sub-expander 23 and the expander 6 is provided in parallel to the sub-expander 23 and the expander 6. The bypass circuit is provided with a sub-expander 21. The bypass circuit is connected to the second four-way valve 4 like the sub-expander 23 and the expander 6.

Here, the electric generator 22 includes a clutch mechanism which is connected to one of the sub-expander 21 and the sub-expander 23. The bypass circuit is provided at its inflow side with a flow path valve 25.

A drive shaft of the expander 6 and a drive shaft of the auxiliary compressor 10 are connected to each other, and the auxiliary compressor 10 is driven by power recover by the expander 6.

The refrigerant circuit includes a first four-way valve 2 to which a discharge side pipe and a suction side pipe of the compressor 1 are connected, a second four-way valve 4 to which a discharge side pipe and a suction side pipe of the expander 6 are connected, and a third four-way valve 9 to which a discharge side pipe and a suction side pipe of the auxiliary compressor 10 are connected. When refrigerant flows in a condition that the outdoor heat exchanger 3 is used as a gas cooler and the indoor heat exchanger 8 is used as an evaporator, the first four-way valve 2 and the third four-way valve 9 are switched over so that the discharge side of the auxiliary compressor 10 becomes a suction side of the compressor 1. When refrigerant flows in a condition that the outdoor heat exchanger 3 is used as the evaporator and the indoor heat exchanger 8 is used as the gas cooler, the first four-way valve 2 and the third four-way valve 9 are switched over so that the discharge side of the compressor 1 becomes a suction side of the auxiliary compressor 10. By switching of the second four-way valve 4, a direction of the refrigerant flowing through the expander 6 becomes always the same direction.

The operation of the heat pump type cooling and heating air conditioner of this embodiment will be explained.

First, a cooling operation mode in which the outdoor heat exchanger 3 is used as a gas cooler and the indoor heat exchanger 8 is used as an evaporator will be explained. A flow of the refrigerant in the cooling operation mode is shown with solid arrows in the drawing.

Refrigerant at the time of the cooling operation mode is compressed at a high temperature and under a high pressure and is discharged by the compressor 1 which is driven by the motor 12. The refrigerant is introduced into the outdoor heat exchanger 3. In the outdoor heat exchanger 3, since $CO_2$ refrigerant is in a supercritical state, the refrigerant is not brought into two-phase state, and dissipates heat to outside fluid such as air and water. Then, the $CO_2$ refrigerant is introduced into the expander 6 and the sub-expander 23 and is expanded by the expander 6 and the sub-expander 23. Power recover by the expander 6 at the time of expanding operation is used for driving the auxiliary compressor 10. At that time, an optimal amount of refrigerant flowing into the expander 6 is calculated from a high pressure refrigerant temperature and a high pressure refrigerant pressure detected on the side of an outlet of the outdoor heat exchanger 3. If the volume flow rate is greater than the calculated optimal refrigerant amount, the flow path valve 25 is opened, the electric generator 22 is connected to the sub-expander 21 to allow refrigerant to flow into the bypass circuit, thereby reducing the volume flow rate of refrigerant flowing into the expander 6. In this case, the sub-expander 23 is not allowed to operate. It is preferable that torque of the electric generator 22 is adjusted to change the bypass amount. If the volume flow rate is smaller than the calculated optimal refrigerant amount, the flow path valve 25 is closed, the electric generator 22 is connected to the sub-expander 23, the low pressure side pressure is reduced, and the volume flow rate of refrigerant flowing into the expander 6 is increased. In this case, the sub-expander 21 is not allowed to operate. It is preferable that torque of the electric generator 22 is adjusted to change the low pressure side pressure.

The $CO_2$ refrigerant expanded by the sub-expander 23 and the expander 6 or the $CO_2$ refrigerant expanded by the sub-expander 21 and the expander 6 is introduced into the indoor heat exchanger 8 through the second four-way valve 4 and is evaporated and suctions heat in the indoor heat exchanger 8. A room is cooled by this endotherm. The refrigerant which has been evaporated is introduced into the auxiliary compressor 10 and supercharged by the auxiliary compressor 10 and is drawn into the compressor 1.

Next, a heating operation mode in which the outdoor heat exchanger 3 is used as the evaporator and the indoor heat exchanger 8 is used as the gas cooler will be explained. A flow of a refrigerant in this heating operation mode is shown with dashed arrows in the drawing.

Refrigerant at the time of the heating operation mode is compressed at a high temperature and under a high pressure and is discharged by the compressor 1 which is driven by the motor 12, and is introduced into the auxiliary compressor 10 through the first four-way valve 2 and the third four-way valve 9 and is further super-pressurized by the auxiliary compressor 10. The refrigerant super-charged by the auxiliary compressor 10 is introduced into the indoor heat exchanger 8 through the third four-way valve 9. In the indoor heat exchanger 8, since $CO_2$ refrigerant is in a supercritical state, the refrigerant is not brought into two-phase state, and dissipates heat to outside fluid such as air and water. A room is heated utilizing this radiation. Then, the $CO_2$ refrigerant is introduced into the expander 6 and the sub-expander 23 and is expanded by the expander 6 and the sub-expander 23. Power recover by the expander 6 at the time of expanding operation is used for driving the auxiliary compressor 10. At that time, an optimal amount of refrigerant flowing into the expander 6 is calculated from a high pressure refrigerant temperature and a high pressure refrigerant pressure detected on the side of an outlet of the indoor heat exchanger 8. If the volume flow rate is greater than the calculated optimal refrigerant amount, the flow path valve 25 is opened, the electric generator 22 is connected to the sub-expander 21 to allow refrigerant to flow into the bypass circuit, thereby reducing the volume flow rate of refrigerant flowing into the expander 6. In this case, the sub-expander 23 is not allowed to operate. It is preferable that torque of the electric generator 22 is adjusted to change the bypass amount. If the volume flow rate is smaller than the calculated optimal refrigerant amount, the flow path valve 25 is closed, the electric generator 22 is connected to the sub-expander 23, the low pressure side pressure is reduced, and the volume flow rate of refrigerant flowing into the expander 6 is increased. In this case, the sub-expander 21 is not allowed to operate. It is preferable that torque of the electric generator 22 is adjusted to change the low pressure side pressure.

The $CO_2$ refrigerant expanded by the sub-expander 23 and the expander 6 or the $CO_2$ refrigerant expanded by the sub-expander 21 and the expander 6 is introduced into the outdoor heat exchanger 3 through the second four-way valve 4, and is evaporated and suctions heat in the outdoor heat exchanger 3. The refrigerant which has been evaporated is drawn into the compressor 1 through the first four-way valve 2.

As described above, according to this embodiment, the open/close valve 25 is opened and the electric generator 22 is connected to the sub-expander 21 to adjust the amount of refrigerant flowing through the bypass circuit, thereby controlling the amount of refrigerant flowing through the expander 6, and the open/close valve 25 is closed and the torque of the electric generator 24 (i.e., load of electric generator) connected to the sub-expander 23 is changed to adjust the high pressure side pressure, thereby controlling the amount of refrigerant flowing through the expander 6. Therefore, it is possible to efficiently recover power in the expander 6. Power recover from the sub-expander 21 is utilized for generating electricity of the electric generator 22, and it is possible to recover more power from the refrigeration cycle.

Further, according to this embodiment, the compressor 1 which compresses refrigerant and the expander 6 and the auxiliary compressor 10 which recover the power are separated from each other. The refrigeration cycle is switched such that the refrigerant is supercharged by the auxiliary compressor 10 at the time of the cooling operation mode, and the refrigerant is super-pressurized at the time of the heating operation mode. With this structure, it is possible to allow the expander 6 to operate as a supercharging type expander which is suitable for cooling, and as a super-pressurizing type expander which is suitable for heating.

Although the above embodiments have been described using the heat pump type cooling and heating air conditioner, the present invention can also be applied to other refrigeration cycle apparatuses in which the outdoor heat exchanger 3 is used as a first heat exchanger, the indoor heat exchanger 8 is used as a second heat exchanger, and the first and second heat exchangers are utilized for hot and cool water devices or thermal storages.

As described above, according to the present invention, it is possible to reduce the constraint that the density ratio is constant as small as possible, and to obtain high power recovering effect in a wide operation range.

What is claimed is:

1. A refrigeration cycle apparatus using carbon dioxide as a refrigerant, comprising:

a compressor;

an outdoor heat exchanger;

an expander;

an indoor heat exchanger;

an auxiliary compressor; and at least three four-way valves connecting said compressor, said outdoor heat exchanger, said expander, said indoor heat exchanger, and said auxiliary compressor, wherein said auxiliary compressor is driven by power recovered by said expander, and wherein when refrigerant flows using said indoor heat exchanger as an evaporator, a discharge side of said auxiliary compressor becomes a suction side of said compressor, and when all of said four-way valves are switched over such that refrigerant flows using said indoor heat exchanger as a gas cooler, a discharge side of said compressor becomes a suction side of said auxiliary compressor.

2. A refrigeration cycle apparatus using carbon dioxide as a refrigerant, comprising:

a compressor;

an outdoor heat exchanger;

an expander;

an indoor heat exchanger;

an auxiliary compressor; and a plurality of four-way valves connecting said compressor, said outdoor heat exchanger, said expander, said indoor heat exchanger, and said auxiliary compressor, wherein said auxiliary compressor is driven by power recovered by said expander, wherein when refrigerant flows using said indoor heat exchanger as an evaporator, a discharge side of said auxiliary compressor becomes a suction side of said compressor, and when said plurality of four-way valves are switched over such that refrigerant flows using said indoor heat exchanger as a gas cooler, a discharge side of said compressor becomes a suction side of said auxiliary compressor, and wherein said plurality of four-way valves include a first four-way valve to which a discharge side pipe and a suction side pipe of said compressor are connected, a second four-way valve to which a discharge side pipe and a suction side pipe of said expander are connected, and a third four-way valve to which a discharge side pipe and a suction side pipe of said auxiliary compressor are connected, wherein when refrigerant flows using said indoor heat exchanger as the evaporator, the discharge side of said auxiliary compressor becomes the suction side of said compressor, and when refrigerant flows using said indoor heat exchanger as the gas cooler, the discharge side of said compressor becomes the suction side of said auxiliary compressor by said first four-way valve and said third four-way valve, and a direction of refrigerant flowing through said expander is always set in the same direction by said second four-way valve.

3. The refrigeration cycle apparatus according to claim 2, wherein at least one of said second four-way valve and said third four-way valve is replaced by a check valve bridge circuit comprising four check valves.

4. A refrigeration cycle apparatus using carbon dioxide as a refrigerant, comprising:

a compressor;

an outdoor heat exchanger;

an expander;

an indoor heat exchanger;

an auxiliary compressor; and a plurality of four-way valves connecting said compressor, said outdoor heat exchanger, said expander, said indoor heat exchanger, and said auxiliary compressor, wherein said auxiliary compressor is driven by power recovered by said expander, wherein when refrigerant flows using said indoor heat exchanger as an evaporator, a discharge side of said auxiliary compressor becomes a suction side of said compressor, and when said plurality of four-way valves are switched over such that refrigerant flows using said indoor heat exchanger as a gas cooler, a discharge side of said compressor becomes a suction side of said auxiliary compressor, and wherein said refrigeration cycle apparatus further comprises a bypass circuit which reduces an amount of refrigerant flowing into said expander, and a bypass valve which adjusts an amount of refrigerant flowing through said bypass circuit.

5. A refrigeration cycle apparatus using carbon dioxide as a refrigerant, comprising:

a compressor;

an outdoor heat exchanger;

an expander;

an indoor heat exchanger;

an auxiliary compressor; and a plurality of four-way valves connecting said compressor, said outdoor heat exchanger, said expander, said indoor heat exchanger, and said auxiliary compressor, wherein said auxiliary compressor is driven by power recovered by said expander, wherein when refrigerant flows using said indoor heat exchanger as an evaporator, a discharge side of said auxiliary compressor becomes a suction side of said compressor, and when said plurality of four-way valves are switched over such that refrigerant flows using said indoor heat exchanger as a gas cooler, a discharge side of said compressor becomes a suction side of said auxiliary compressor, and wherein said refrigeration cycle apparatus further comprises a pre-expansion valve which increases an amount of refrigerant flowing into said expander.

6. A refrigeration cycle apparatus using carbon dioxide as a refrigerant, comprising:

a compressor;

an outdoor heat exchanger;

an expander;

an indoor heat exchanger;

an auxiliary compressor; and a plurality of four-way valves connecting said compressor, said outdoor heat exchanger, said expander, said indoor heat exchanger, and said auxiliary compressor, wherein said auxiliary compressor is driven by power recovered by said expander, wherein when refrigerant flows using said indoor heat exchanger as an evaporator, a discharge side of said auxiliary compressor becomes a suction side of said compressor, and when said plurality of four-way valves are switched over such that refrigerant flows using said indoor heat exchanger as a gas cooler, a discharge side of said compressor becomes a suction side of said auxiliary compressor, and wherein a suction capacity of said compressor is set to 3 to 6 times of a suction capacity of said expander.

7. A refrigeration cycle apparatus using carbon dioxide as a refrigerant, comprising:

a compressor;

an outdoor heat exchanger;

an expander;

an indoor heat exchanger;

an auxiliary compressor; and a plurality of four-way valves connecting said compressor, said outdoor heat exchanger, said expander, said indoor heat exchanger, and said auxiliary compressor, wherein said auxiliary compressor is driven by power recovered by said expander, wherein when refrigerant flows using said indoor heat exchanger as an evaporator, a discharge side of said auxiliary compressor becomes a suction side of said compressor, and when said plurality of four-way valves are switched over such that refrigerant flows using said indoor heat exchanger as a gas cooler, a discharge side of said compressor becomes a suction side of said auxiliary compressor, and wherein a suction capacity of said compressor is set to 4 times of a suction capacity of said expander, and a suction capacity of said auxiliary compressor is set to 4.3 times of the suction capacity of said expander.

8. A refrigeration cycle apparatus using carbon dioxide as a refrigerant, comprising:

a compressor;

an outdoor heat exchanger;

an expander;

an indoor heat exchanger;

an auxiliary compressor; and a plurality of four-way valves connecting said compressor, said outdoor heat exchanger, said expander, said indoor heat exchanger, and said auxiliary compressor, wherein said auxiliary compressor is driven by power recovered by said expander, wherein when refrigerant flows using said indoor beat exchanger as an evaporator, a discharge side of said auxiliary compressor becomes a suction side of said compressor, and when said plurality of four-way valves are switched over such that refrigerant flows using said indoor heat exchanger as a gas cooler, a discharge side of said compressor becomes a suction side of said auxiliary compressor, and wherein a cooling operation rated frequency of said compressor and a cooling operation rated frequency of said auxiliary compressor are the same frequency.

9. A refrigeration cycle apparatus using carbon dioxide as a refrigerant, comprising:

a compressor;

an outdoor heat exchanger;

an exchanger;

an indoor heat exchanger;

an auxiliary compressor; and a plurality of four-way valves connecting said compressor, said outdoor heat exchanger, said expander, said indoor heat exchanger, and said auxiliary compressor, wherein said auxiliary compressor is driven by power recovered by said expander, wherein when refrigerant flows using said indoor heat exchanger as an evaporator, a discharge side of said auxiliary compressor becomes a suction side of said compressor, and when said plurality of four-way valves are switched over such that refrigerant flows using said indoor heat exchanger as a gas cooler, a discharge side of said compressor becomes a suction side of said auxiliary compressor, and wherein an operation frequency of said auxiliary compressor is set lower than an operation frequency of said compressor.

10. The refrigeration cycle apparatus using carbon dioxide as a refrigerant and having a compressor, an outdoor heat exchanger, an expander and an indoor heat exchanger, in which said power recovered by said expander is used for driving said compressor, wherein a sub-expander is provided in parallel to said expander, and an electric generator is connected to said sub-expander.

11. The refrigeration cycle apparatus using carbon dioxide as a refrigerant and having a compressor, an outdoor heat exchanger, an expander and an indoor heat exchanger, in which said power recovered by said expander is used for driving said compressor, wherein said expander is provided at its suction side with a sub-expander, and an electric generator is connected to said sub-expander.

12. The refrigeration cycle apparatus using carbon dioxide as a refrigerant and having a compressor, an outdoor heat exchanger, an expander and an indoor heat exchanger, in which said power recovered by said expander is used for driving said compressor, wherein said expander is provided at its discharge side with a sub-expander, and an electric generator is connected to said sub-expander.

13. The refrigeration cycle apparatus using carbon dioxide as a refrigerant and having a compressor, an outdoor heat exchanger, an expander and an indoor heat exchanger, in which said power recovered by said expander is used for driving said compressor, wherein said expander is provided at its suction side with a first sub-expander, a second sub-expander is provided in parallel to said expander and said first sub-expander, and electric generators are connected to said first sub-expander and said second sub-expander, respectively.

14. The refrigeration cycle apparatus using carbon dioxide as a refrigerant and having a compressor, an outdoor heat exchanger, an expander and an indoor heat exchanger, in which said power recovered by said expander is used for driving said compressor, wherein said expander is provided at its suction side with a sub-expander, a bypass flow path is provided in parallel to said expander and said sub-expander, and said bypass flow path is provided with a bypass valve.

15. The refrigeration cycle apparatus using carbon dioxide as a refrigerant and having a compressor, an outdoor heat exchanger, an expander and an indoor heat exchanger, in which said power recovered by said expander is used for driving said compressor, wherein said expander is provided at its suction side with a pre-expansion valve, a sub-expander is provided in parallel to said expander and said pre-expansion valve, and an electric generator is connected to said sub-expander.

16. The refrigeration cycle apparatus using carbon dioxide as a refrigerant and having a compressor, an outdoor heat exchanger, an expander and an indoor heat exchanger, in which said power recovered by said expander is used for driving said compressor, wherein said expander is provided at its suction side with a first sub-expander, a second sub-expander is provided in parallel to said expander and said first sub-expander, an electric generator connected to said first sub-expander is an electric generator connected to said second sub-expander, and said electric generator includes a clutch mechanism which is connected to one of said first sub-expander and said second sub-expander.

17. The refrigeration cycle apparatus using carbon dioxide as a refrigerant and having a compressor, an outdoor heat exchanger, an expander and an indoor heat exchanger, in which said power recovered by said expander is used for driving said compressor, wherein said expander is provided at its discharge side with a first sub-expander, a second expander is provided in parallel to said expander and said first sub-expander, an electric generator connected to said first sub-expander is an electric generator connected to said second sub-expander, and said electric generator includes a clutch mechanism which is connected to one of said first sub-expander and said second sub-expander.

18. The refrigeration cycle apparatus according to any one of claims 10 to 17, wherein the suction side of said compressor or the discharge side of said compressor is provided with said auxiliary compressor, and power recovered by said expander is used as power for driving said auxiliary compressor instead of said compressor.

19. The refrigeration cycle apparatus according to any one of claims 10 to 17, further comprising a first four-way valve to which a discharge side pipe and a suction side pipe of said compressor are connected, and a second four-way valve to which discharge side pipes and suction side pipes of said expander and said sub-expander are connected, wherein refrigerant discharged from said compressor is selectively allowed to flow into said indoor heat exchanger or said outdoor heat exchanger by said first four-way valve, a direction of refrigerant flowing through said expander and said sub-expander is always set in the same direction by said second four-way valve.

20. The refrigeration cycle apparatus according to claim 18, further comprising a first four-way valve to which discharge side pipes and suction side pipes of said compressor and said auxiliary compressor are connected, and a second four-way valve to which discharge side pipes and suction side pipes of said expander and said sub-expander are connected, wherein refrigerant discharged from said compressor and said auxiliary compressor is selectively allowed to flow into said indoor heat exchanger or said outdoor heat exchanger by said first four-way valve, a direction of refrigerant flowing through said expander and said sub-expander is always set in the same direction by said second four-way valve.

* * * * *